US007523554B2

(12) United States Patent
Kimura et al.

(10) Patent No.: US 7,523,554 B2
(45) Date of Patent: Apr. 28, 2009

(54) METHOD OF MANUFACTURING A WHEEL RIM

(75) Inventors: Shizuo Kimura, Saitama (JP); Kenzo Takeda, Utsunomiya (JP); Ikuo Kato, Kumagaya (JP); Yukio Uchiyama, Higashimtasuyama (JP); Tadashi Goto, Hidaka (JP); Nobuyuki Kakiya, Tochigi-ken (JP); Kiyoshi Satou, Hamamatsu (JP); Naotake Marui, Hamamatsu (JP); Shinichi Ohnaka, Utsunomiya (JP); Tatsuo Yamanaka, Hamamatsu (JP); Jin Fukuda, Tochigi-ken (JP); Taisei Wakisaka, Tochigi-ken (JP); Haruo Machida, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 85 days.

(21) Appl. No.: 10/560,835

(22) PCT Filed: Jun. 17, 2004

(86) PCT No.: PCT/JP2004/008543

§ 371 (c)(1),
(2), (4) Date: May 31, 2006

(87) PCT Pub. No.: WO2004/112985

PCT Pub. Date: Dec. 29, 2004

(65) Prior Publication Data

US 2006/0265876 A1 Nov. 30, 2006

(30) Foreign Application Priority Data

Jun. 17, 2003 (JP) ..... 2003-171828
Jun. 18, 2003 (JP) ..... 2003-172930
Jun. 18, 2003 (JP) ..... 2003-172935
Jul. 4, 2003 (JP) ..... 2003-270938
Jul. 14, 2003 (JP) ..... 2003-274042
Aug. 7, 2003 (JP) ..... 2003-289148

(51) Int. Cl.
*B21K 1/38* (2006.01)
*B21D 39/02* (2006.01)

(52) U.S. Cl. ..... 29/894.353; 29/894.322; 29/557; 228/158; 72/52

(58) Field of Classification Search ..... 29/894.322, 29/894.353, 894.354, 557; 72/51, 52
See application file for complete search history.

(56) References Cited

U.S. PATENT DOCUMENTS 6,598,294 B2 7/2003 Yamaguchi et al.
2002/0007556 A1 1/2002 Marron et al.
2006/0107715 A1 * 5/2006 Imamura et al. ..... 72/56

FOREIGN PATENT DOCUMENTS

EP 1 057 573 12/2000

(Continued)

OTHER PUBLICATIONS

Japanese Office Action mailed Jan. 23, 2007 with partial English translation (3 pages).

(Continued)

*Primary Examiner*—David P Bryant
*Assistant Examiner*—Sarang Afzali
(74) *Attorney, Agent, or Firm*—Kratz, Quintos & Hanson, LLP

(57) ABSTRACT

A method of manufacturing a wheel rim by bringing end faces of a workpiece into abutment against each other to form a hollow cylindrical body and forming a circumferential recess which is depressed from an outer circumferential wall of said hollow cylindrical body toward an inner circumferential wall thereof, including providing protrusions disposed near ends of a joined area of the hollow cylindrical body and extending in a joining direction, and then pressing the outer circumferential wall of the hollow cylindrical body to form the recess.

5 Claims, 40 Drawing Sheets

FOREIGN PATENT DOCUMENTS

| | | |
|---|---|---|
| JP | 57-60804 | 4/1982 |
| JP | 60-143454 | 9/1985 |
| JP | 06-250850 | 12/1985 |
| JP | 60-244477 | 12/1985 |
| JP | 61-200622 | 12/1986 |
| JP | 62-51004 | 3/1987 |
| JP | 63-56935 | 4/1988 |
| JP | 63-224826 | 9/1988 |
| JP | 64-38184 | 3/1989 |
| JP | 64-83401 | 3/1989 |
| JP | 2-70304 | 3/1990 |
| JP | 2-70340 | 3/1990 |
| JP | 02-299733 | 12/1990 |
| JP | 03-040030 | 4/1991 |
| JP | 5-58103 | 3/1993 |
| JP | 05-169261 | 7/1993 |
| JP | 05-277851 | 10/1993 |
| JP | 5-310001 | 11/1993 |
| JP | 06-190654 | 7/1994 |
| JP | 06-258301 | 9/1994 |
| JP | 09-171005 | 6/1997 |
| JP | 11-44675 | 2/1999 |
| JP | 2000-180421 | 6/2000 |
| JP | 2000-180422 | 6/2000 |
| JP | 2000-334583 | 12/2000 |
| JP | 2001-526965 | 12/2001 |
| JP | 2002-001550 | 1/2002 |
| JP | 2002-035940 | 2/2002 |
| JP | 2002-45939 | 2/2002 |
| JP | 2002-282980 | 10/2002 |
| JP | 2002-293277 | 10/2002 |
| JP | 2002-350407 | 12/2002 |
| JP | 2003-002001 | 1/2003 |
| JP | 2003-236637 | 8/2003 |

OTHER PUBLICATIONS

Communication from Japanese Patent Office dated May 27, 2008 with English translation (3 pages).
Communication from the Japanese Patent Office in a corresponding application mailed Nov. 25, 2008 with English translation (3 pages).
Japanese Office Action mailed Jan. 20, 2009 with partial English translation (4 pages).

* cited by examiner

METHOD OF MANUFACTURING A WHEEL RIM

TECHNICAL FIELD

The present invention relates to a method of manufacturing a wheel rim from a plate-like blank, a wheel having a wheel rim produced by the method, and a method of manufacturing such a wheel.

BACKGROUND ART

As wheels for supporting tires required for automobiles to travel on, there have widely been used two-piece wheels comprising a wheel rim (hereinafter also referred to simply as "rim") in the form of a hollow cylindrical body and a disk-shaped wheel disk (hereinafter also referred to simply as "disk") inserted in the wheel rim, the wheel rim and the wheel disk being joined to each other by MIG welding, TIG welding, or the like. In recent years, it is a mainstream trend to make both a rim and a disk of aluminum to meet demands for lightweight automobiles.

The disk is manufactured by machining a plate-like aluminum blank such as a an extended aluminum member by drawing, and thereafter forming a hub hole, bolt holes, and ornamental holes for improved design and heat radiation in the aluminum blank by punching or cutting.

The rim is manufactured as follows: First, the end faces of an elongate rectangular plate are brought into abutment against each other, and thereafter the abutting end faces are joined to each other by resistance welding, MIG welding, or the like, thereby forming a hollow cylindrical body.

Then, the welded region of the hollow cylindrical body is trimmed or cut to remove edges, after which the hollow cylindrical body is rolled by a multi-step rolling process (see Patent Document 1, for example), forming a recess called a drop portion 2 in a substantially central region of an outer circumferential wall of the hollow cylindrical body 1, as shown in FIG. 42. The reference numeral 3 in FIG. 42 represents a welded seam.

After curled portions are formed on the opposed ends of the hollow cylindrical body 1, hump portions directed from an inner circumferential wall toward the outer circumferential wall of the hollow cylindrical body 1 are formed, thereby producing a rim.

In the process of forming the drop portion 2, the welded seam 3 may crack, as described in Patent Document 2. If the welded seam 3 cracks, then the production efficiency of the rim is lowered because the cracked welded seam 3 needs to be repaired. According to Patent Document 2, it has been proposed to heat the welded seam 3 to substantially equalize the hardness thereof to the hardness of the other regions, so that the welded seam 3 is prevented from being cracking.

In order to increase the strength of the rim, the ends of the rim may be bent into curled portions, as described in Patent Document 3.

The disk is inserted into the rim thus manufactured, and they are joined to each other by arc welding, thereby producing a wheel.

For joining the disk and the rim to each other by arc welding, the wheel is inclined 30° to the horizontal direction, and the welding torch is aimed at a position that is closer to the disk by a distance corresponding to the diameter of the welding wire. The welding current and voltage, and the moving speed of the welding torch are adjusted depending on the thicknesses of the rim and the disk, for thereby forming a welded bead in the range of about 10 to 30% of the thickness of the rim (see Patent Document 4).

Patent Document 1: Japanese Laid-Open Patent Publication No. 2-70304;

Patent Document 2: Japanese Laid-Open Patent Publication No. 63-224826;

Patent Document 3: Japanese Laid-Open Utility Model Publication No. 63-56935; and Patent Document 4: Japanese Laid-Open Patent Publication No. 5-58103.

DISCLOSURE OF THE INVENTION

PROBLEMS TO BE SOLVED BY THE INVENTION

As described above, the rim generally has hump portions. The hump portions serve to prevent air from leaking from the tire that is mounted on the wheel. If the hump portions have poor dimensional accuracy with respect to the curled portions, then the following problems may arise: If the radii representing raised amounts of the hump portions vary greatly, and the positional relations between the curled portions and the hump portions (the distance by which the curled portions and the hump portions are spaced from each other) vary greatly, then air may tend to leak from the tires.

Therefore, it is desirable to increase the dimensional accuracy of the hump portions. If, however, the welded seam 3 is heated as described in Patent Document 2, then there is a need for a facility and a process for the heat treatment. Consequently, investments required for the facility to produce rims are increased, and productive efficiency of the rims is lowered.

When the drop portion 2 is formed, since the welded seam 3 is hardened and difficult to extend, the material around the welded seam 3 is pulled. As a result, a circumferential edge portion including the welded seam 3 is depressed toward the welding direction, as shown at an enlarged scale in FIG. 43. Because this makes the circumferential edge portion of the rim poor in dimensional accuracy, the rim suffers a low yield. It is difficult to overcome this drawback only by performing the heat treatment as disclosed in Patent Document 2.

In the production of a rim, it is difficult to form a sufficient welded bead for a wheel only by adjusting the aiming and moving speed of the welding torch and the welding current and voltage as welding conditions. Specifically, inasmuch as the thickness of the rim is smaller than that of the disk, the welded bead is exposed on the welded surface of the rim, tending to lower the mechanical strength of the rim itself and impair the hermetic seal at the time the tire is fitted over the rim. If attempts are made to prevent the exposure of the welded beam in order to avoid the above shortcomings, then a gap may be created, failing to provide sufficient bonding strength between the rim and the disk with the welded bead.

Furthermore, because it is difficult to form the welded bead, the welded bead hinders improvement of production efficiency of wheels.

It is a general object of the present invention to provide a method of manufacturing a rim efficiently by accurately machining hump portions and curled portions and by highly accurately establishing the positional relations between the curled portions and the hump portions.

A major object of the present invention is to provide a method of manufacturing a rim having a circumferential edge portion of good dimensional accuracy, with increased production efficiency without the addition of a new facility such as a heat treatment facility and a new process.

Another object of the present invention is to provide a wheel having a wheel rim and a wheel disk which are joined to each other with increased bonding strength by appropriately forming a welded beam, the wheel being capable of being produced with increased production efficiency, and a method of manufacturing such a wheel.

MEANS FOR SOLVING THE PROBLEMS

According to a first aspect of the present invention, there is provided a method of manufacturing a wheel rim from a plate-like blank, comprising the steps of:

curving the blank;

forming a hollow cylindrical body by bringing end faces of the blank into abutment against each other;

forming a recess depressed from a curved outer circumferential wall of the hollow cylindrical body toward an inner circumferential wall thereof;

forming curled portions on opposite ends of the hollow cylindrical body by bending a circular end face of the hollow cylindrical body with the recess formed therein toward another circular end face thereof; and forming hump portions by pressing regions near the curled portions of the hollow cylindrical body with the curled portions on the opposite ends thereof, from the inner circumferential wall to raise the outer circumferential wall.

Preferably, the curled portions should be formed by the first curling step of forming the end faces into respective curved shapes, and the second curling step of forming the curved shapes into rectangular shapes.

The first curling step may be performed by a pressing process and the second curling step may be performed by a spinning process.

In the first curling step, a side wall surface of the recess may be supported and the end face of the hollow cylindrical body near the side wall surface is curled, and thereafter another side wall surface of the recess may be supported and the end face of the hollow cylindrical body near the other side wall surface is curled.

Preferably, the step of forming a hollow cylindrical body is performed by friction stir welding.

Through holes may be formed in the curled portions and the recess after the step of forming hump portions.

According to a second aspect of the present invention, there is provided a method of manufacturing a wheel rim by bringing end faces of a workpiece into abutment against each other to form a hollow cylindrical body and forming a circumferential recess which is depressed from an outer circumferential wall of the hollow cylindrical body toward an inner circumferential wall thereof, the method comprising the steps of providing protrusions disposed near ends of a joined area of the hollow cylindrical body and extending in a joining direction, and then pressing the outer circumferential wall of the hollow cylindrical body to form the recess.

In the above manufacturing method, preferably, fingers are formed on respective corners of the workpiece and joined to form the protrusions.

The hollow cylindrical body may be cut circumferentially to form the protrusions.

Abutting edges of the hollow cylindrical body are joined to each other by friction stir welding.

The recess can be formed by a spinning process or a roll forming process.

According to a third aspect of the present invention, there is provided a wheel for supporting a vehicular tire fitted thereover, comprising:

a wheel rim formed as a hollow cylinder from a plate-like blank; and a wheel disk formed from a plate-like blank, the wheel disk having a peripheral edge portion bent substantially parallel to the central axis of rotation of the wheel and a slanted surface beveled from an end face of the peripheral edge portion toward the central axis of rotation;

wherein a welded bead is formed from an inner side surface of the wheel rim to the slanted surface of the wheel disk, the wheel rim and the wheel disk being joined to each other.

Preferably, the slanted surface of the wheel disk is tilted at an acute angle of 45° or greater with respect to the central axis of rotation of the wheel.

According to a fourth aspect of the present invention, there is provided a method of manufacturing a wheel for supporting a vehicular tire fitted thereover, the wheel comprising:

a wheel rim formed as a hollow cylinder from a plate-like blank; and a wheel disk formed from a plate-like blank, the wheel disk having a peripheral edge portion bent substantially parallel to the central axis of rotation of the wheel and a slanted surface beveled from an end face of the peripheral edge portion toward the central axis of rotation;

the method comprising the steps of placing a pressure-fitted product in which the peripheral edge portion of the wheel disk is press-fitted into an inner side surface of the wheel rim, holding the pressure-fitted product such that the slanted surface of the wheel disk is substantially horizontal, and thereafter welding the wheel rim to the slanted surface to form a welded bead thereby to join the wheel rim and the wheel disk to each other.

The pressure-fitted product is preferably held such that the slanted surface of the wheel disk is more tilted toward the wheel rim.

BEST MODE FOR CARRYING OUT THE INVENTION

A preferred embodiment of a wheel according to the present invention will be described in detail below with reference to the accompanying drawings in relation to a method of manufacturing a wheel rim of the wheel and a method of pressing a wheel disk into the wheel rim and joining them to each other.

First, a rim will be described below.

Figure 1:
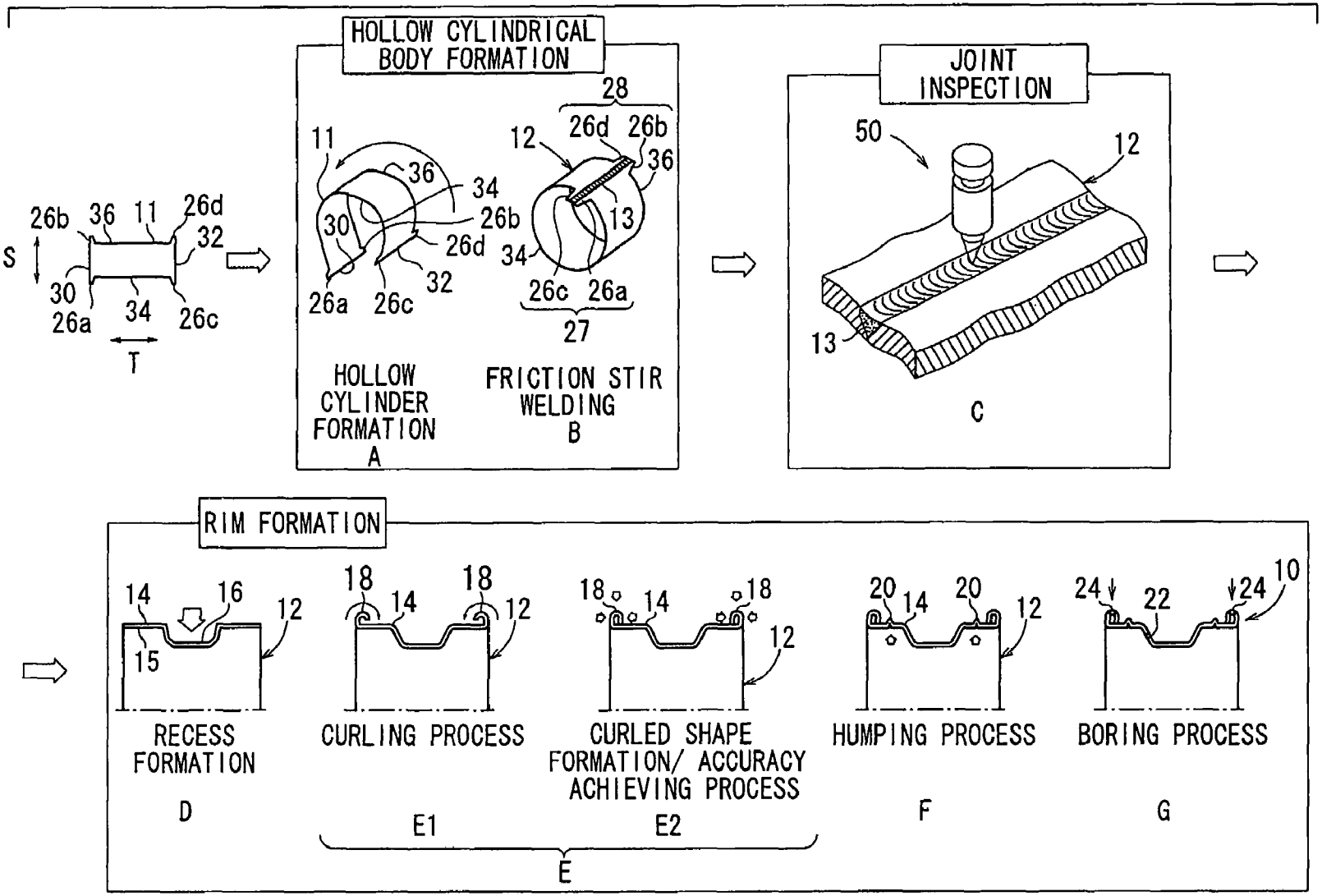
FIG. 1 is a schematic view illustrative of the steps of a method of manufacturing a wheel rim.

FIG. 1 is a schematic view showing a method of manufacturing a rim 10. As shown in FIG. 1, the rim 10 is manufactured by step A of bringing end faces of a workpiece 11, which is in the form of a plate-like blank, into abutment against each other to form a hollow cylindrical body 12, step B of forming the hollow cylindrical body 12 by joining the abutting end faces of the hollow cylindrical body 12, step C of inspecting a joint 13 of the hollow cylindrical body 12, step D of forming a drop portion 16 depressed toward an inner circumferential wall 15 in an outer circumferential wall 14 of the hollow cylindrical body 12, step E of bending opposite ends of the hollow cylindrical body 12 into curled portions 18, step F of pressing the hollow cylindrical body 12 from the inner circumferential wall 15 to raise the outer circumferential wall 14 into hump portions 20, and step G of forming a valve hole 22 and water removal holes 24 as through holes in the drop portion 16 and the curled portions 18.

First, as shown in FIG. 1, a hollow cylindrical body forming process is performed to form the hollow cylindrical body 12 in step A.

Figure 2:
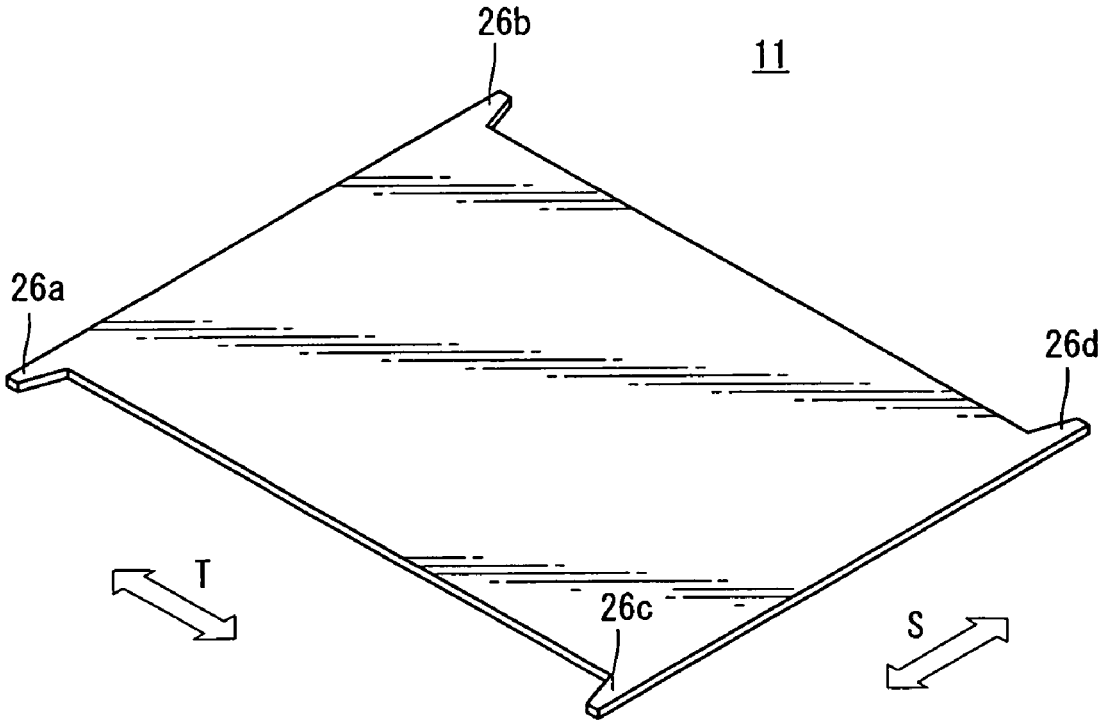
FIG. 2 is a schematic perspective view of a workpiece for forming a wheel rim, having fingers on respective corners thereof.

As shown in FIG. 2, the workpiece 11 for forming the hollow cylindrical body 12 is in the form of a substantially elongate rectangular plate made of 5000-based (JIS symbol) aluminum alloy. First through fourth fingers 26*a* through 26*d* which are oriented in the directions indicated by the arrow S are disposed respectively at the four corners of the workpiece 11. The directions indicated by the arrow S represent a joining direction. Stated otherwise, the first through fourth fingers 26*a* through 26*d* project along the joining direction.

Figure 3A:
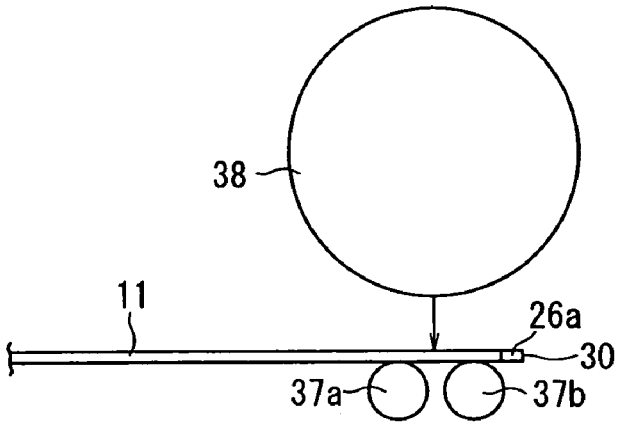
FIGS. 3A through 3D are views showing successive steps of curving the workpiece into a hollow cylindrical body.
Figure 3B:
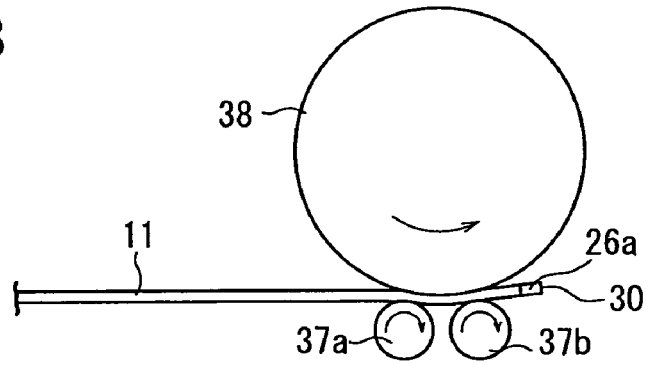

The workpiece 11 thus constructed is curved along the directions indicated by the arrow T shown in FIG. 2. Specifically, as shown in FIG. 3A, the workpiece 11 is fed by rotating feed rollers, not shown, until its distal end reaches a position on two delivery rollers 37*a*, 37*b*. Thereafter, a movable bending roller 38 is lowered toward the delivery rollers 37*a*, 37*b*. Finally, the movable bending roller 38 and the delivery rollers 37*a*, 37*b* press and grip the workpiece 11 (FIG. 3B).

Figure 3C:
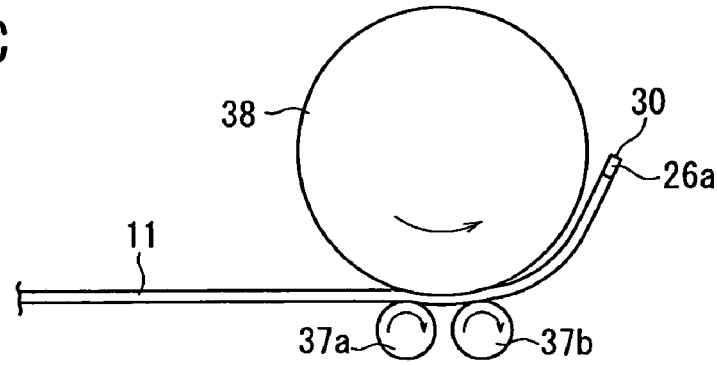

Then, the movable bending roller 38 is rotated to cause the workpiece 11 to start being curved along the outer circumferential surface of the movable bending roller 38 as shown in FIG. 3C. At this time, the delivery rollers 37*a*, 37*b* rotate as the workpiece 11 is progressively delivered.

Figure 3D:
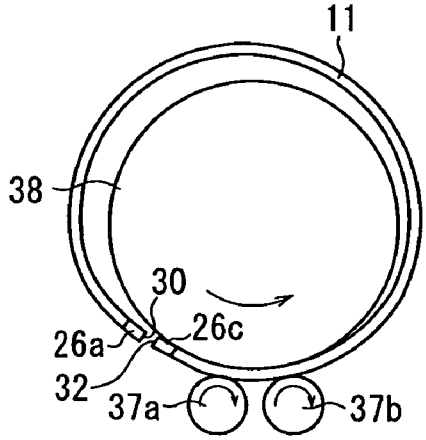
Figure 4:
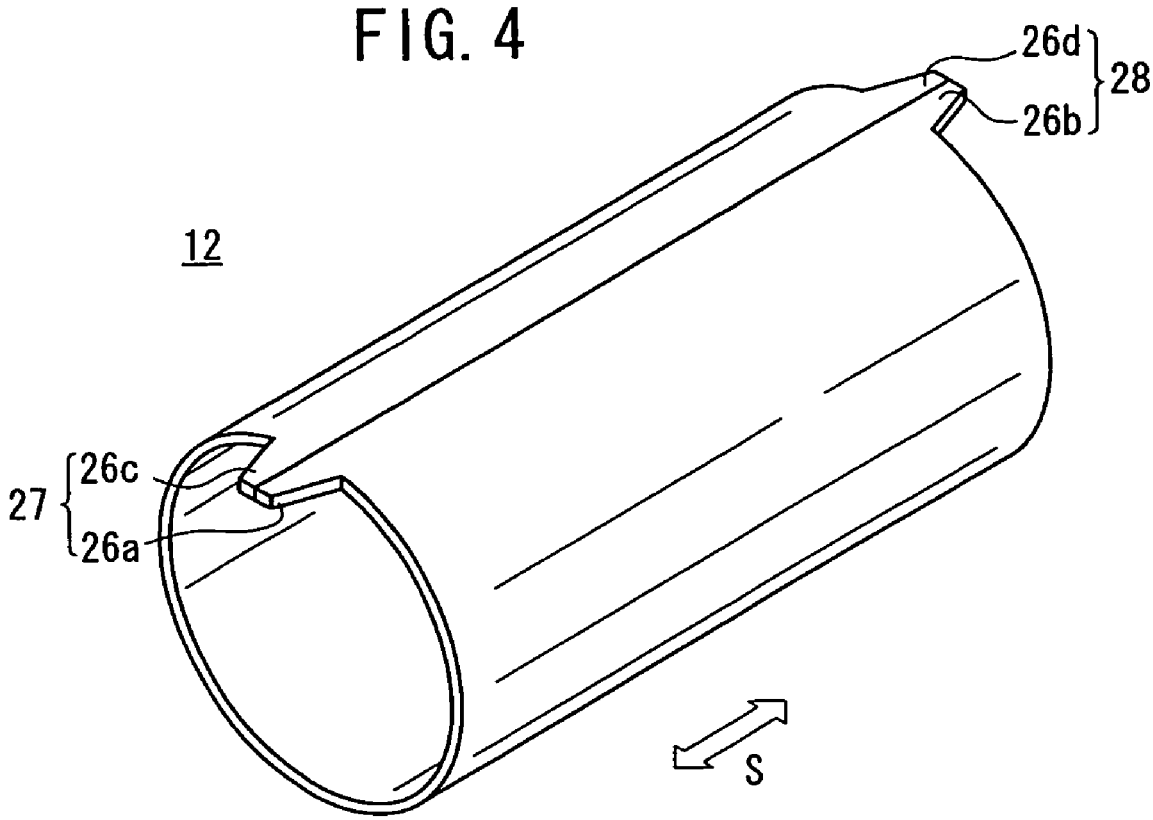
FIG. 4 is a schematic perspective view of the hollow cylindrical body having protrusions that is formed by curving the workpiece shown in FIG. 2 and bringing the fingers into abutment against each other.

The above operation is continued to bring first and second end faces 30, 32 of the workpiece 11 closely toward each other, as shown in FIGS. 3D and 3E, until finally the first and second end faces 30, 32 are brought into abutment against each other to form a hollow cylindrical body 12, as shown in FIG. 4. Simultaneously, a first finger 26*a* and a third finger 26*c* have their end faces brought into abutment against each other, forming a first protrusion 27, and a second finger 26*b* and a fourth finger 26*d* have their end faces brought into abutment against each other, forming a second protrusion 28.

Thereafter, the movable bending roller 38 is lifted to release the hollow cylindrical body 12 from the movable bending roller 38 and the delivery rollers 37*a*, 37*b*. Therefore, the hollow cylindrical body 12 can be moved to a station where next step B is carried out.

In step B, friction stir welding is performed on the abutting end faces of the hollow cylindrical body 12. At this time, the hollow cylindrical body 12 is supported by a jig 190 shown in FIG. 5.

The jig 190 has an elongate core, not shown, securely positioned on a support 192, a first gripping member 194, and a second gripping member 196. The first gripping member 194 is movable back and forth by a first cylinder, not shown, and the second gripping member 196 is movable back and forth by a gripping cylinder 198. The first gripping member 194 and the second gripping member 196 have respective recesses 200, 202. The first protrusion 27 and the second protrusion 28 of the hollow cylindrical body 12 are fitted respectively in the recesses 200, 202.

The first gripping member 194 is surrounded by an aligning presser member 204 that is substantially C-shaped as viewed in plan. The aligning presser member 204 has a distal end projecting beyond the distal end of the first gripping member 194. The aligning presser member 204 is displaceable by a second cylinder, not shown, in a direction toward the hollow cylindrical body 12 or a direction away from the hollow cylindrical body 12.

Figure 5:
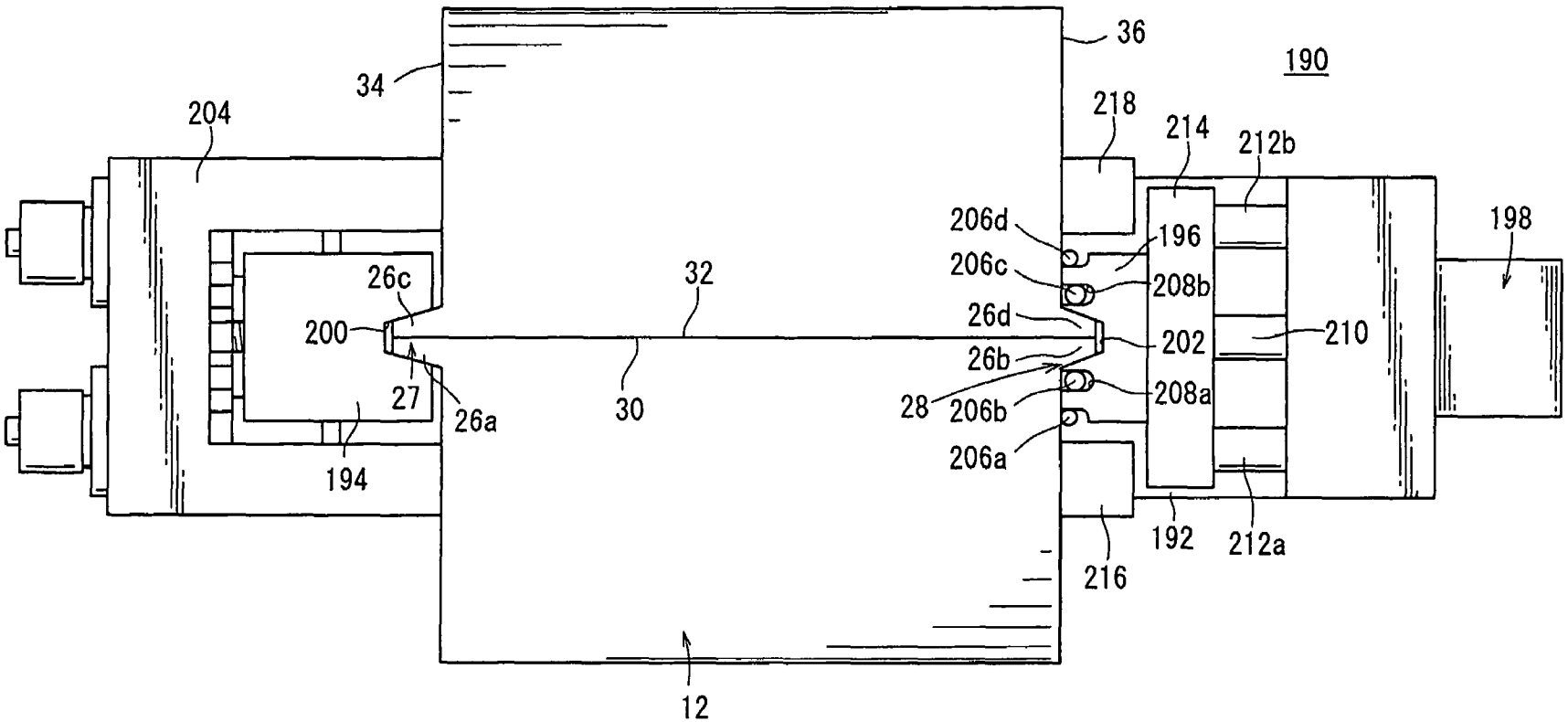
FIG. 5 is a plan view showing the manner in which a workpiece is supported by a jig.

Four upstanding pins 206*a* through 206*d* are mounted on the support 192 near a right end thereof in FIG. 5. Of these pins 206*a* through 206*d*, the inner pins 206*b*, 206*c* enter respective curved recesses 208*a*, 208*b* defined in the distal end of the second gripping member 196.

The gripping cylinder 198 is disposed on the right end of an upper end surface of the support 192. The gripping cylinder 198 has a piston rod 210 and two guide members 212*a*, 212*b* disposed one on each side of the piston rod 210. A presser disk 214 extends across and is mounted on the guide member 212*a*, the piston rod 210, and the guide member 212*b*. The second gripping member 196 is coupled to the presser disk 214.

A first aligning disk 216 and a second aligning disk 218 are securely positioned on the upper end surface of the support 192 closely to the second protrusion 28 of the hollow cylindrical body 12.

The hollow cylindrical body 12 that has been curved as described above is placed over the elongate core with the second protrusion 28 positioned ahead, until finally the end face of the hollow cylindrical body 12 near the second protrusion 28 abuts against the first aligning disk 216 and the second aligning disk 218.

The first cylinder is actuated to displace the aligning presser member 204 to the right in FIG. 5. Since the distal end of the aligning presser member 204 projects beyond the distal end of the first gripping member 194, as described above, the distal end of the aligning presser member 204 first abuts against a third end face 34 of the hollow cylindrical body 12 near the first protrusion 27.

When the third end face 34 of the hollow cylindrical body 12 is pushed by the aligning presser member 204, a fourth end face 36 of the hollow cylindrical body 12 is displaced toward the first aligning disk 216 and the second aligning disk 218. Therefore, if the second finger 26*b* is displaced prior to the fourth finger 26*d*, for example, then the fourth end face 36 near the second finger 26*b* abuts against the first aligning disk 216, and stops being displaced. When the aligning presser member 204 is continuously displaced, the fourth end face 36 near the fourth finger 26*d* finally abuts against the second aligning disk 218. The fourth end face 36 near the fourth finger 26*d* stops being displaced, whereupon the third end face 34 and the fourth end face 36 of the hollow cylindrical body 12 lie flush with each other. Upon such alignment, the aligning presser member 204 stops being displaced.

Then, the first gripping member 194 is displaced by the second cylinder to fit the first protrusion 27 in the recess 200 in the first gripping member 194. Since the above end face positioning process has been performed, the first protrusion 27 is fitted in the recess 200 without the first finger 26*a* and the third finger 26*c* having their tip ends positioned out of alignment with each other.

Then, the gripping cylinder 198 is actuated to move the piston rod 210 forward, displacing the presser disk 214 and the second gripping member 196 to the left in FIG. 5. Finally, the pins 206*b*, 206*c* enter the curved recesses 208*a*, 208*b*, respectively, in the second gripping member 196, and the second protrusion 28 is fitted in the recess 202. The second finger 26*b* and the fourth finger 26*d* of the second protrusion 28 have their tip ends positioned in alignment with each other.

As the first protrusion 27 and the second protrusion 28 are fit respectively in the recesses 200, 202 in the first gripping member 194 and the second gripping member 196, as described above, the hollow cylindrical body 12 is gripped by the first gripping member 194 and the second gripping member 196.

In this state, the abutting region between the first end face 30 and the second end face 32 is welded by friction stir welding (FSW) in step B.

Figure 6:
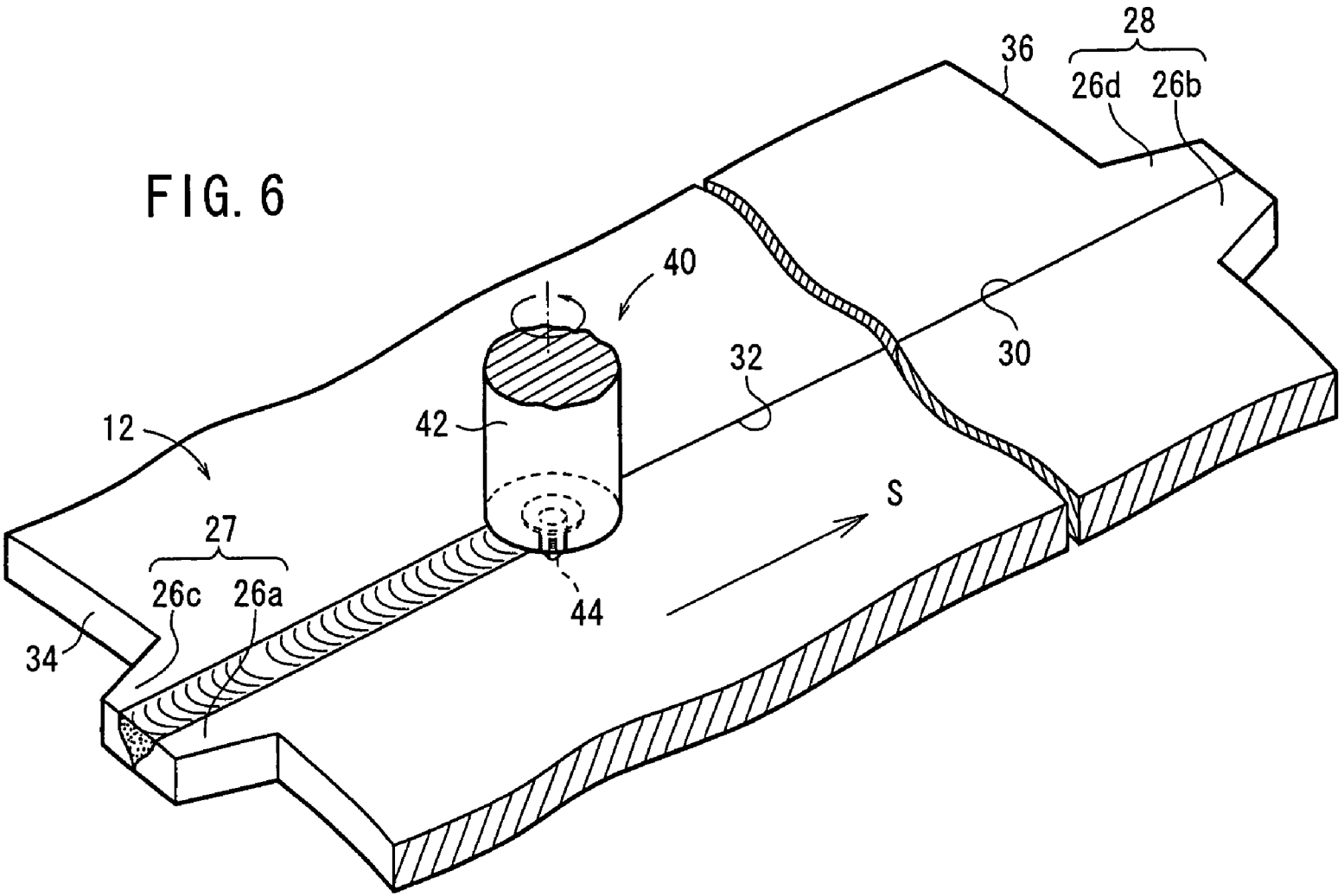
FIG. 6 is a view illustrative of a friction stir welding process in step B shown in FIG. 1.

As shown in FIG. 6, a friction stir welding tool 40 for performing friction stir welding on the first end face 30 and the second end face 32 has a cylindrical rotor 42 fixed to a spindle of a friction stir welding apparatus, not shown, and a probe 44 mounted on the tip end of the rotor 42 for being embedded in the abutting region between the first end face 30 and the second end face 32 of the hollow cylindrical body 12.

The probe 44 is directly held against the abutting region between the first end face 30 and the second end face 32. Then, the spindle is rotated to rotate the rotor 42 and the probe 44. The probe 44 is held in frictional contact with the abutting region between the first end face 30 and the second end face 32, generating frictional heat in the abutting region and nearby regions thereby to soften the material of the hollow cylindrical body 12 in those regions. When the material is softened, the probe 44 has its tip end embedded in the abutting region.

The probe 44 is then displaced along the abutting region (in the direction indicated by the arrow S), and the softened material plastically flows as it is stirred by the probe 44. Thereafter, when the probe 44 is spaced away from the stirred region, the material is hardened. This phenomenon is sequentially repeated to join the first end face 30 and the second end face 32 integrally together in a solid state, resulting in the joint 13.

In step C (see FIG. 1), a joint inspecting process is carried out to confirm whether the joint 13 thus formed contains defects such as un-joined areas, voids, etc. or not. Such defects are usually confirmed using a water-immersion-type ultrasonic flaw inspecting apparatus 50.

The hollow cylindrical body 12 with the friction-stir-welded abutting region is conveyed to a position above a water tank by a conveying mechanism, and thereafter dropped and immersed in the water.

Figure 7:
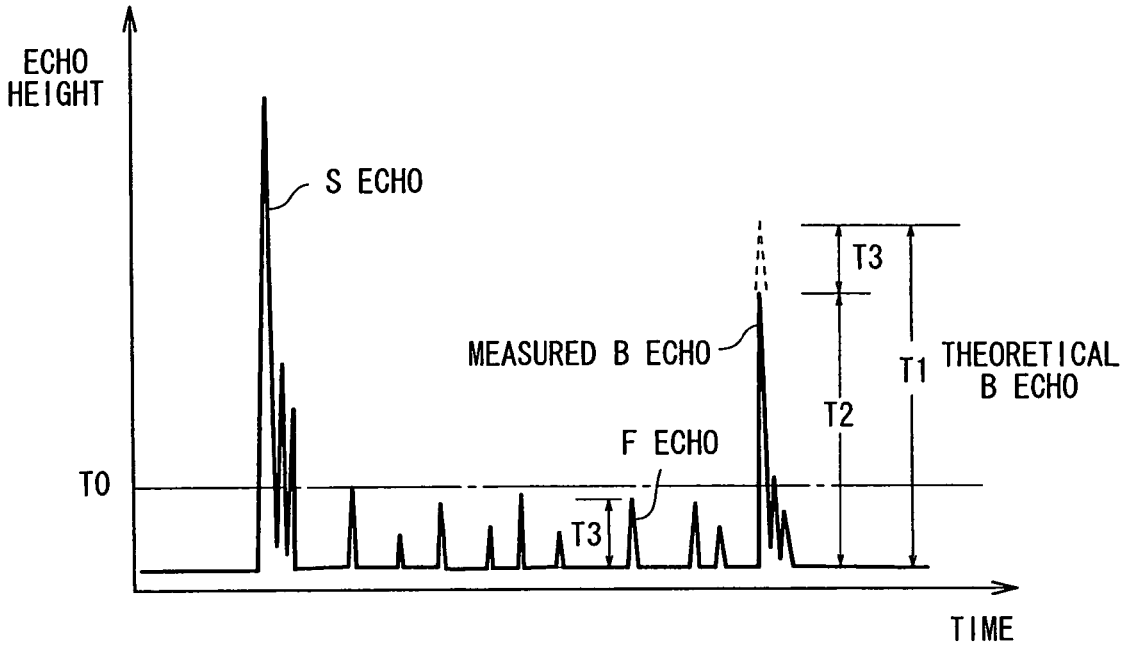
FIG. 7 is a view showing a profile produced by echoes that appear due to an ultrasonic wave and a reflected ultrasonic wave.

The joint 13 that is immersed in the water is longitudinally scanned by an ultrasonic probe of the ultrasonic flaw inspecting apparatus 50. While the joint 13 is being scanned, the ultrasonic probe radiates an ultrasonic wave Q1. Part of the ultrasonic wave Q1 is reflected as a reflected ultrasonic wave Q3 on an inner surface of the lower end surface of the joint 13. A peak belonging to the reflected ultrasonic wave Q3 are measured (measured B echo), and the intensity T2 of the measured B echo is compared with the intensity T1 of a theoretical B echo that appears in the absence of a joint defect. As shown in FIG. 7, if the intensity T2 of the measured B echo is smaller than the intensity T1 of the theoretical B echo, then it is judged that there is a joint defect in the joint 13.

The difference T3 between the intensity T1 of the theoretical B echo and the intensity T2 of the measured B echo may be recorded and compared to estimate the dimensions of the joint defect in the longitudinal and transverse directions.

If the hollow cylindrical body 12 is judged as containing a joint defect in step C, then the hollow cylindrical body 12 is rejected. If the hollow cylindrical body 12 is judged as containing no joint defect, then the hollow cylindrical body 12 is machined to cut off the first protrusion 27 and the second protrusion 28.

Figure 8:
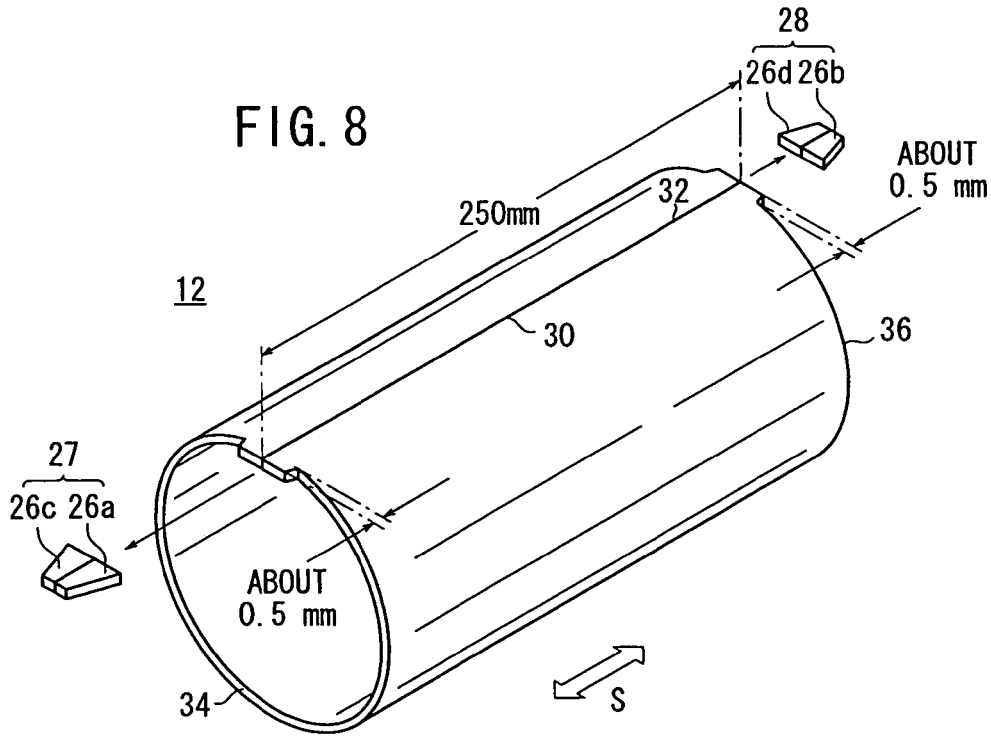
FIG. 8 is a perspective view of the hollow cylindrical body having abutting edges joined to each other, with first and second protrusions mostly cut off.

Part of the first protrusion 27 and the second protrusion 28 is left as having a dimension of about 0.2% of the longitudinal dimension of the portion of the hollow cylindrical body 12 which is free of the first protrusion 27 and the second protrusion 28. For example, as shown in FIG. 8, if the portion of the hollow cylindrical body 12 which is free of the first protrusion 27 and the second protrusion 28 has a longitudinal dimension of 250 mm, then part of the first protrusion 27 and the second protrusion 28 may be left as having a dimension of about 0.5 mm in the longitudinal direction of the hollow cylindrical body 12.

Figure 9:
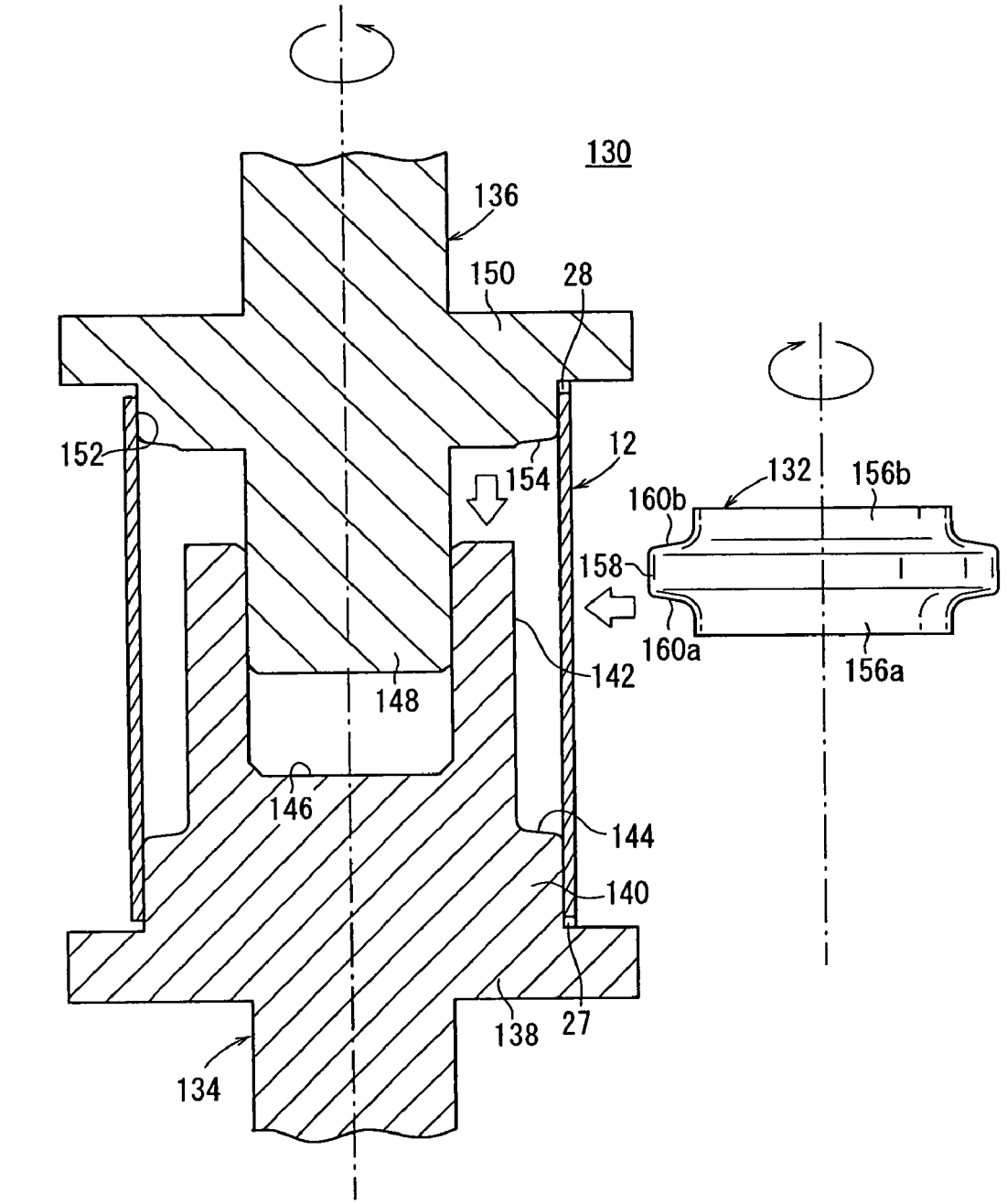
FIG. 9 is a fragmentary cross-sectional view of a die apparatus for forming a drop portion in the hollow cylindrical body.

Thereafter, the hollow cylindrical body 12 is conveyed to a station where it is to be machined into a rim (see FIG. 1). In step D (see FIG. 1) during the rim formation, a drop portion 16 is formed in a side circumferential wall of the hollow cylindrical body 12. Specifically, as shown in FIG. 9, the hollow cylindrical body 12 is subjected to a spinning process using a die apparatus 130 and a forming disk 132. The die apparatus 130 and the forming disk 132 can be rotated by a rotating mechanism, not shown.

The die apparatus 130 has a first split die 134 and a second split die 136 each having a substantially cylindrical shape. The first split die 134 has a gripping flange 138 near its lower end in FIG. 9. The first split die 134 also has a large-diameter portion 140 and a small-diameter portion 142 that are successively arranged in this order from the gripping flange 138. A tapered portion 144 is interposed between the large-diameter portion 140 and the small-diameter portion 142. The small-diameter portion 142 has an insertion hole 146 defined therein.

The second split die 136 has a cylindrical boss 148 inserted in the insertion hole 146, a gripping flange 150, and a step 152 interposed between the cylindrical boss 148 and the gripping flange 150. A tapered portion 154 that is shaped similarly to the tapered portion 144 is interposed between cylindrical boss 148 and the gripping flange 150.

The forming disk 132 has small-diameter portions 156*a*, 156*b* and a large-diameter portion 158 disposed between the small-diameter portions 156*a*, 156*b*. A tapered portion 160*a* is disposed between the small-diameter portion 156*a* and the large-diameter portion 158, and a tapered portion 160*b* is disposed between the large-diameter portion 158 and the small-diameter portion 156*b*. The tapered portions 160*a*, 160*b* are complementary in shape to the tapered portions 144, 154.

When the remaining first protrusion 27 of the hollow cylindrical body 12 is placed on the upper end face, as shown in FIG. 9, of the gripping flange 138 of the first split die 134, the second split die 136 is lowered. The remaining second protrusion 28 of the hollow cylindrical body 12 finally abuts against the gripping flange 150 of the second split die 136, whereupon the hollow cylindrical body 12 is gripped by the gripping flanges 138, 150. At this time, as can be seen from FIG. 9, the end faces of the hollow cylindrical body 12, except the first protrusion 27 and the second protrusion 28, do not abut against the first split die 134 and the second split die 136.

Then, the first split die 134 and the second split die 136, and the forming disk 132 are rotated in opposite directions, respectively, with the hollow cylindrical body 12 sandwiched therebetween. At this time, though part of the first protrusion 27 and the second protrusion 28 remains on the hollow cylindrical body 12, the remaining part is so small that the weight of the region of the hollow cylindrical body 12 near the joint 13 is only slightly greater than the other region (non-joint) of the hollow cylindrical body 12. Consequently, the hollow cylindrical body 12 is almost free of any eccentric motion when it is rotated.

Figure 10:
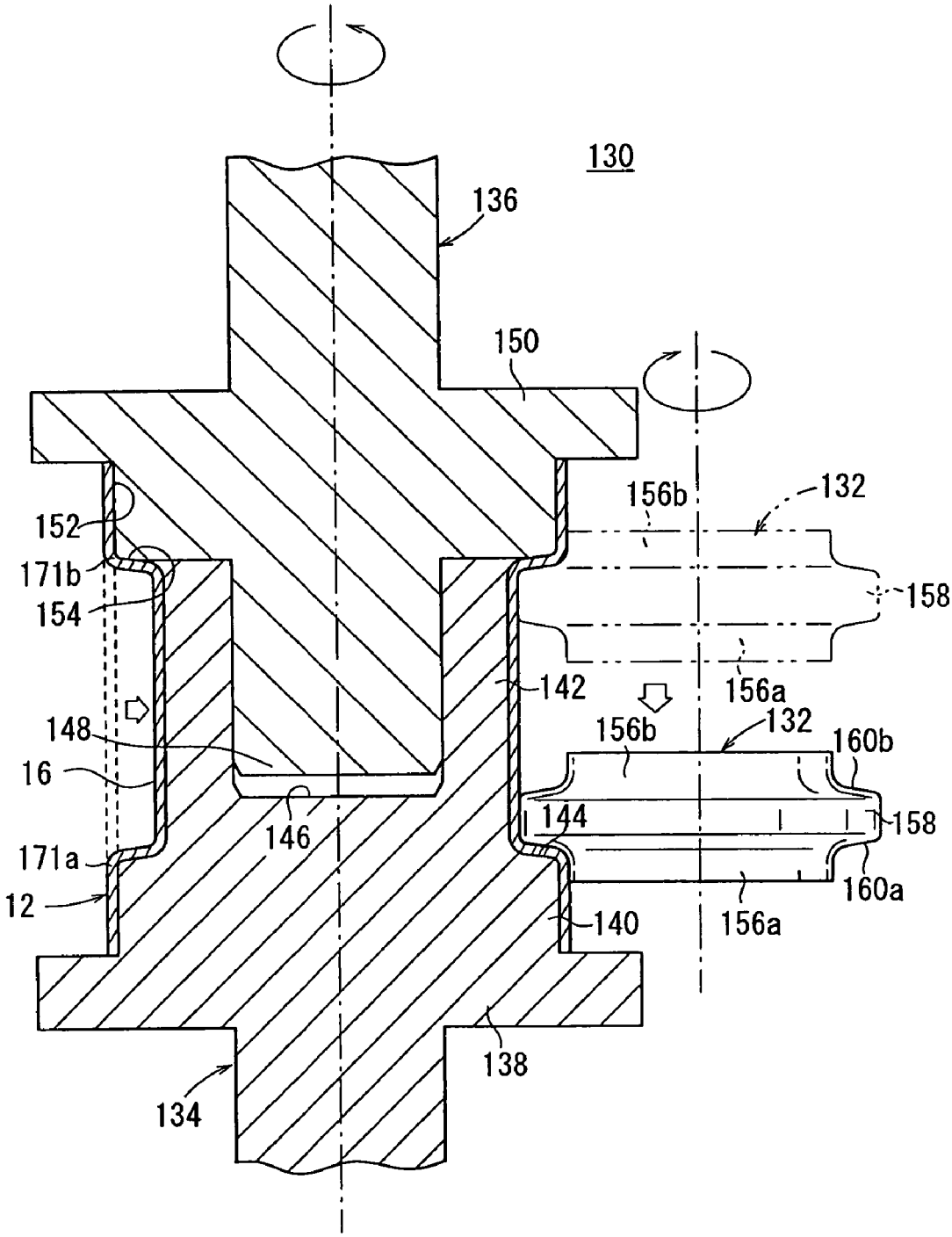
FIG. 10 is a fragmentary cross-sectional view showing the manner in which the drop portion is formed in the hollow cylindrical body by the die apparatus shown in FIG. 9.

As shown in FIG. 10, the second split die 136 is displaced toward the first split die 134, and the forming disk 132 that has started rotating in a position represented by the imaginary lines is moved closely to the hollow cylindrical body 12, causing the large-diameter portion 158 to press the outer circumferential wall of the hollow cylindrical body 12. Finally, the large-diameter portion 158 reaches a cavity defined by the small-diameter portion 142 and the tapered portion 154 of the first split die 134 with the hollow cylindrical body 12 interposed therebetween. The outer circumferential wall of the hollow cylindrical body 12 is now depressed radially inwardly, forming a recess. The tapered portion 162*b* contiguous to the large-diameter portion 158 is seated on the tapered portion 154 with the hollow cylindrical body 12 interposed therebetween, forming a tapered portion 171*b* contiguous to the recess.

Then, the forming disk 132 is displaced downwardly in FIG. 10 along the rotational shaft thereof. As the forming disk 132 is displaced downwardly, the recess is continuously formed to produce the drop portion 16. The forming disk 132 is continuously displaced until the tapered portion 162*a* of the forming disk 132 is seated on the tapered portion 144 with the hollow cylindrical body 12 interposed therebetween. When the tapered portion 162*a* is seated on the tapered portion 144, a tapered portion 171*a* contiguous to the drop portion 16 is formed.

Since the joint 13 is produced by friction stir welding, the crystal grain of the joint 13 is not much greater in grain diameter than the un-joined portion (non-joint) of the hollow cylindrical body 12. Therefore, the ductility of the joint 13 is slightly smaller than the unjoined portion. When the outer circumferential wall of the hollow cylindrical body 12 is pressed to form the drop portion 16, if forces are applied to pull the axially opposite ends of the hollow cylindrical body 12 toward the drop portion 16, then since the material is easily extended in the unjoined portion, the opposite ends of the unjoined portion are not largely pulled toward the pressed region, but the opposite ends of the joint 13 are relatively largely pulled toward the pressed region.

Figure 11:
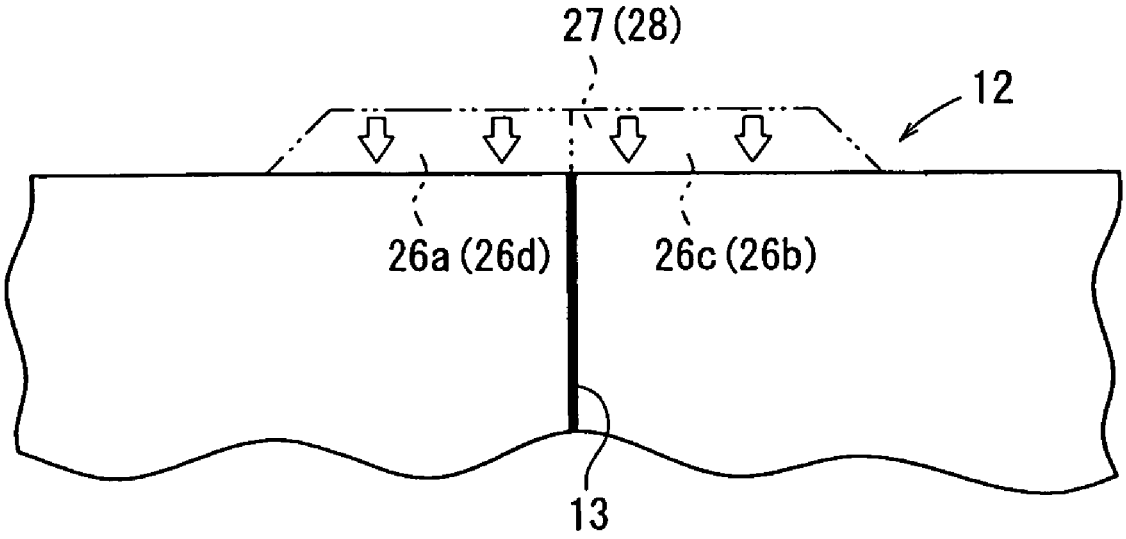
FIG. 11 is an enlarged fragmentary view of a circumferential edge portion of the hollow cylindrical body with the first protrusion (second protrusion) pulled into a flush surface when the drop portion is formed.

According to the present embodiment, however, inasmuch as part of the first protrusion 27 and the second protrusion 28 remains on the hollow cylindrical body 12, when the joint 13 is pulled in forming the drop portion 16, the remaining part is also pulled. As a result, as shown in FIG. 11, the axial dimensions of the joint 13 and the unjoined portion are substantially the same, so that the hollow cylindrical body 12 has a substantially flush circumferential edge. Specifically, as the drop portion 16 is formed, the entire end faces of the hollow cylindrical body 12 are brought into abutment against the first split die 134 and the second split die 136 (see FIG. 10).

According to the present embodiment, consequently, the drop portion 16 is formed with part of the first protrusion 27 and the second protrusion 28 remaining. In the joint 13 which is relatively difficult to extend, the remaining part is pulled to make up for axial dimensional differences of the hollow cylindrical body 12. Accordingly, a rim 10 of excellent dimensional accuracy can be produced.

Furthermore, because friction stir welding is performed to join the abutting edges of the hollow cylindrical body 12, the hardness of the joint 13 increases to a degree that is much smaller than if the abutting edges of the hollow cylindrical body 12 were joined by other joining processes. Stated otherwise, the joint 13 extends more easily than if the joint 13 were produced by other joining processes such as welding or the like. Therefore, cracking is prevented from being developed from the joint 13 when the drop portion 16 is formed.

Figure 12:
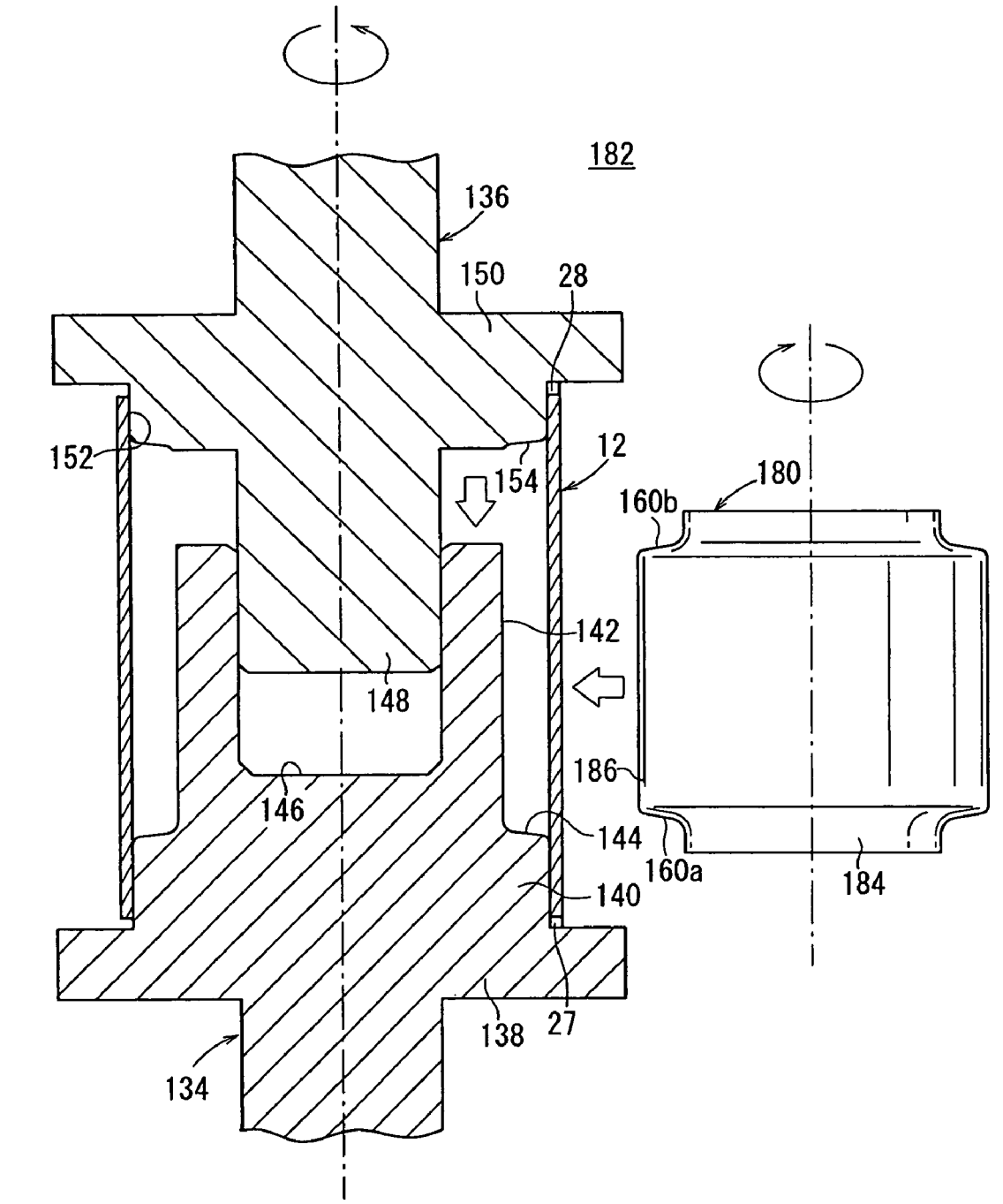
FIG. 12 is a fragmentary cross-sectional view of another die apparatus for forming a drop portion in the hollow cylindrical body.

In step D, a roll forming process may be carried out to form the drop portion 16 in the hollow cylindrical body 12. According to the roll forming process, as shown in FIG. 12, a die apparatus 182 having a forming roll 180 is used. The forming roll 180 has a cylindrical barrel 184 and a bulging portion 186 projecting diametrically outwardly from a substantially central portion of the barrel 184. The bulging portion 186 and the barrel 184 are joined to each other via tapered portions 160*a*, 160*b*. As with the die apparatus 130 described above, the tapered portions 160*a*, 160*b* are complementary in shape to the tapered portions 144, 154. The bulging portion 186 has a length corresponding to the length of the small-diameter portion 142 of the first split die 134.

With the die apparatus 182, the first split die 134 and the second split die 136, and the forming roll 180 are rotated in opposite directions, respectively, with the hollow cylindrical body 12 sandwiched therebetween (see FIG. 12). The second split die 136 is displaced toward the first split die 134, and the forming roll 180 is moved closely to the hollow cylindrical body 12, causing the bulging portion 186 to press the outer circumferential wall of the hollow cylindrical body 12.

Finally, the bulging portion 186 reaches a cavity defined by the small-diameter portion 142 of the first split die 134 and the tapered portions 144, 154 with the hollow cylindrical body 12 interposed therebetween. The outer circumferential wall of the hollow cylindrical body 12 is now depressed toward the inner circumferential wall 15, forming the drop portion 16. The tapered portions 160*a*, 160*b* contiguous to the bulging portion 186 are seated on the tapered portions 144, 154 with the hollow cylindrical body 12 interposed therebetween, forming tapered portions 171*a*, 171*b* contiguous to the drop portion 16.

In this case, the hollow cylindrical body 12 and hence the rim 10 which are of excellent dimensional accuracy are also obtained.

In step E1 (see FIG. 1), the opposite ends of the hollow cylindrical body 12 are bent to produce curled portions 18. Specifically, the curled portions 18 are formed on the end of the hollow cylindrical body 12 which includes the third end face 34 and the end of the hollow cylindrical body 12 which includes the fourth end face 36.

Figure 13:
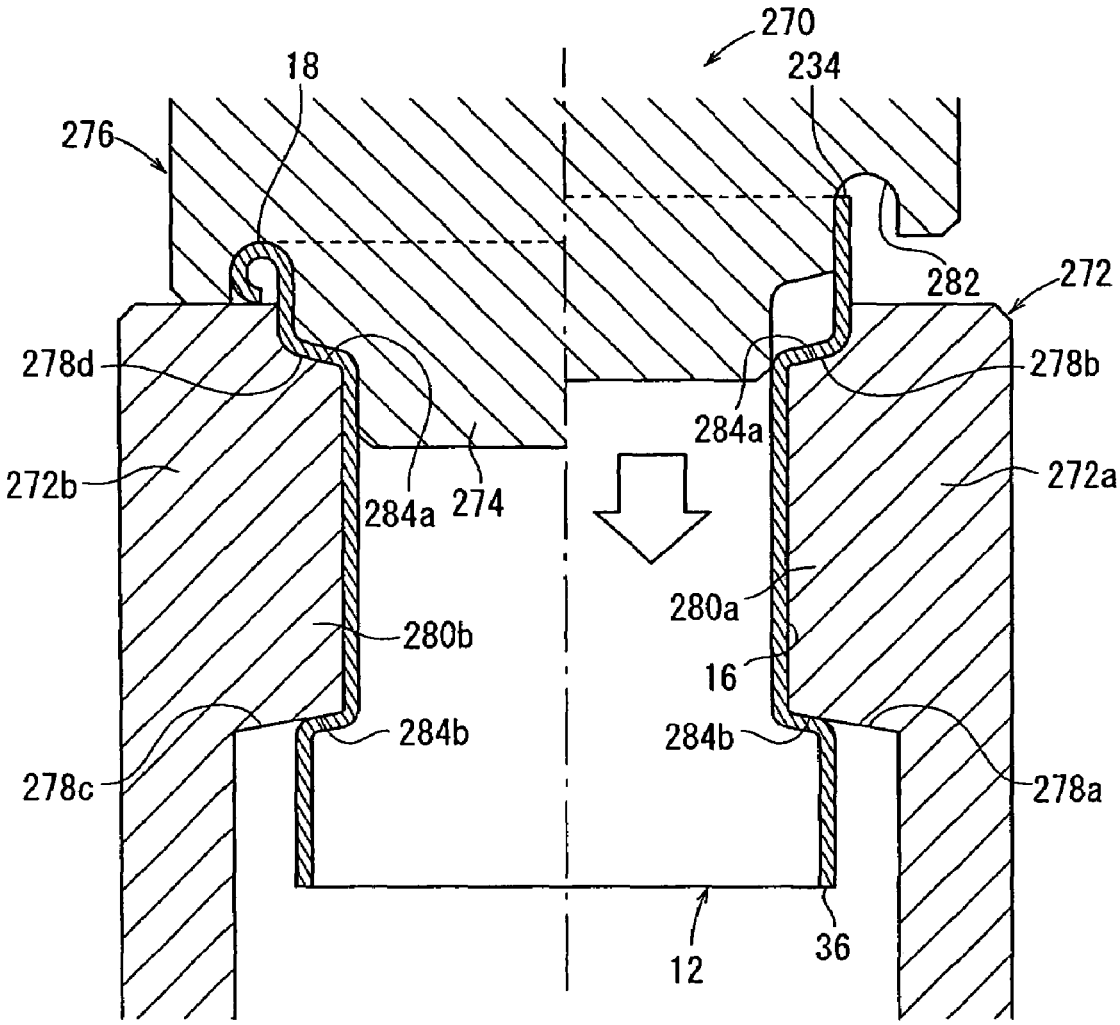
FIG. 13 is a view illustrative of a curling process in step E1 shown in FIG. 1.

As shown in FIG. 13, a die apparatus 270 for forming a curled portion 18 on an end of the hollow cylindrical body 12 has a fixed die 272 and a movable die 276 having a cylindrical boss 274 to be inserted into a semicircular opening in the fixed die 272 with the hollow cylindrical body 12 sandwiched therebetween, the fixed die 272 and the movable die 276 being relatively movable toward and away from each other. The fixed die 272 has two split dies 272*a*, 272*b* having on inner circumferential walls thereof semiarcuate annular lands 280*a*, 280*b* including steps 278*a*, 278*b* and steps 278*c*, 278*d*. The drop portion 16 of the hollow cylindrical body 12 is placed on the annular lands 280*a*, 280*b*. The movable die 276 has an annular recess 282 having a semiarcuate cross-sectional shape defined therein, the annular recess 282 being open toward an upper end face of the fixed die 272. In FIG. 13, the right-hand part of the die apparatus 270 is shown as being positioned prior to the curling process, and the left-hand part of the die apparatus 270 is shown as being positioned after the curling process.

The drop portion 16 of the hollow cylindrical body 12 is held in engagement with the annular lands 280*a*, 280*b* of the fixed die 272, with the third end face 34 of the hollow cylindrical body 12, for example, projecting upwardly from the fixed die 272. Then, the movable die 276 is moved forward toward the fixed die 272, i.e., the die apparatus 270 performs a pressing process, to curl the third end face 34 into a curved shape complementary to the semiarcuate cross-sectional shape of the recess 282 (this process will be referred to as a first curling step).

At this time, the drop portion 16 has a side wall surface 284*a* near the third end face 34 which is pressed and supported by the steps 278*b*, 278*d* of the split dies 272*a*, 272*b*, and the fourth end face 36 is not pressed. Therefore, the fourth end face 36 is not compressed. Stated otherwise, the fourth end face 36 is prevented from being deformed and hence maintains its dimensional accuracy.

Thereafter, the hollow cylindrical body 12 is placed such that the fourth end face 36 projects upwardly of the fixed die 272. The fourth end face 36 is then curled in the same manner as the third end face 34. In this manner, the curled portions 18 are formed on the opposite ends of the hollow cylindrical body 12. Since the drop portion 16 has a side wall surface 284*b* near the fourth end face 36 which is pressed and supported by the steps 278*b*, 278*d* of the split dies 272*a*, 272*b*, the curled portion of the third end face 34 is not compressed. The curled portions 18 of good dimensional accuracy are produced.

The die apparatus 270 may have movable dies 276 on opposite sides of the fixed die 272 for simultaneously curling the opposite ends, i.e., the third end face 34 and the fourth end face 36.

Figure 14:
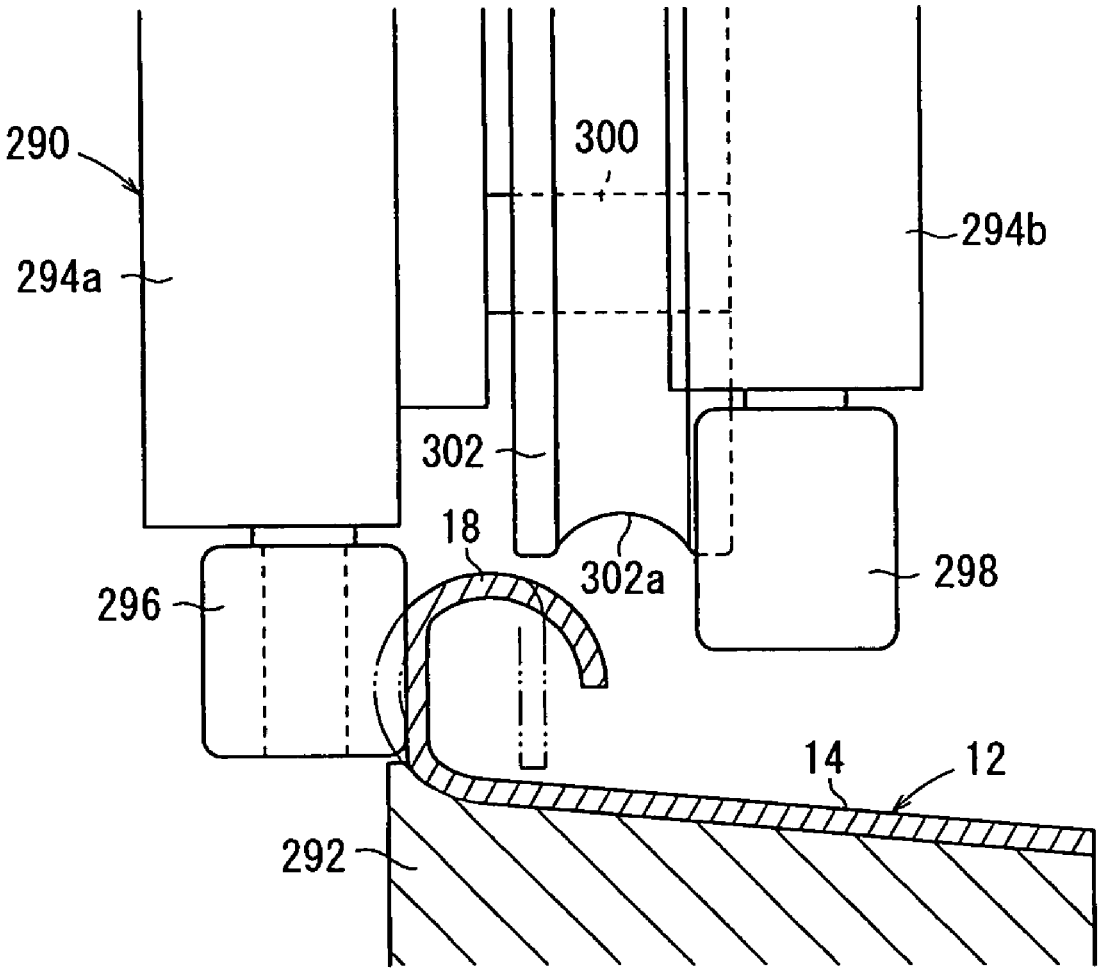
FIG. 14 is a view illustrative of a process for forming curled shape and achieving accuracy in step E2 shown in FIG. 1.
Figure 15:
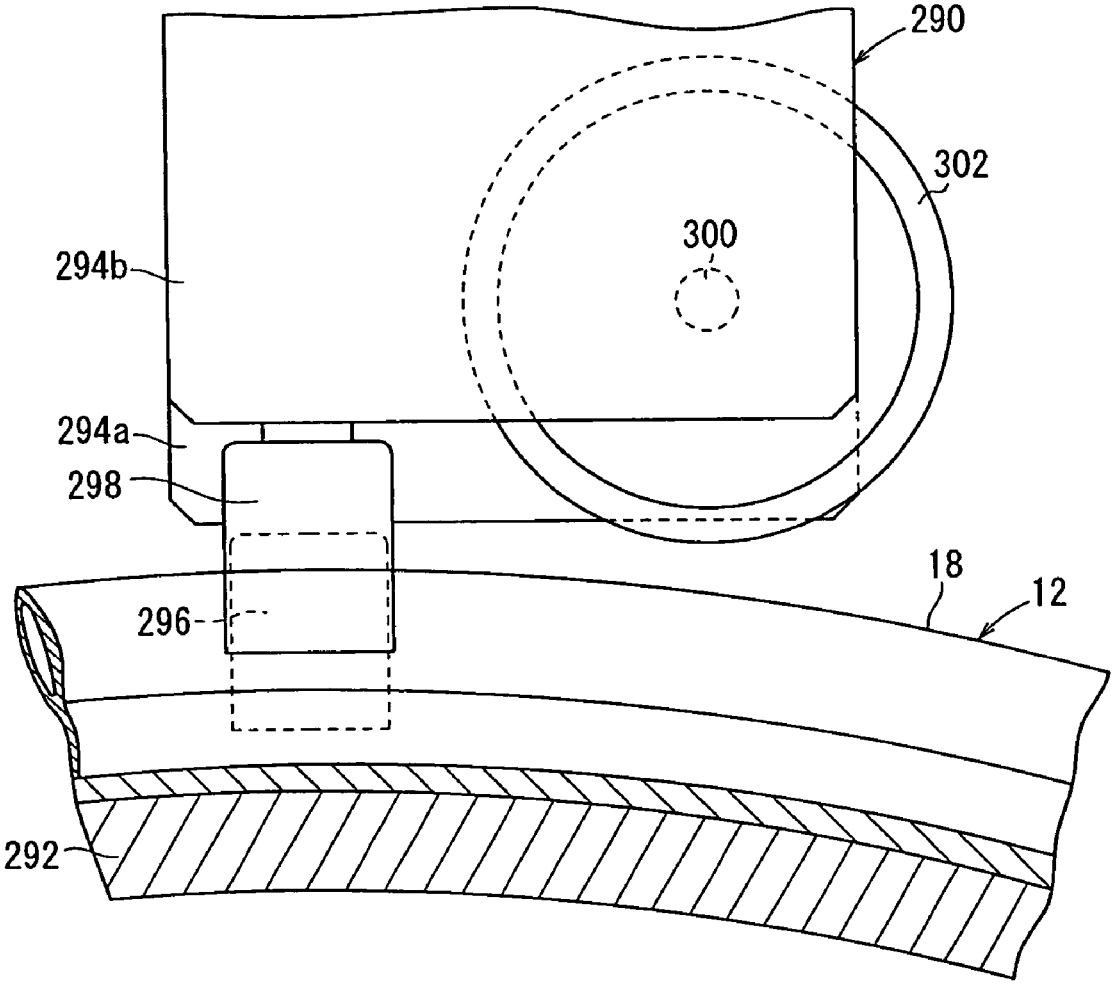
FIG. 15 is another view illustrative of the process for forming curled shape and achieving accuracy shown in FIG. 14.

In step E2 (see FIG. 1), the curled portions 18 are subjected to a curled shape formation and accuracy achieving process by a spinning process using a holder unit 290 and a placement die 292 (see FIGS. 14 and 15). Stated otherwise, the opposite ends of each of the curled portions 18 are machined into a substantially rectangular shape (this process will be referred to as a second curling step).

As shown in FIGS. 14 and 15, the holder unit 290 has dies 296, 298 mounted respectively on holders 294*a*, 294*b*, a support shaft 300 interconnecting the holders 294*a*, 294*b*, and a forming roller 302 disposed between the dies 296, 298 and rotatably supported on the support shaft 300. The holder unit 290 is movable vertically, laterally, and back and forth by hydraulic cylinders, not shown.

The die 296 presses a rising wall of the curled portion 18 of the hollow cylindrical body 12 that is placed on an end of the placement die 292, making flat a side surface of the curled portion 18. Then, a side surface of the remainder of the curled portion 18 is flattened by the die 298. Thereafter, a remaining curved upper region of the curled portion 18 whose side surfaces have thus been flattened is fitted in an annular groove 302*a* defined in a side circumferential wall of the forming roller 302, and compressed thereby. The remaining curved upper region of the curled portion 18 has its radius of curvature reduced. The tip end faces of the curled portions 18, i.e., the third end face 34 and the fourth end face 36, are seated on the outer circumferential wall 14 of the hollow cylindrical body 12.

Figure 16:
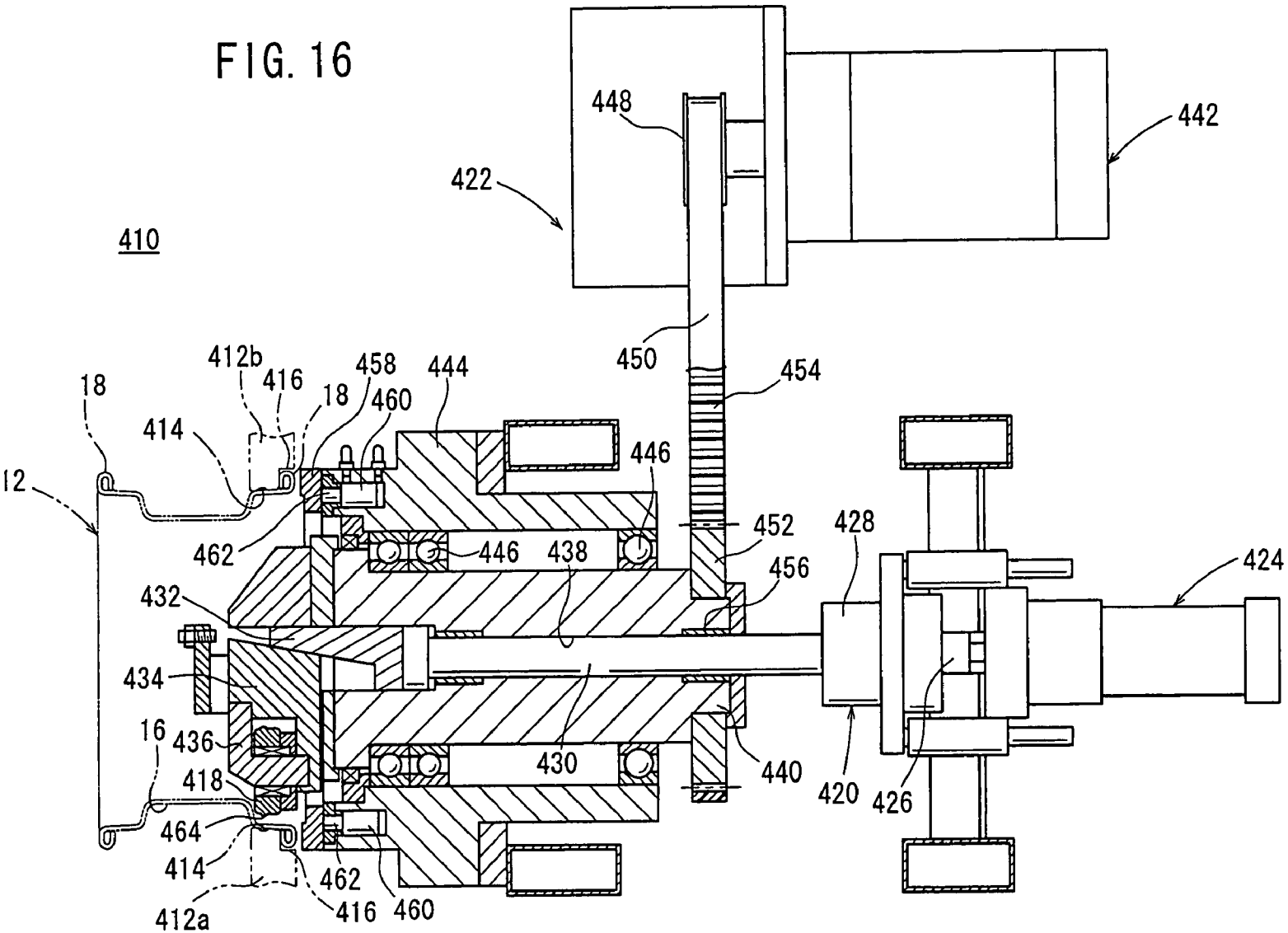
FIG. 16 is a cross-sectional view showing an essential structure of a hump portion forming apparatus used to perform a humping process in step F shown in FIG. 1.

Then, hump portions 20 are formed on the hollow cylindrical body 12 in step F (see FIG. 1), using a hump portion forming apparatus 410 shown in FIG. 16.

The hump portion forming apparatus 410 has openable/closable gripping dies 412*a*, 412*b* for gripping the hollow cylindrical body 12 and the curled portion 18 from the outer circumferential wall thereof. Each of the gripping dies 412*a*, 412*b* has a first recess 414 for forming the hump portion 20 and a second recess 416 for supporting the curled portion 18 from the outer circumferential wall thereof.

The hump portion forming apparatus 410 also has a roller die 418 for forming the hump portion 20, a displacing means 420 for displacing the roller die 418 toward the inner circumferential wall surface of the hollow cylindrical body 12, and a turning means 422 for turning the roller die 418 in the circumferential direction of the hollow cylindrical body 12.

The displacing means 420 has a roller die displacing cylinder 424 supported on a base, not shown, an elongate rod 430 coupled to a rod 426 of the roller die displacing cylinder 424 by a joint bracket 428 and functioning as a rotational shaft, an engaging cam 432 fixed to the distal end of the elongate rod 430 and having a slanted surface, and a moving cam 434 which is displaceable toward an inner circumferential wall surface of the hollow cylindrical body 12 when the engaging cam 432 moves forward. A bearing, not shown, is interposed between the elongate rod 430 and the joint bracket 428.

The moving cam 434 is normally biased to move toward the engaging cam 432 by a helical spring, not shown. The moving cam 434 has a slanted surface complementary to the slanted surface of the engaging cam 432. When the elongate rod 430 moves forward to cause the slanted surface of the engaging cam 432 to press the slanted surface of the moving cam 434, the roller die 418 that is rotatably supported on a shaft 436 coupled to the moving cam 434 is displaced downwardly in FIG. 16, i.e., toward the inner circumferential wall surface of the hollow cylindrical body 12.

The turning means 422 has a rotor 440 having a hole 438 which accommodates the elongate rod 430 therein, and a motor 442 for rotating the rotor 440.

Specifically, the elongate rod 430 is inserted in the hole 438 that is defined in the rotor 440. The rotor 440 is mostly surrounded by a fixed frame 444 with bearings 446 interposed therebetween.

The motor 442 has a rotational shaft with a pulley 448 fixed to the distal end thereof. A belt 450 is trained around the pulley 448. A gear 452 is fitted to a side circumferential wall of the rotor 440 that projects from the fixed frame 444. The belt 450 has grooves 454 defined in its inner circumferential surface and held in mesh with the gear 452. A bearing 456 is interposed between the rotor 440 and the elongate rod 430. When the pulley 448 is rotated, the elongate rod 430 is also rotated by the rotor 440.

An annular support member 458 is disposed on the fixed frame 444 for supporting an end face of the curled portion 18. Specifically, six support member cylinders 460 are disposed at equal spaced intervals in a circumferential pattern, and the annular support member 458 is mounted on the distal ends of respective rods 462 of the support member cylinders 460. The rods 462 are movable back and forth in synchronism with each other to simultaneously bring an abutment surface of the annular support member 458 into abutment against the end face of the curled portion 18.

The roller die 418 has a ridge 464 projecting on its side circumferential wall at a position aligned with the first recesses 414 of the gripping dies 412*a*, 412*b*.

Each of the hump portions 20 is formed by the hump portion forming apparatus 410 as follows.

First, the gripping dies 412*a*, 412*b* are closed to grip the hollow cylindrical body 12, thereby securely positioning the hollow cylindrical body 12. At this time, the curled portion 18 is placed in the respective second recesses 416 of the gripping dies 412*a*, 412*b*.

The six support member cylinders 460 are synchronously actuated to simultaneously move the respective rods 462 forward until the annular support member 458 abuts against the end face of the curled portion 18. Since the annular support member 458 simultaneously abuts against the end face of the curled portion 18, the longitudinal axis of the hollow cylindrical body 12 and the longitudinal axis of the elongate rod 430 are held in alignment with each other. That is, the hollow cylindrical body 12 is prevented from being tilted with respect to the elongate rod 430 and hence the roller die 418.

Figure 17:
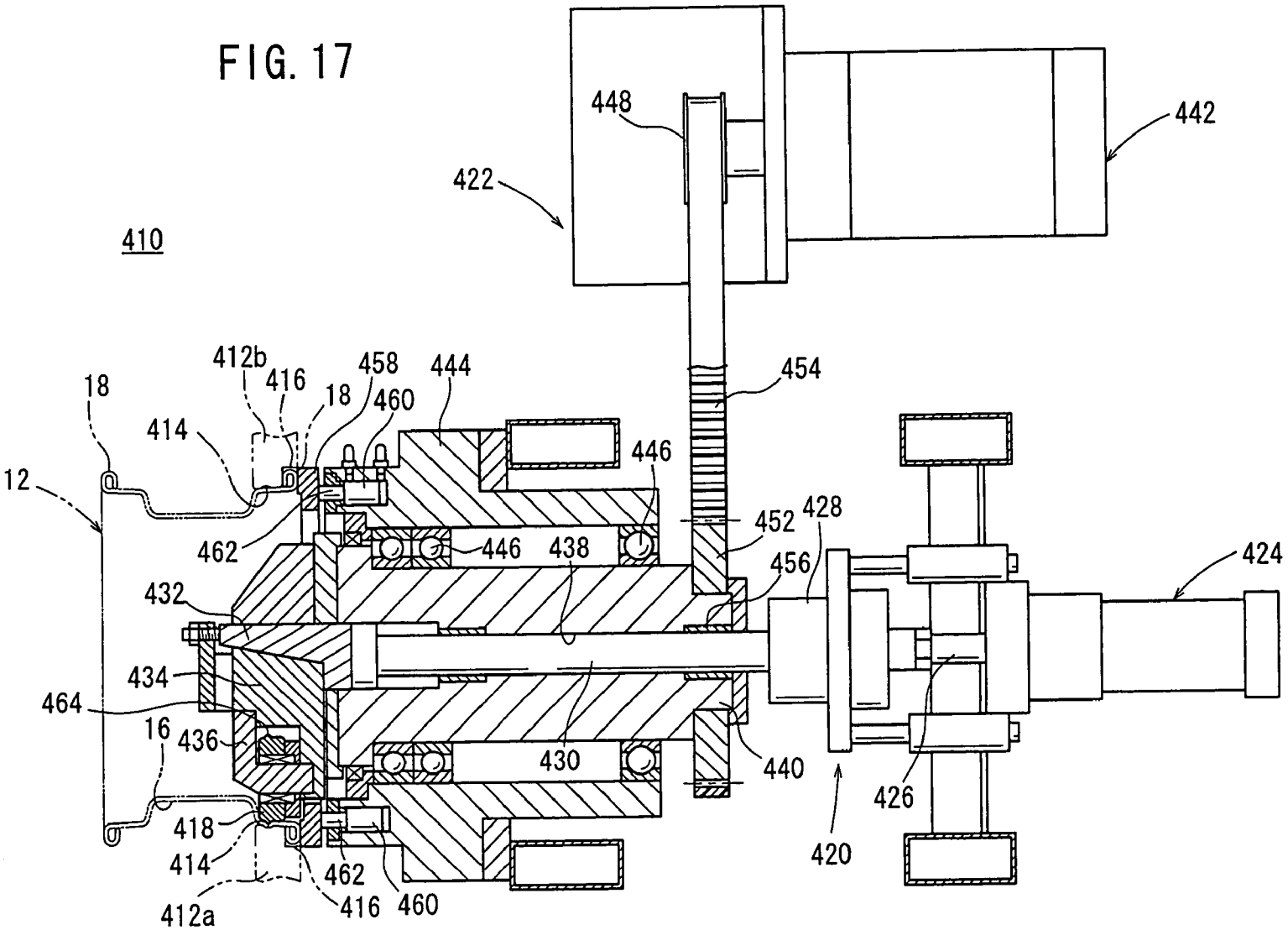
FIG. 17 is a cross-sectional view showing the manner in which a roller die of the hump portion forming apparatus shown in FIG. 16 is displaced toward an inner circumferential wall surface of the hollow cylindrical body to press the inner circumferential wall surface for forming a raised portion.

Then, the rod 426 of the roller die displacing cylinder 424 is moved forward to cause the joint bracket 428 to move the elongate rod 430 forward. The slanted surface of the engaging cam 432 is brought into sliding contact with the slanted surface of the moving cam 434, displacing the moving cam 434 toward the inner circumferential wall surface of the hollow cylindrical body 12. As a result, as shown in FIG. 17, the ridge 464 of the roller die 418 abuts against the inner circumferential wall surface of the hollow cylindrical body 12. Continued displacement of the roller die 418 causes the inner circumferential wall surface to be depressed and also causes the outer circumferential wall surface to rise due to plastic deformation, producing a raised portion that is placed in the first recesses 414 of the gripping dies 412*a*, 412*b*.

Then, the pulley 448 mounted on the distal end of the rotational shaft of the motor 442 is rotated. When the pulley 448 is rotated, the belt 450 and the gear 452 start rotating, causing the rotor 440. The rotation of the rotor 440 causes the bearing 456 to rotate the elongate rod 430. Since the bearing 446 is interposed between the rotor 440 and the fixed frame 444, the fixed frame 444 is not rotated. The same applies to the elongate rod 430 and the joint bracket 428.

When the elongate rod 430 is rotated, the engaging cam 432 and the moving cam 434 are also rotated. The roller die 418 coupled to the moving cam 434 is turned along the inner circumferential wall surface of the hollow cylindrical body 12, continuously depressing the inner circumferential wall 15 of the hollow cylindrical body 12 and continuously raising the outer circumferential wall 14 thereof. When the outer circumferential wall 14 is thus continuously raised, a hump portion 20 projecting from the outer circumferential wall 14 is formed.

According to the present embodiment, after the hollow cylindrical body 12 is positioned in place, the inner circumferential wall 15 is pressed by the roller die 418 to form the hump portion 20. Consequently, the hump portion 20 can be formed at a position that is spaced a predetermined distance from the curled portion 18.

In this case, the inner circumferential wall surface of the hollow cylindrical body 12 is pressed by the ridge 464 of the roller die 418, and the hollow cylindrical body 12 is plastically deformed by introducing the material of the hollow cylindrical body 12 pressed by the ridge 464 into the first recesses 414 of the gripping dies 412*a*, 412*b*. Consequently, the radii of curvature of the inner circumferential wall 15 and the outer circumferential wall 14 of the hump portion 20 are kept in a predetermined numerical range. Stated otherwise, the hump portion 20 is formed with high dimensional accuracy.

Since the hollow cylindrical body 12 is prevented from being inclined by abutment against the annular support member 458, the hump portion 20 has its profile extending along the circumferential direction of the hollow cylindrical body 12.

After the hump portion 20 is formed on one end of the hollow cylindrical body 12, the hollow cylindrical body 12 is released and then reversed. Thereafter, the same operation of the hump portion forming apparatus 410 as described above is carried out to form a hump portion 20 with high dimensional accuracy on the other end of the hollow cylindrical body 12.

Then, in step G (see FIG. 1), a valve hole 22 and water removal holes 24 are formed in the drop portion 16 and the curled portions 18 of the hollow cylindrical body 12. An unillustrated boring device, e.g., a general drilling machine or a drill, is used to perform a desired boring process on the hollow cylindrical body 12. The rim 10 which is reliably bored is now produced.

In this manner, the rim 10 is manufactured from the hollow cylindrical body 12 through steps A through G.

Figure 18:
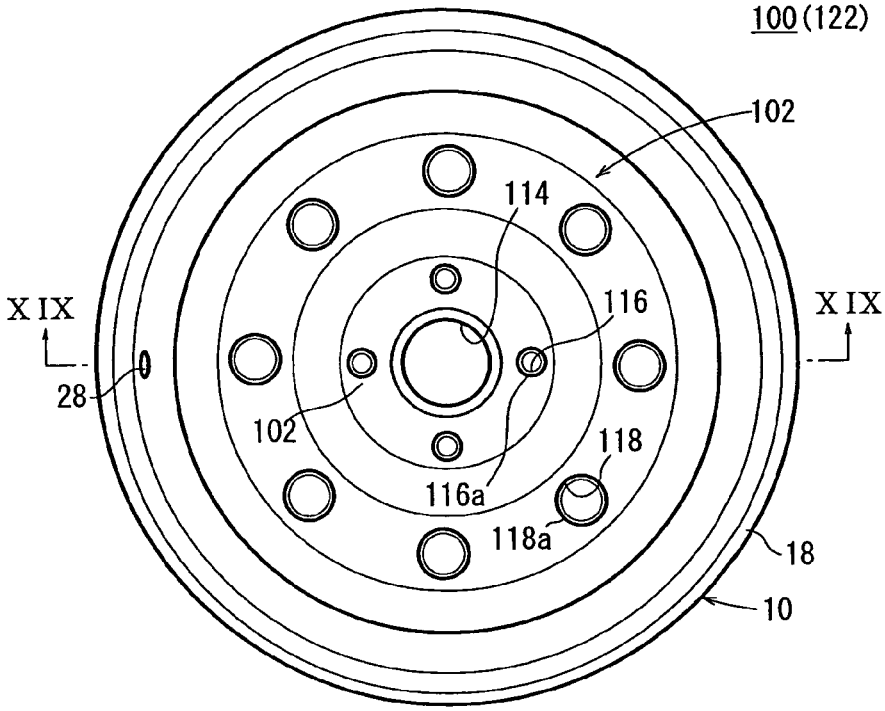
FIG. 18 is a front elevational view of a pressure-fitted product (wheel) with a disk assembled in a rim.
Figure 19:
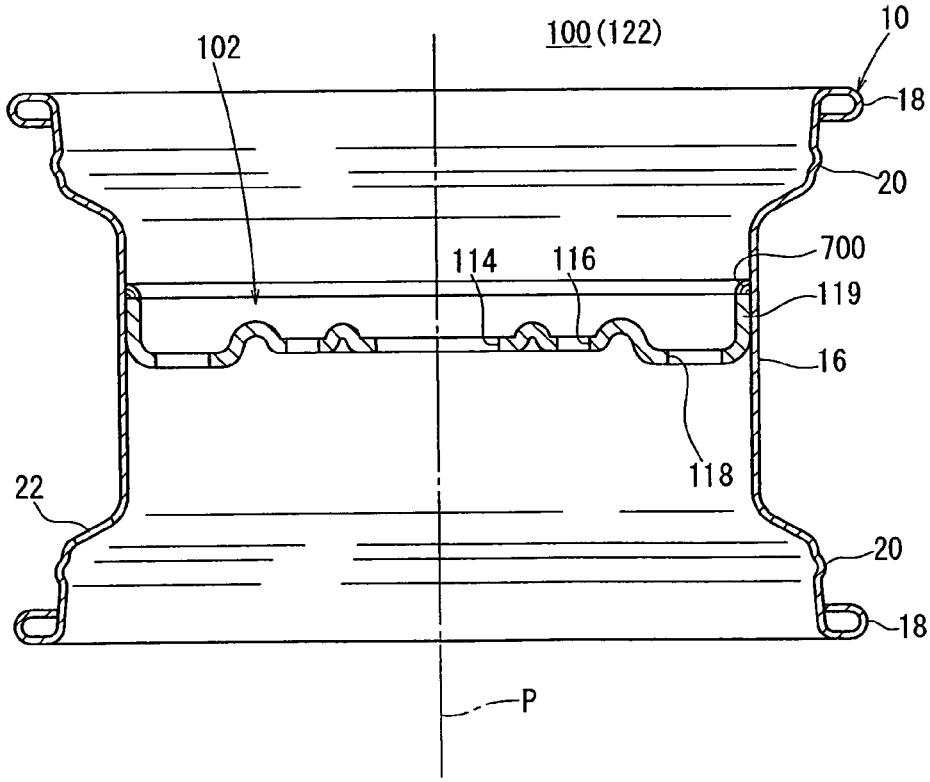
FIG. 19 is a vertical cross-sectional view of the wheel shown in FIG. 18.

A disk 102 shown in FIGS. 18 and 19 is manufactured as follows.

First, a plate-like aluminum blank, e.g., a wrought aluminum member, is drawn into a primary workpiece. In this process, the aluminum blank is machined by a first die into a shape having portions, which correspond to the shoulder and edge of the disk 102, slightly curved in cross section. According to the primary machining process, the edge of the primary workpiece has a thickness which is the same as or slightly smaller than the thickness t of the aluminum blank.

Then, in a second step, the primary workpiece is simultaneously compressed and drawn into a secondary workpiece.

In this step, portions of the primary workpiece which correspond to bolt holes 116 are compressed to thinner portions. At the same time, outer peripheral edges of the bolt holes are limited into the thickness t of the aluminum blank, and the edge of the primary workpiece is machined into a thickness t2 which is the same as or slightly greater than the thickness t of the aluminum blank. The shoulder of the primary workpiece further curved in cross section is formed.

In the secondary workpiece thus obtained, the portions which correspond to the bolt holes 116 and are compressed to thinner portions, and the outer peripheral edges 116*a* of the bolt holes 116 which are limited into the thickness t of the aluminum blank are increased in strength by hardening the aluminum blank. When the portions are compressed to thinner portions, the removed material plastically flows into the edge of the primary workpiece. Since the edge is limited to the thickness t2 which is the same as or slightly greater than the thickness t of the aluminum blank, the edge has its strength increased, and the strength thereof is further increased by further hardening.

In a third step, a hub hole 114, bolt holts 116, and ornamental holes 118 are formed in the secondary workpiece by a blanking process with a press (not shown) or a cutting process with a cutter (not shown), thereby producing the disk 102.

Figure 20:
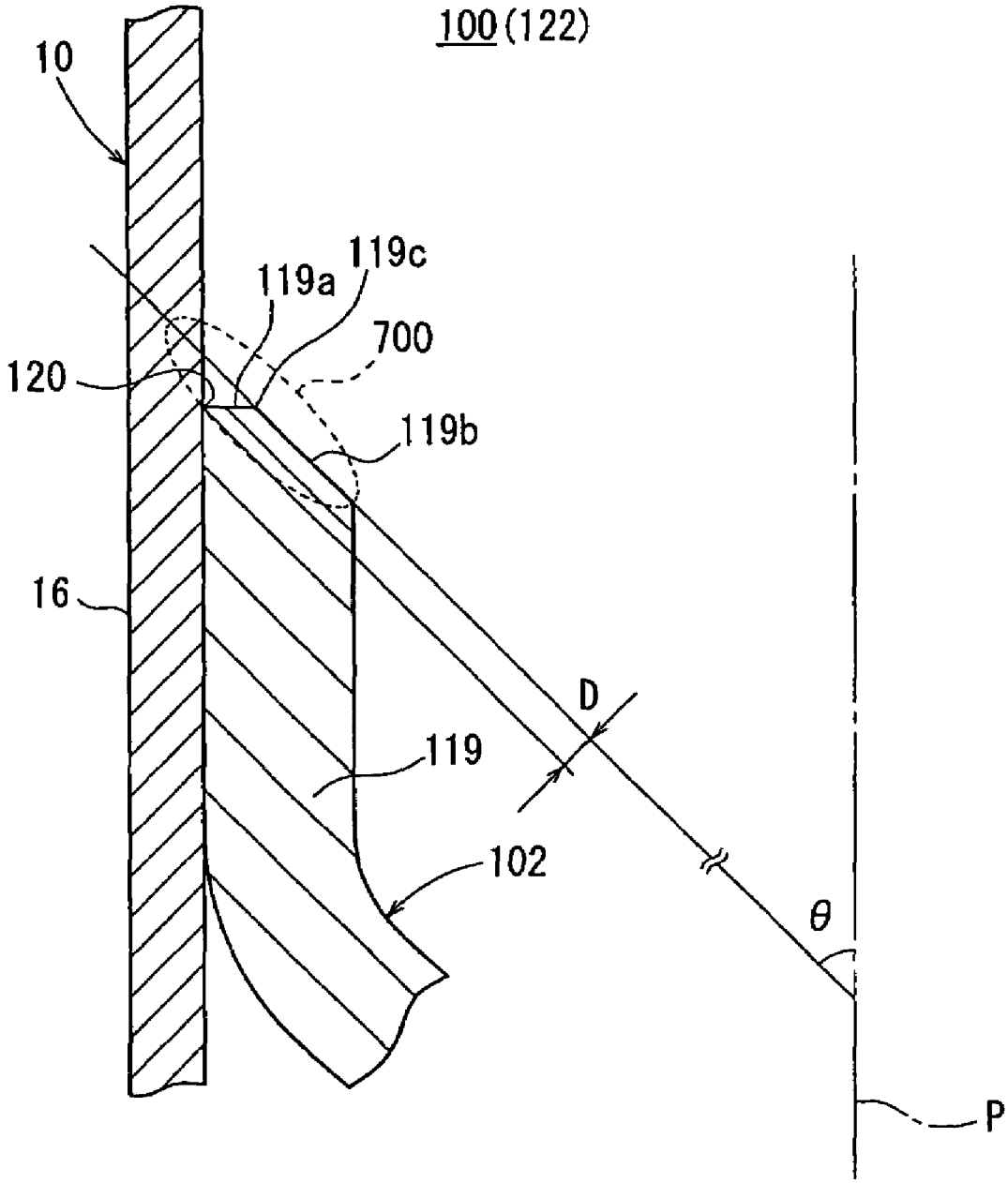
FIG. 20 is an enlarged fragmentary cross-sectional view of the wheel shown in FIG. 19.

As shown in FIG. 19, the disk 102 has a peripheral edge portion 119 oriented toward and bent substantially parallel to the central axis P of rotation of a pressure-fitted product 100 that is made up of the rim 10 and the disk 102 press-fitted in the rim 10. As shown in FIG. 20, the peripheral edge portion 119 has a slanted surface 119*b* beveled from an end face 119*a* inwardly of the peripheral edge portion 119, i.e., toward the central axis P of rotation. The slanted surface 119*b* has an annular edge 119*c* on its outer circumferential side, i.e., at the boundary between the slanted surface 119*b* and the end face 119*a*. The slanted surface 119*b* should preferably be inclined at an acute angle θ of 45° or greater to the central axis P of rotation.

The ornamental holes 118 are for decorative purposes, and function to radiate frictional heat generated by an unillustrated brake drum or brake disk that is positioned near the hub.

Figure 21:
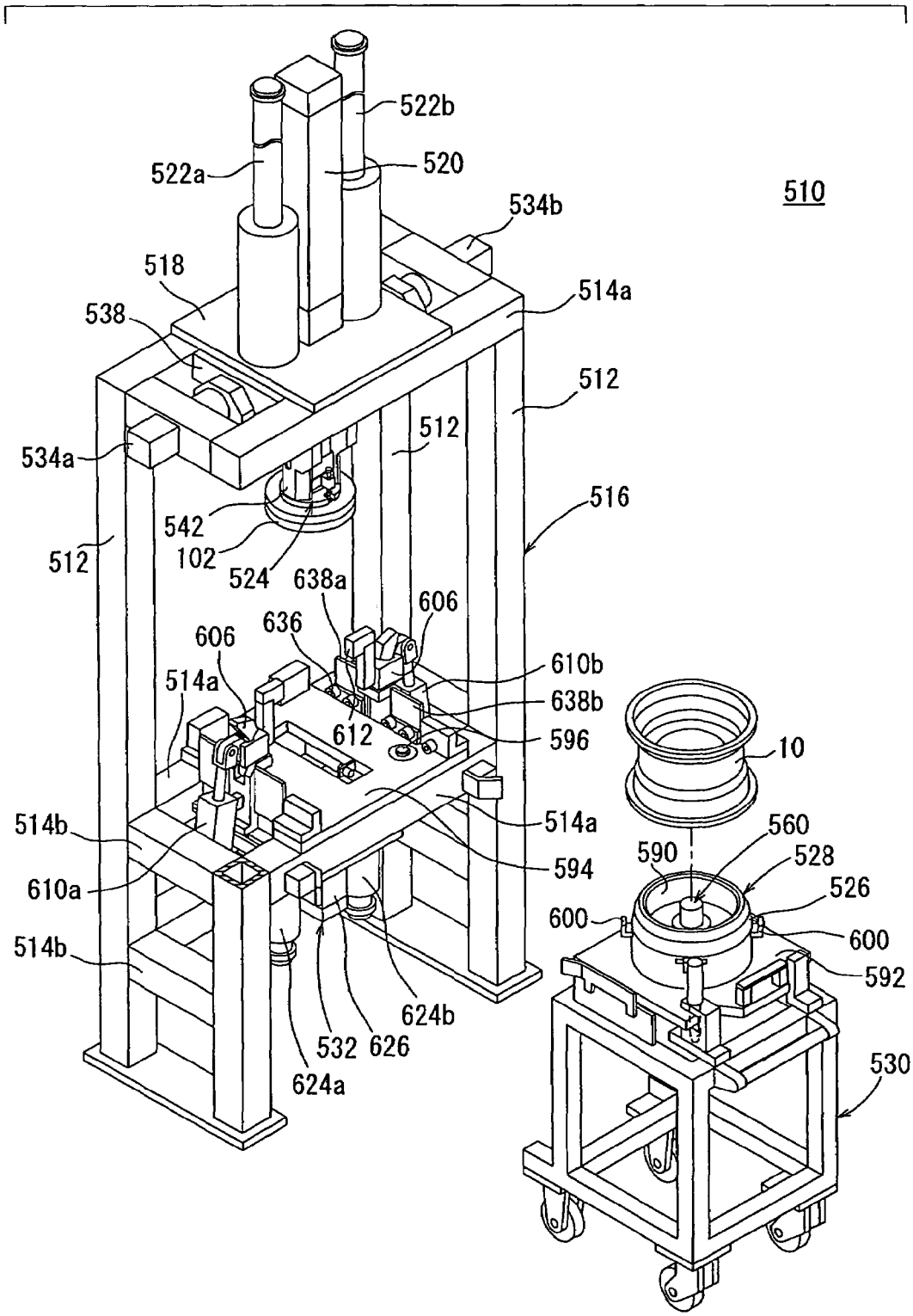
FIG. 21 is a perspective view of a disk pressing apparatus for pressing the disk into the rim and a carriage.
Figure 22:
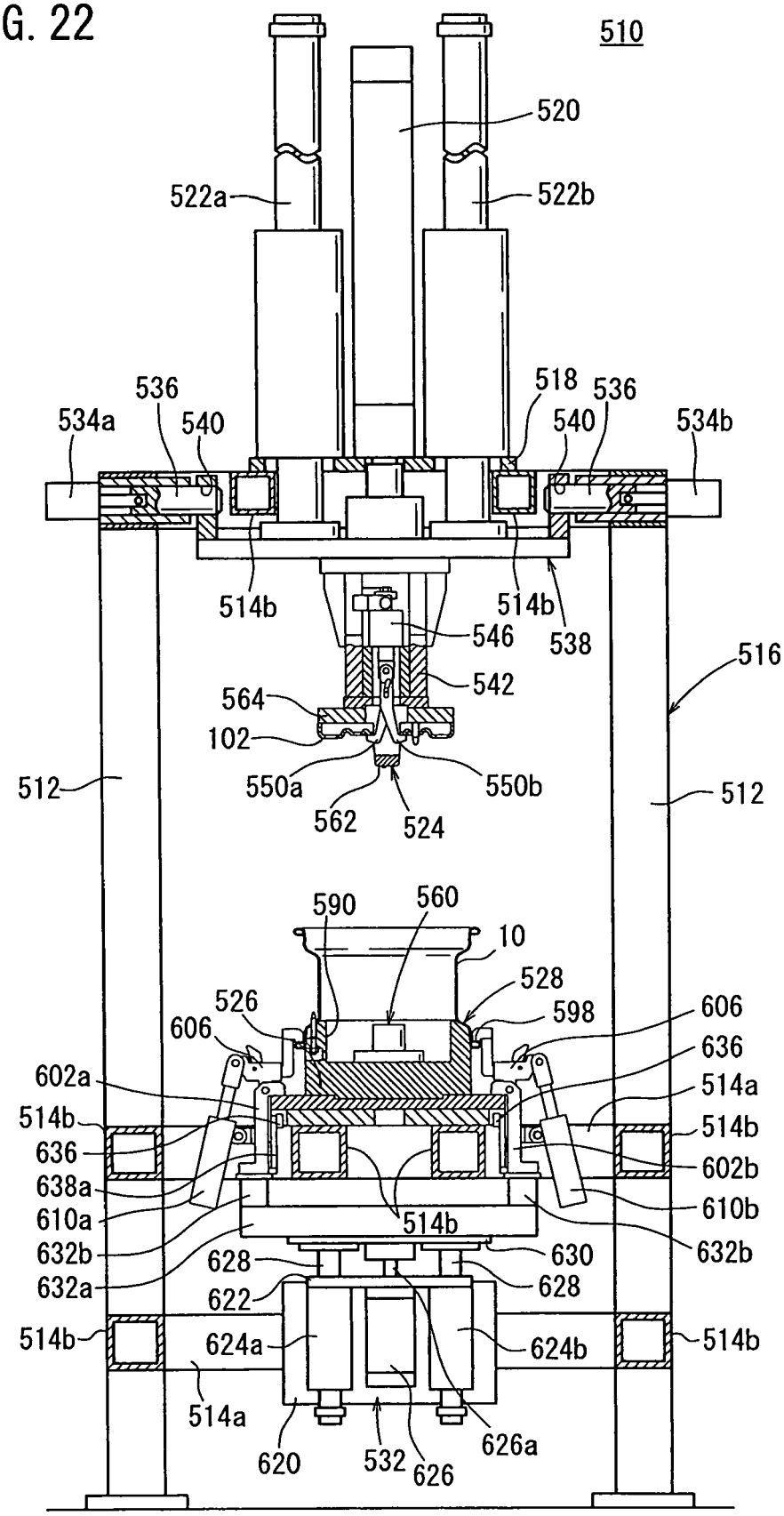
FIG. 22 is a front elevational view, partly cut away, of the disk pressing apparatus shown in FIG. 21.
Figure 23:
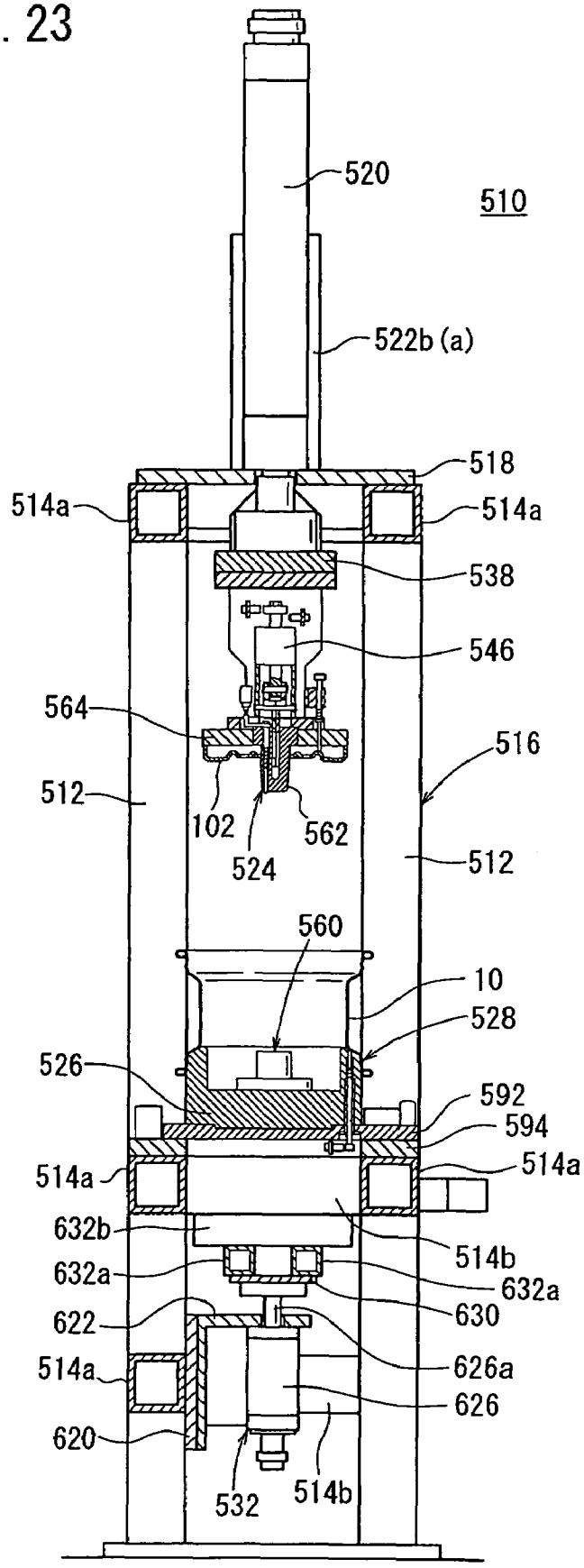
FIG. 23 is a side elevational view, partly cut away, of the disk pressing apparatus shown in FIG. 21.

The disk 102 thus produced is pressed into the rim 10, using a disk pressing apparatus 510 shown in FIGS. 21 through 23.

The disk pressing apparatus 510 has a frame 516 made up of a plurality of vertical support posts 512 and a plurality of long and short horizontal beams 514*a*, 514*b*, an upper plate 518 fixed to the upper end of the frame 516, a first cylinder 520 and a pair of guide rods 522*a*, 522*b* which are vertically fixed to the upper surface of the upper plate 518, and an upper die unit 524 mounted for vertical displacement in response to actuation of the first cylinder 520 and including a disk fixing means for fixing the disk 102 that is set in place.

The disk pressing apparatus 510 also has a lower die unit 528 including a rim holding die 526 for setting the rim 10 thereon and a rim fixing means for fixing the rim 10 to the rim holding die 526, and a lifter 532 for lifting the rim holding die 526 when the rim holding die 526 is to be replaced with another rim holding die that is carried by a carriage 530, to be described later.

As shown in FIG. 23, a pair of second cylinders 534*a*, 534*b* for preventing the upper die unit 524 from falling is mounted on the upper ends of the support posts 512 of the frame 516. The second cylinders 534*a*, 534*b* have respective piston rods 536 projecting into respective holes 540 that are defined in side panels of a vertically movable plate 538, thereby keeping the upper die unit 524 including the vertically movable plate 538 in an uppermost position.

The piston rod of the first cylinder 520 and the guide rods 522*a*, 522*b* have ends coupled to an upper surface of the vertically movable plate 538. When the first cylinder 520 is actuated, the vertically movable plate 538 is vertically moved in unison with the upper die unit 524 while being linearly guided by the guide rods 522*a*, 522*b*.

The disk fixing means is mounted on a lower surface of the vertically movable plate 538 by a joint member 542 that is coupled to the vertically movable plate 538. The disk fixing means includes a housing 544 fixed to the joint member 542, a third cylinder 546 having two rods, a pair of clamp arms 550*a*, 550*b* coupled by a joint pin 548 to one of the rods of the third cylinder 546, an engaging pin 554 having opposite ends held by the housing 544 and engaging in substantially V-shaped oblong grooves 552 defined in the clamp arms 550*a*, 550*b*, an abutment member 562 having a slit 558 defined therein in which fingers 556 of the clamp arms 550*a*, 550*b* move toward and away from each other, the abutment member 562 serving to abut against an engaged member 560 of the lower die unit 528, to be described later, to limit the depth to which the disk 102 is pressed, and a holding plate 564 for holding the disk 102 which is clamped by the fingers 556 of the clamp arms 550*a*, 550*b* (see FIGS. 24 and 25).

The holding plate 564 and the abutment member 562 function as the upper die unit 524. To the holding plate 564, there are fixed a positioning pin 566 which is inserted into a hole in the disk 102 to position the disk 102 on the holding plate 564, and a pin 568 for preventing the disk 102 from being in accurately assembled (see FIGS. 24 and 25).

A pair of first sensors 570*a*, 570*b* (see FIG. 25) is mounted on the joint member 542 for detecting a displacement of the other rod of the third cylinder 546 to detect whether the disk 102 has reliably been clamped by the fingers 556 of the clamp arms 550*a*, 550*b* or not.

Figure 25:
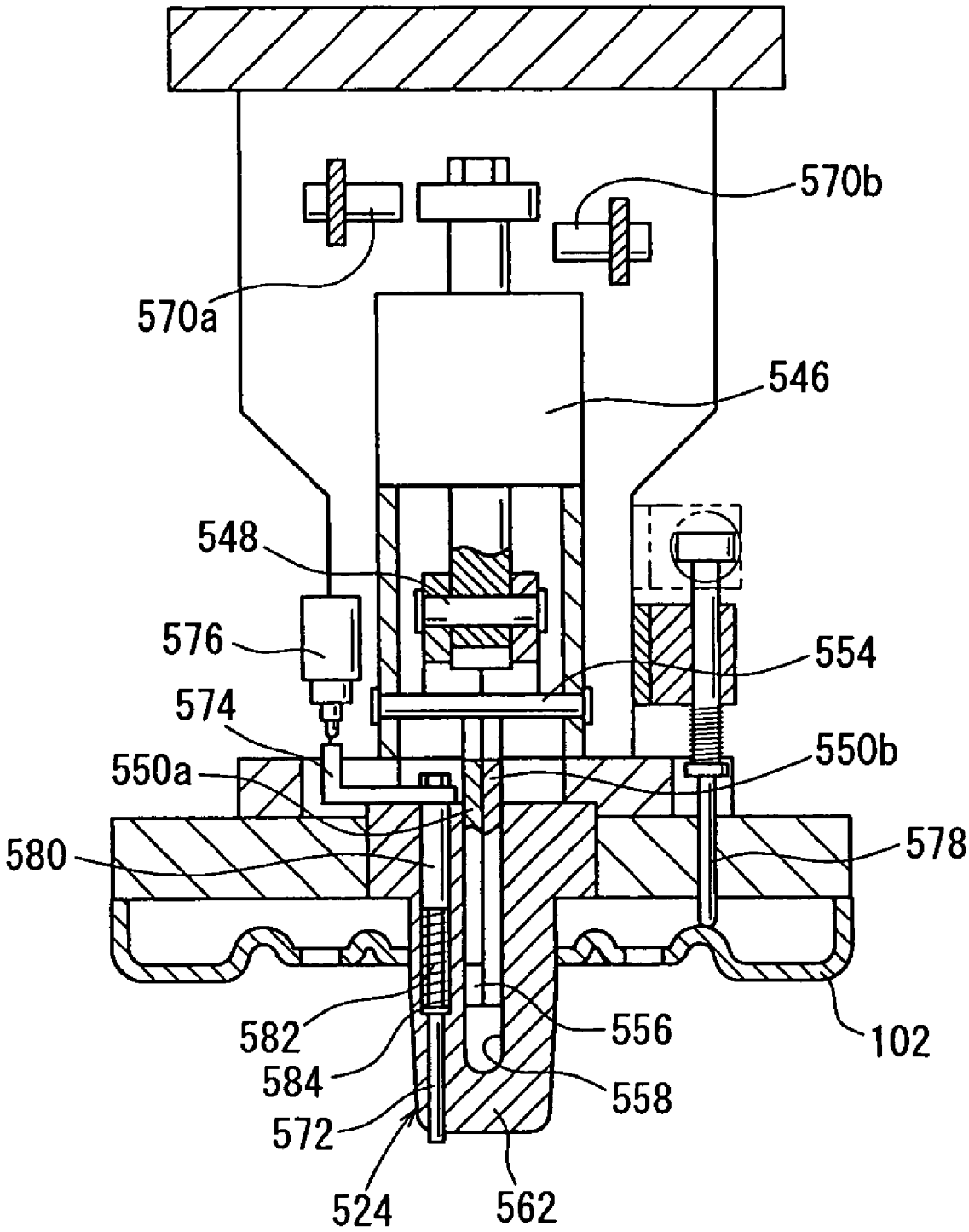
FIG. 25 is an enlarged fragmentary vertical cross-sectional view of the upper die unit of the disk pressing apparatus shown in FIG. 21.
Figure 26:
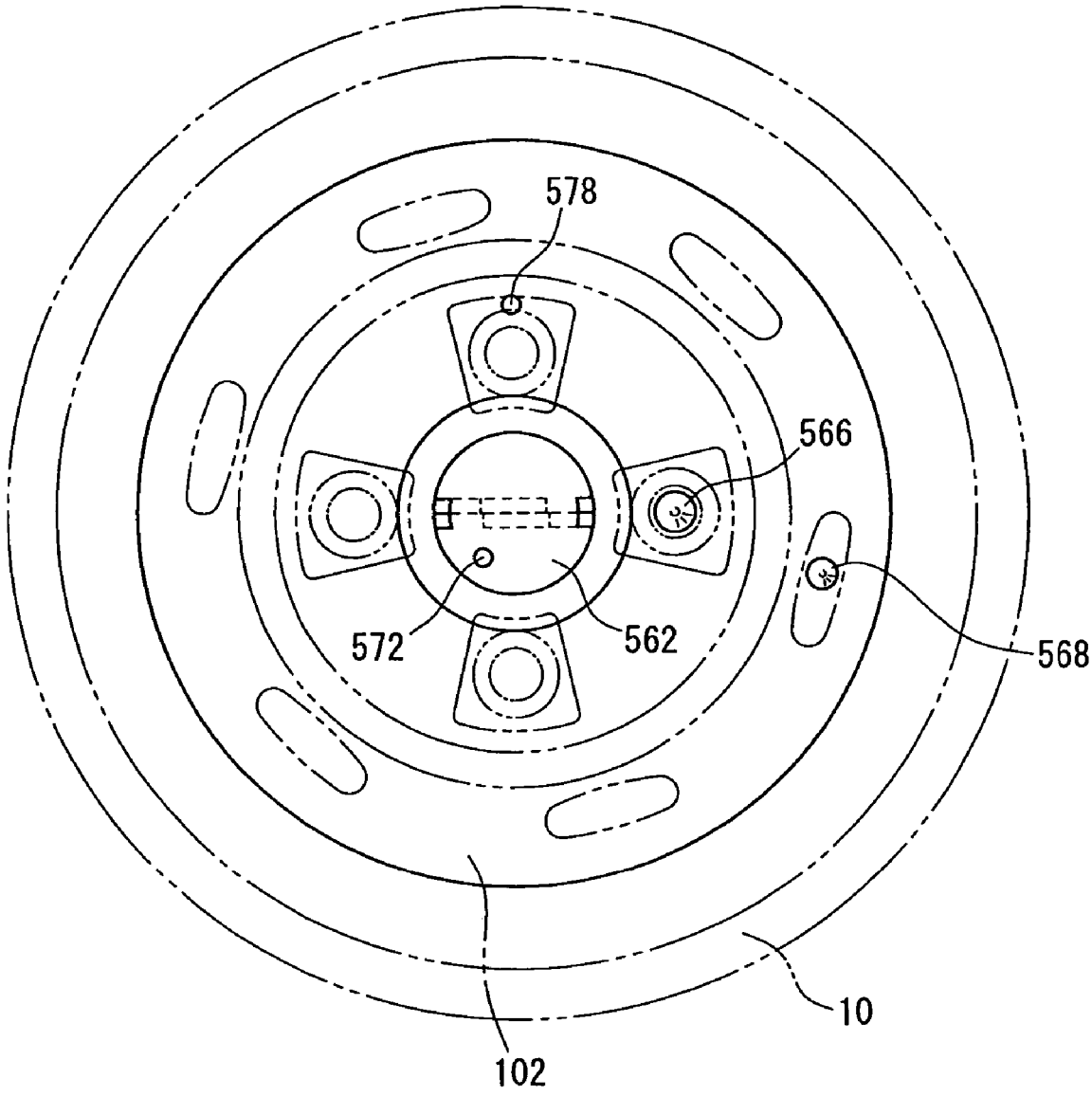
FIG. 26 is a view as viewed in the direction indicated by the arrow Z in FIG. 24.

As shown in FIG. 25, a pin 572 partly projects from the lower end of the abutment member 562, and an L-shaped plate 574 is joined to an end of the pin 572. When the abutment member 562 is lowered into abutment against the engaged member 560 of the lower die unit 528, part of the pin 572 is pressed upwardly by the engaged member 560. The pin 572 and the L-shaped plate 574 are slightly elevated together until the L-shaped plate 574 contacts a second sensor 576. The second sensor 576 detects abutment of the abutment member 562 and the engaged member 560 of the lower die unit 528.

As shown in FIG. 25, the joint member 542 has a pin 578 which is displaced upwardly when it contacts the disk 102 set in place. When the displacement of the pin 578 is detected by a sensor, not shown, the disk 102 is detected as being set on the upper die unit 524.

The reference numeral 580 represents a hollow cylindrical collar fixedly placed in a hole in the abutment member 562 and supporting the pin 572 for displacement. The reference numeral 582 represents a return spring having an end engaging the collar 580 and the other end engaging a ring member 584 fastened to the pin 572 for normally biasing the pin 572 to be partly exposed out of the abutment member 562.

The lower die unit 528 has the rim holding die 526 for setting the rim 10 along a positioning pin 586, the rim holding die having on its outer wall a support surface 588 complementary in shape to the rim 10, a pallet 592 in the form of a flat plate with the rim holding die 526 placed thereon, and a support plate 594 supporting the rim holding die 526 and the pallet 592.

The support plate 594 is supported on a pair of parallel long beams 514*a* extending horizontally between the support posts 512 and a pair of short beams 514*b* joined perpendicularly between the long beams 514*a* (see FIGS. 21 through 23).

The rim holding die 526 is movable horizontally in unison with the pallet 592 when it is to be replaced with another rim holding die. The support plate 594 has positioning teeth 596 for positioning another replacing pallet 592 in a predetermined position on the support plate 594 (see FIGS. 21 and 27).

The rim holding die 526 has a substantially circular cavity 590 defined therein which is open upwardly. The engaged member 560 is fixedly mounted centrally in the cavity 590 for being engaged by the abutment member 562 to limit the depth to which the disk 102 is pressed, when the upper die unit 524 is lowered.

Figure 24:
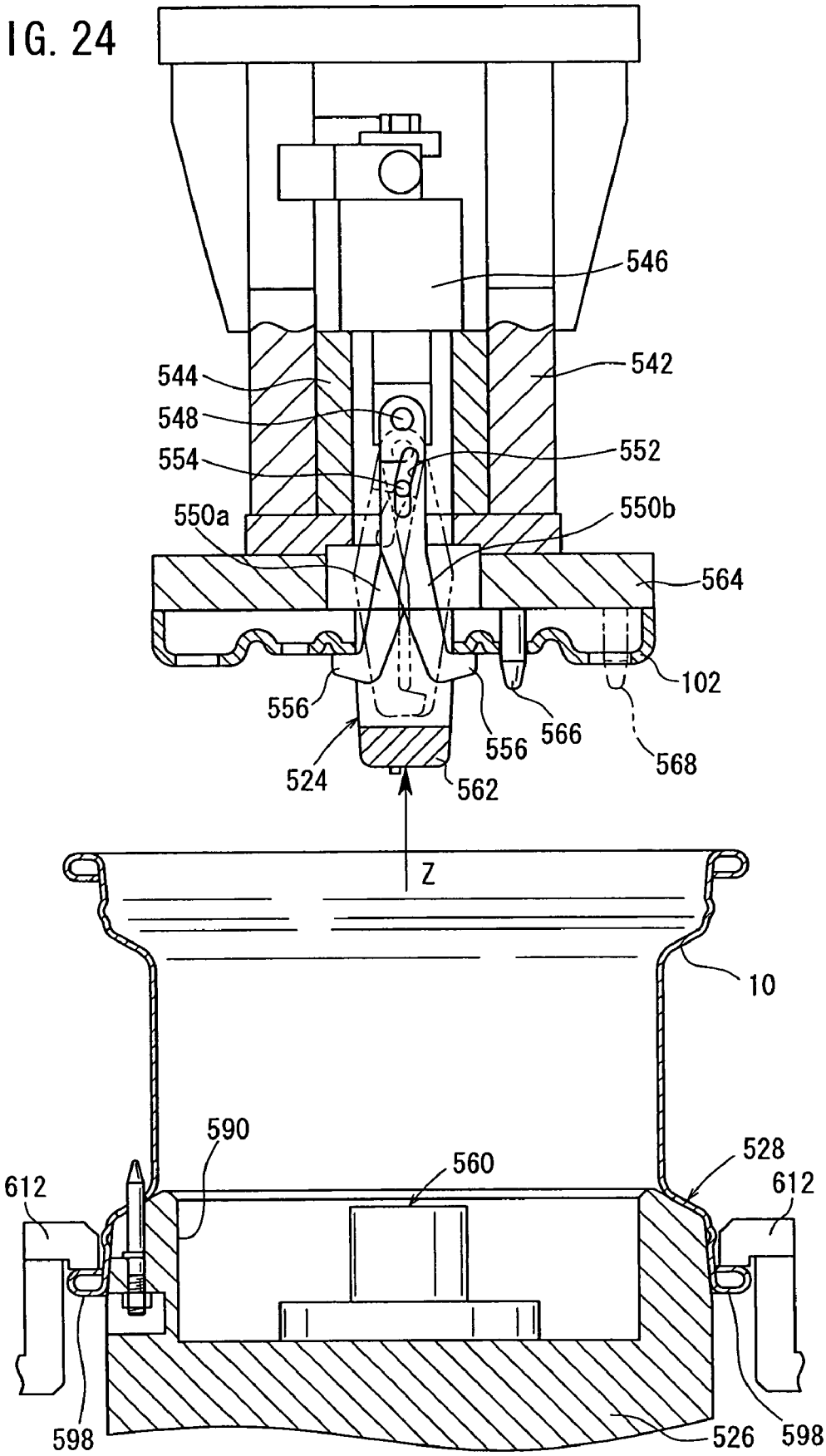
FIG. 24 is an enlarged fragmentary vertical cross-sectional view of an upper die unit and a lower die unit of the disk pressing apparatus shown in FIG. 21.

As shown in FIGS. 21 and 24, the engaged member 560 has a pair of disk members having different diameters integrally stacked on each other. However, the engaged member 560 is not limited to the illustrated structure, but may be of another shape. The abutment member 562 of the upper die unit 524 and the engaged member 560 of the lower die unit 528 are held in coaxial alignment with each other.

Figure 28:
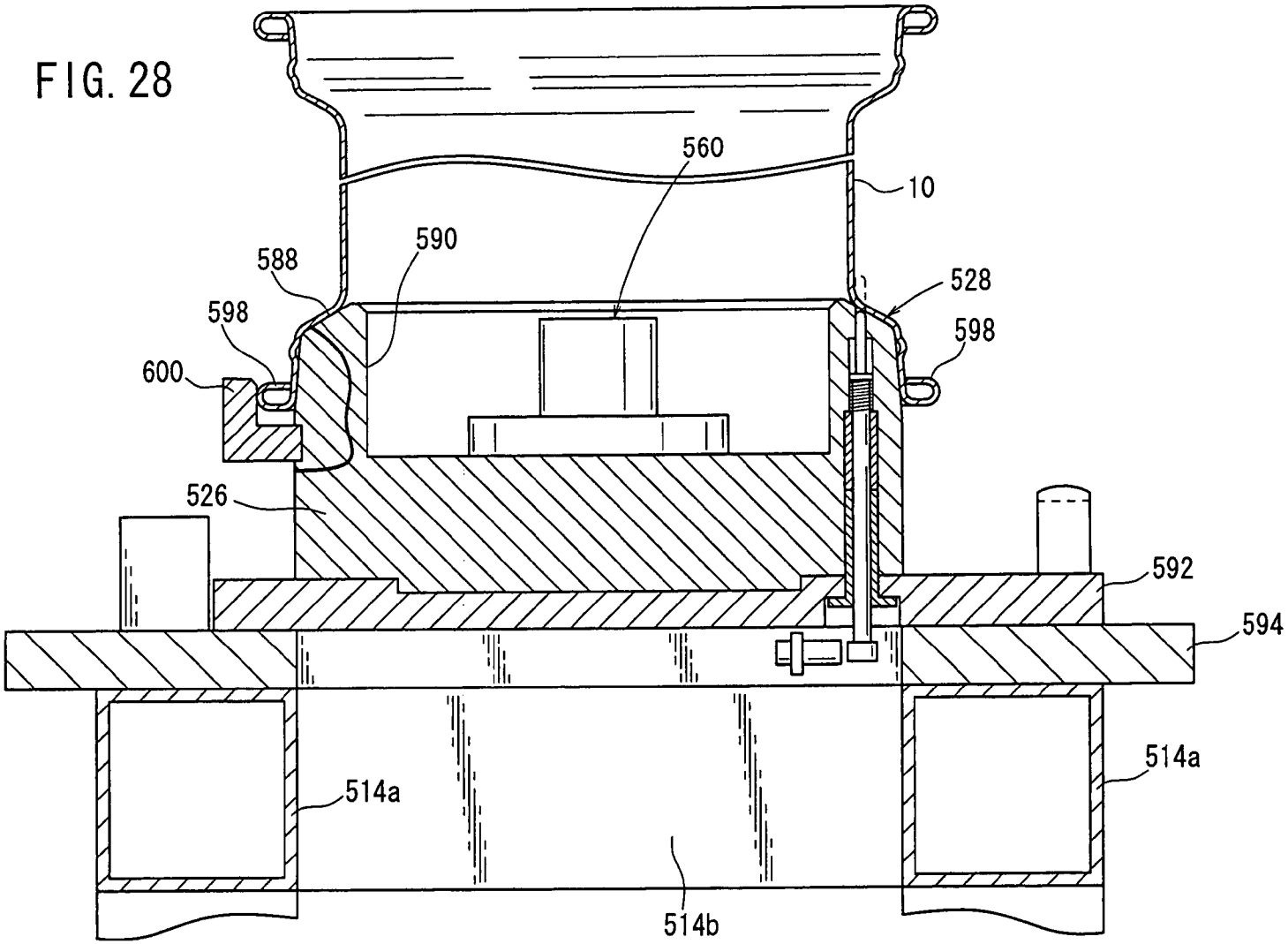
FIG. 28 is an enlarged fragmentary vertical cross-sectional view of the lower die unit.
Figure 29:
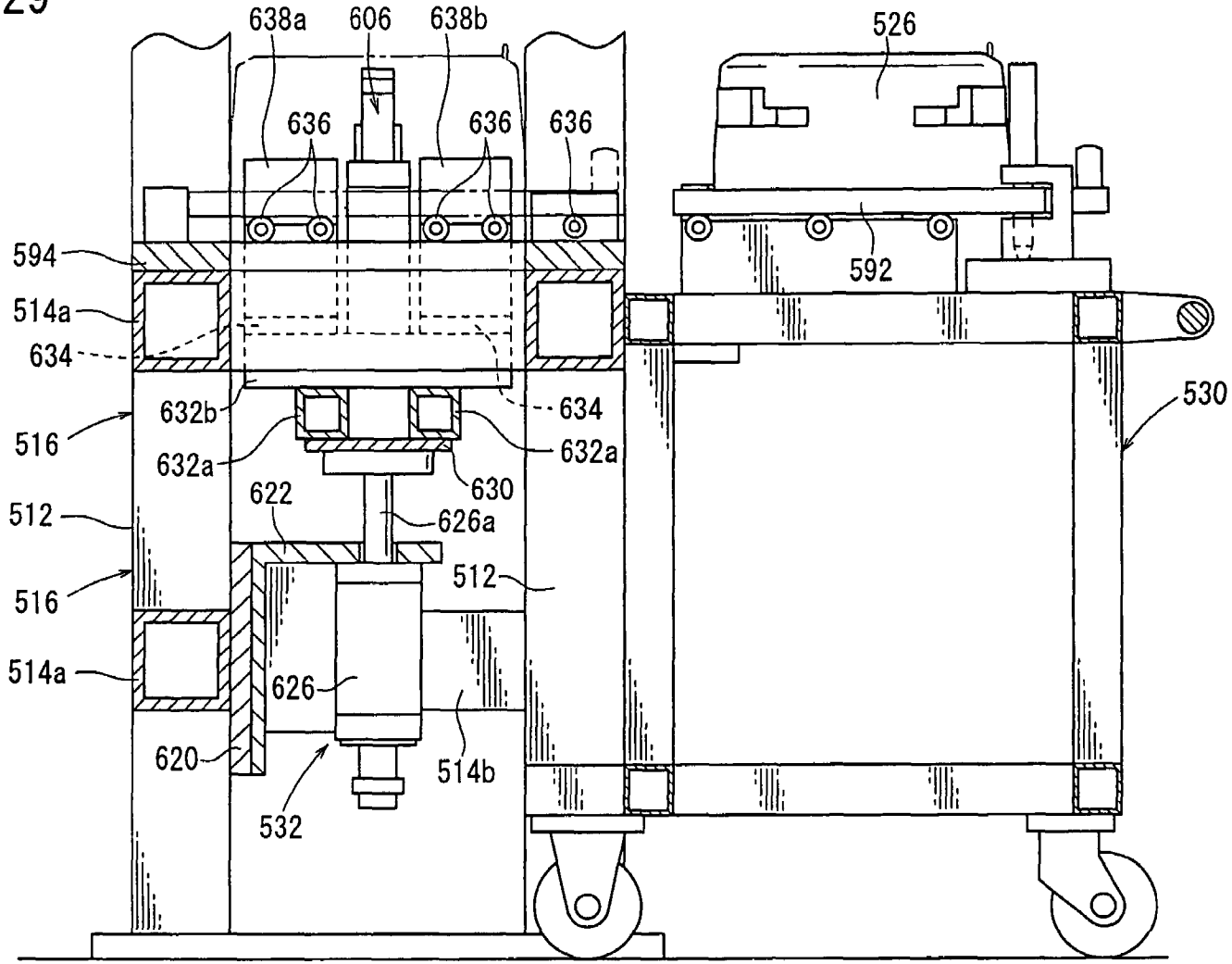
FIG. 29 is an enlarged fragmentary vertical cross-sectional view showing the manner in which the carriage is set on a frame to replace the rim holding die.

Four engaging blocks 600 (see FIG. 28) each having a substantially L-shaped cross section for engaging the curled portion 18 of the rim 10 are fixedly mounted on the outer wall surface of the rim holding die 526 at intervals of about 90° intervals in the circumferential direction.

Figure 27:
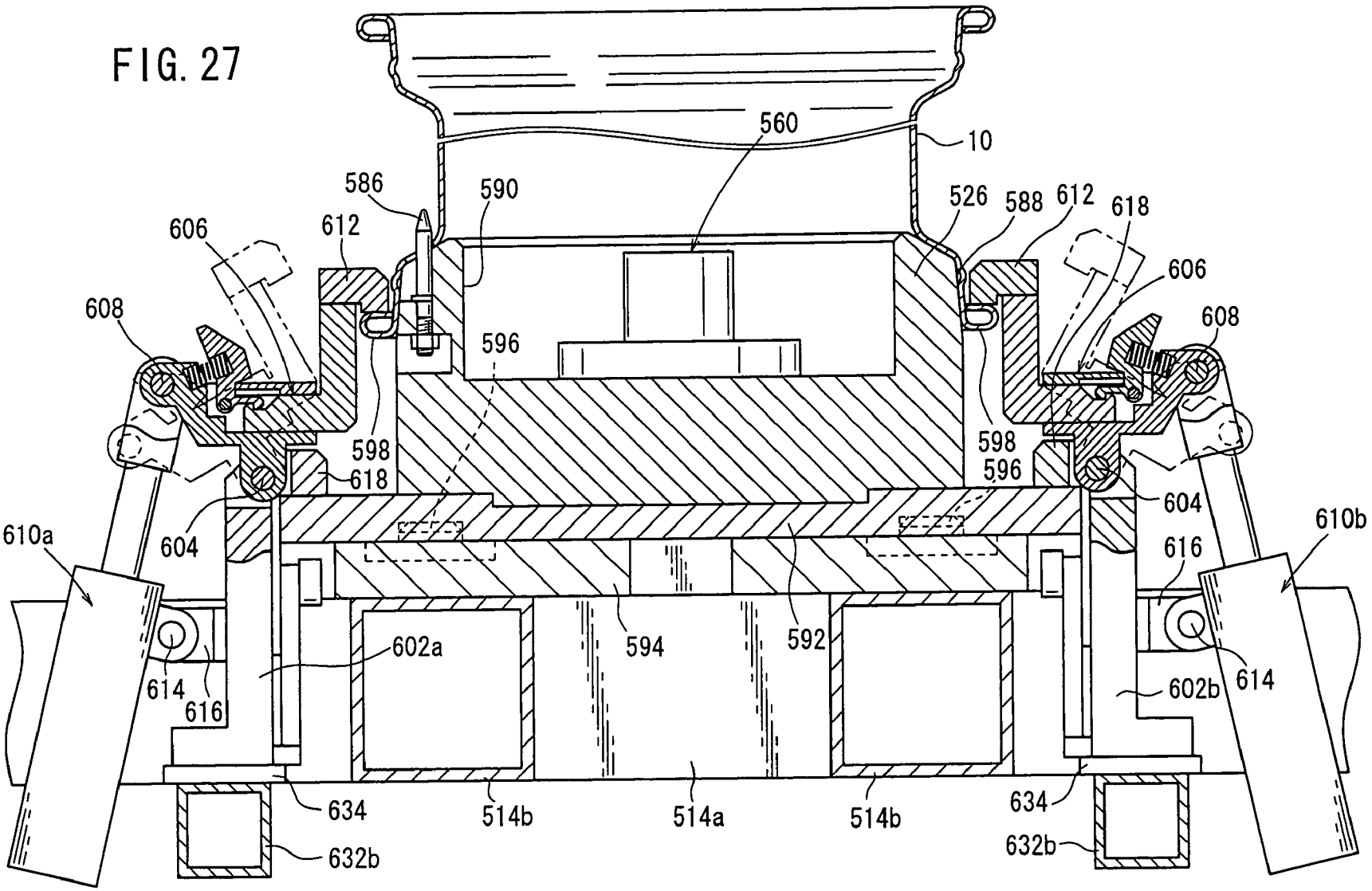
FIG. 27 is an enlarged fragmentary vertical cross-sectional view showing the manner in which a rim holding die of the lower die unit is clamped.

As shown in FIGS. 21, 22, and 27, the rim fixing means includes a pair of support blocks 602*a*, 602*b* fixedly mounted on a joint plate of the lifter 532, to be described later, in confronting relation to each other with the rim holding die 526 disposed therebetween, a pair of clamp members 606 angularly movably coupled to the respective support blocks 602*a*, 602*b* for angular movement through a predetermined angle about first joint pins 604, and a pair of fourth cylinders 610*a*, 610*b* coupled to the respective clamp members 606 by second joint pins 608 and having respective piston rods that are movable back and forth for angularly moving the clamp members 606 through a predetermined angle about the first joint pins 604.

As shown in FIG. 27, the clamp members 606 have respective clamp fingers 612 for contacting and pressing the curled portions 18 of the rim 10 downwardly. The fourth cylinders 610*a*, 610*b* have respective cylinder tubes coupled to the respective support blocks 602*a*, 602*b* by third joint pins 614 and joint members 616.

The support blocks 602*a*, 602*b* have respective bent portions 618 on upper ends thereof which press the upper surface of the pallet 592 to secure the pallet 592 to the support plate 594.

As shown in FIGS. 21 through 23 and 29, the lifter 532 includes a first flat plate 620 and a second plate 622 of an L-shaped cross section which are fixed to a side wall of the long beam 514*a* that extends horizontally between the vertical support posts 512 that extend substantially parallel to each other, a pair of guide members 624*a*, 624*b* and a lifter cylinder 626 which are fixed to a bent portion of the second plate 622, and a flat lifter plate 630 fixed to the end of a piston rod 626*a* of the lifter cylinder 626 and the ends of guide rods 628 of the guide members 624*a*, 624*b*.

Four die frames 632*a*, 632*b* each in the form of a hollow rectangular tube are stacked substantially in the shape of a curb and fixed to the upper surface of the lifter plate 630. The support blocks 602*a*, 602*b* of the rim fixing means and a first side plate 638*a* and a second side plate 638*b* are fixedly mounted by respective joint plates 634 on the respective upper die frames 632*b* which are spaced a predetermined distance from each other and extend substantially parallel to each other. The first side plate 638*a* and the second side plate 638*b* support a plurality of rollers 636 rotatably mounted thereon which will engage the lower surface of the pallet 592 when the lifter plate 630 is lifted by the lifter cylinder 626.

When the lifter cylinder 626 is actuated, the lifter plate 630 is guided along the guide rods 628 to lift or lower, in unison, the rim fixing means including the four curb-shaped die frames 632*a*, 632*b*, the joint plates 634, and the fourth cylinders 610*a*, 610*b*, and the first side plate 638*a* and the second side plate 638*b* with the rollers 636 rotatably mounted thereon, which are all disposed on the lifter plate 630.

The disk is pressed into the rim by the disk pressing apparatus that is arranged as described above, in the following manner.

The upper die unit 524 is locked by the second cylinders 534*a*, 534*b* and held in the uppermost position as an initial position.

In the initial position, the disk 102 is engaged by the holding plate 564 and the abutment member 562 of the upper die unit 524, and is positioned and set by the positioning pin 566. After the disk 102 is set on the upper die unit 524, the third cylinder 546 is actuated to displace the fingers 556 of the clamp arms 550*a*, 550*b* away from each other and cause the fingers 556 to hold the disk 102, thereby fixing the disk 102 to the upper die unit 524.

The rim 10 is set on the support surface 588 of the rim holding die 526 of the lower die unit 528, and the fourth cylinders 610*a*, 610*b* are actuated to clamp the curled portions 18, thereby fixing the rim 10 to the rim holding die 526. When the rim 10 is set on the rim holding die 526, the rim 10 is positioned in place by the positioning pin 586 on the rim holding die 526, and the curled portions 18 of the rim 10 are engaged and guided by the four engaging blocks 600 that are disposed circumferentially along the outer wall surface of the rim holding die 526.

In the above process, after the disk 102 is first set on the upper die unit 524, the rim 10 is set on the lower die unit 528. However, the rim 10 may first be set on the lower die unit 528, and then the disk 102 may be set on the upper die unit 524.

After the disk 102 is fixed to the upper die unit 524 and the rim 10 is fixed to the lower die unit 528, the first cylinder 520 (e.g., a hydraulic cylinder) mounted on the upper plate 518 is actuated to lower the upper die unit 524 with the disk 102 held thereon while the upper die unit 524 is being guided by the guide rods 522*a*, 522*b*. The lower die unit 528 is not displaced because it is fixed to the frame 516 by the support plate 594.

Figure 30:
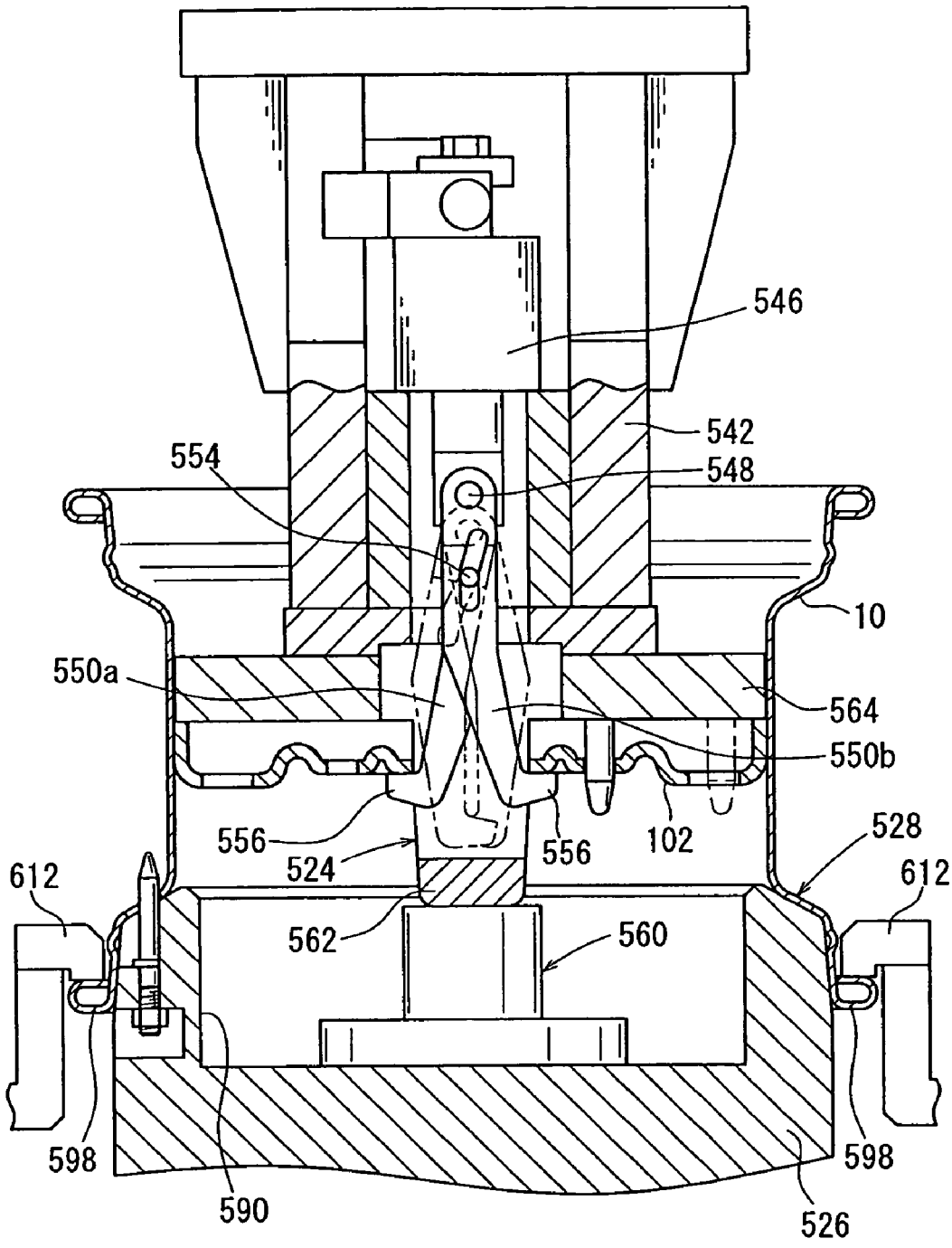
FIG. 30 is an enlarged fragmentary vertical cross-sectional view showing the manner in which an engaging member abuts against an engaged member when the disk fixed to the upper die unit is pressed into an opening in the rim fixed to the lower die unit.

When the disk 102 is lowered in unison with the upper die unit 524, the disk 102 is pressed into the rim 10 along the opening thereof. When the abutment member 562 of the upper die unit 524 abuts against the engaged member 560 disposed in the cavity 590 in the rim holding die 526, the downward movement of the upper die unit 524 is limited, whereupon the process of pressing the disk 102 into the rim 10 is completed (see FIG. 30). In this manner, the pressure-fitted product 100 shown in FIGS. 18 and 19 is obtained.

After the process of pressing the disk 102 into the rim 10 is completed, the third cylinder 546 is actuated to displace the fingers 556 of the clamp arms 550*a*, 550*b* toward each other, thereby unclamping the disk 102. The first cylinder 520 is actuated to elevate the upper die unit 524 and hold it in the initial position, and the fourth cylinders 610*a*, 610*b* are actuated to unclamp the curled portions 18 of the rim 10. Then, a next step can be performed.

The rims 10 are classified into many types depending on the overall axial length thereof. The engaged member 560 and the lower die unit 528 may be replaced with those corresponding to the rim 10 to be processed, providing an adjusted vertical dimension at which the engaged member 560 is engaged by the abutment member 562. Therefore, the depth to which the disk 102 is pressed into the rim 10 can freely be set.

As can be seen from FIG. 20, the pressure-fitted product 100 has a substantially v-shaped groove 120 defined by the inner side surface of a well portion 10*d* of the rim 10 and the end face 119*a* of the peripheral edge portion 119 of the disk 102. The groove 120 has a depth D from the slanted surface 119*b*. When the rim 10 and the disk 102 are welded by MIG welding or the like from the inner side surface to the slanted surface 119*b*, a welded bead 700 is formed, producing a wheel 122.

Figure 31:
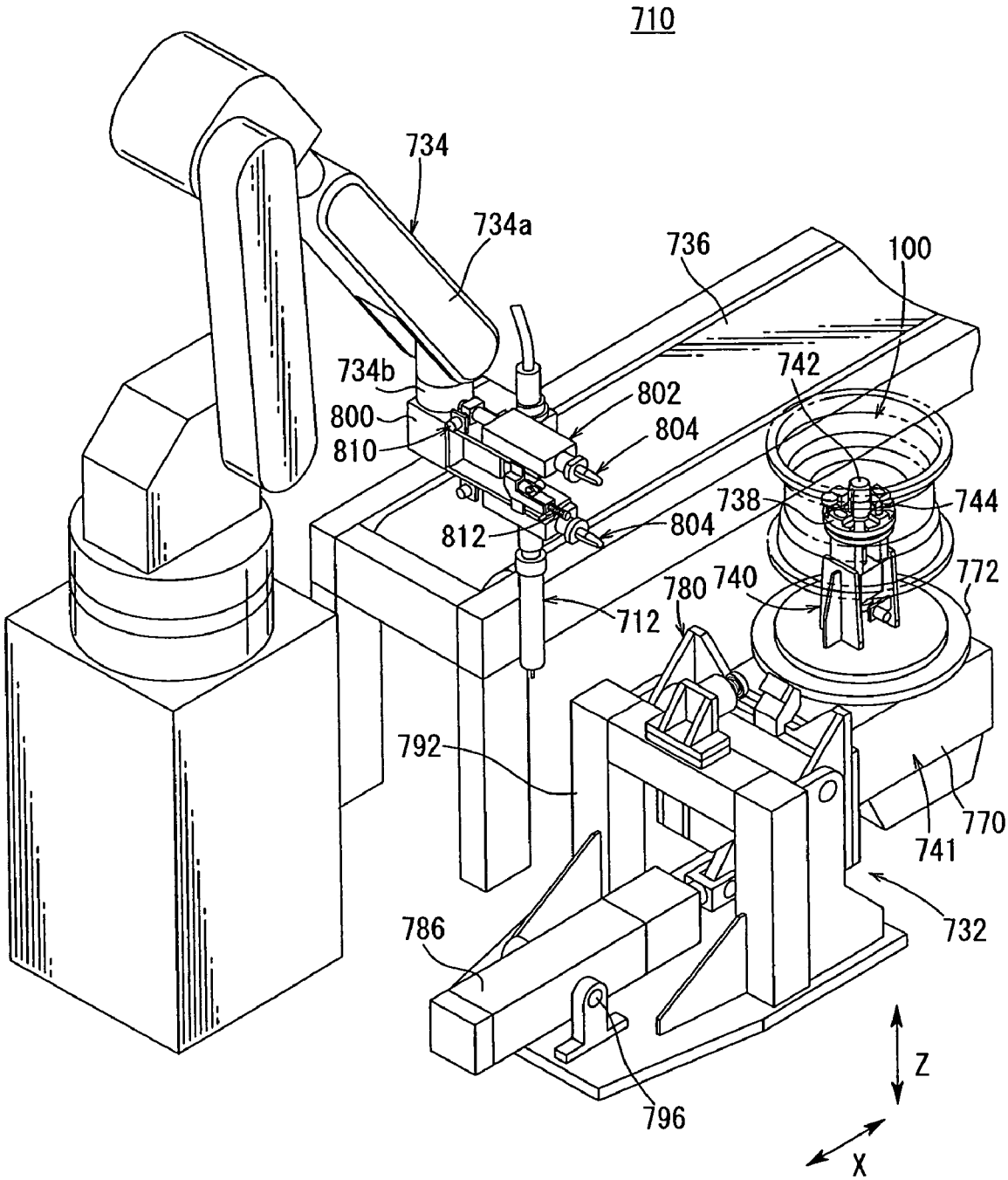
FIG. 31 is a schematic perspective view of a welding system.

FIG. 31 is a perspective view of a welding system 710 for performing such a welding process.

As shown in FIG. 31, the welding system 710 has a placing/tilting means 732 for positioning and placing the pressure-fitted product 100 after it is supplied by a supply conveyor, not shown, for example, and tilting the pressure-fitted product 100, a trainable articulated robot 734 having a welding torch 712 mounted thereon, and a feed conveyor 736 such as a belt conveyor or the like for feeding a wheel 122, which has been produced by welding the rim 10 and the disk 102 with the welding torch 712, to a subsequent process such as an inspection process or the like.

Figure 32:
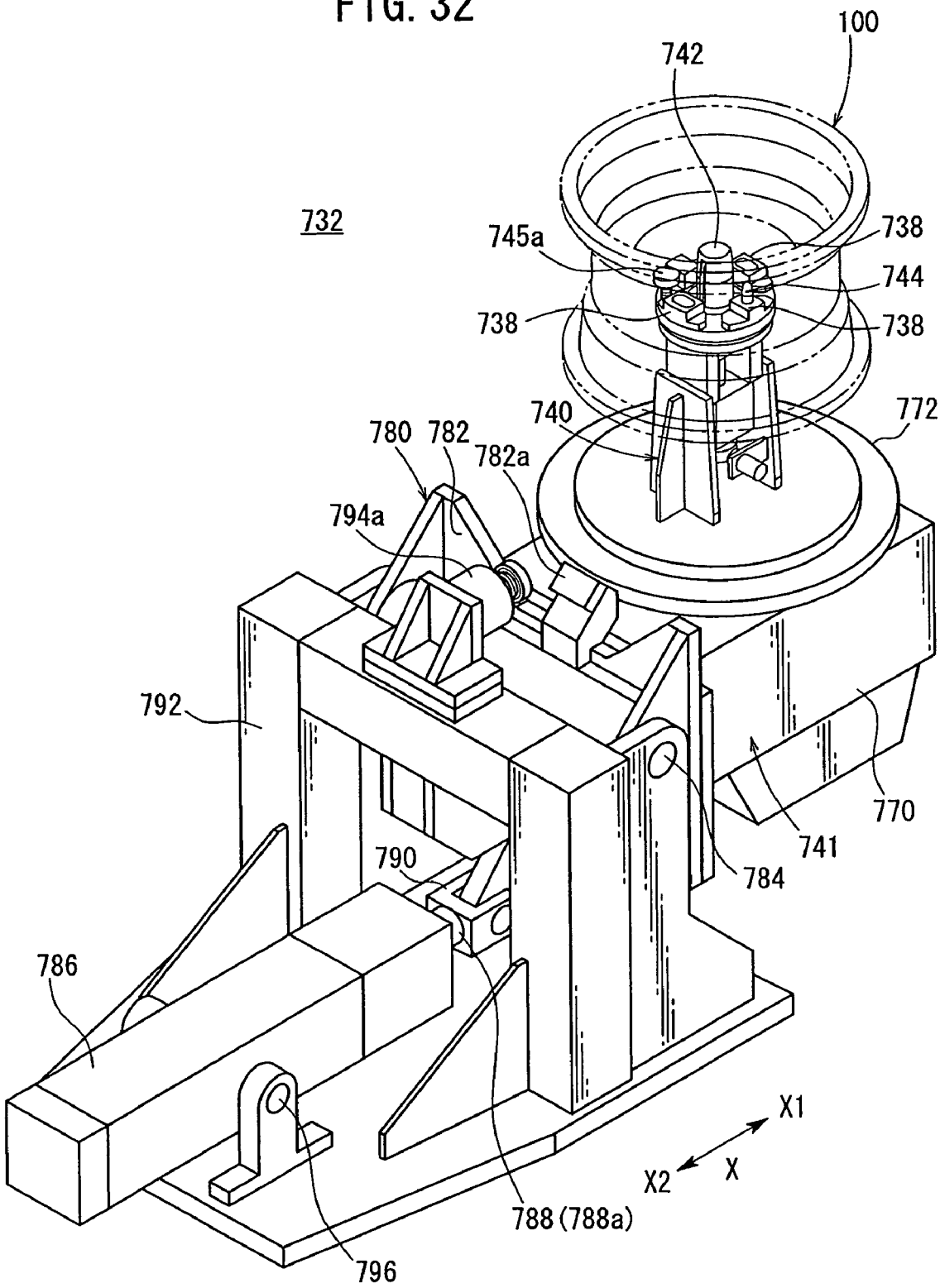
FIG. 32 is a perspective view of a placing/tilting means of the welding system shown in FIG. 31.
Figure 33:
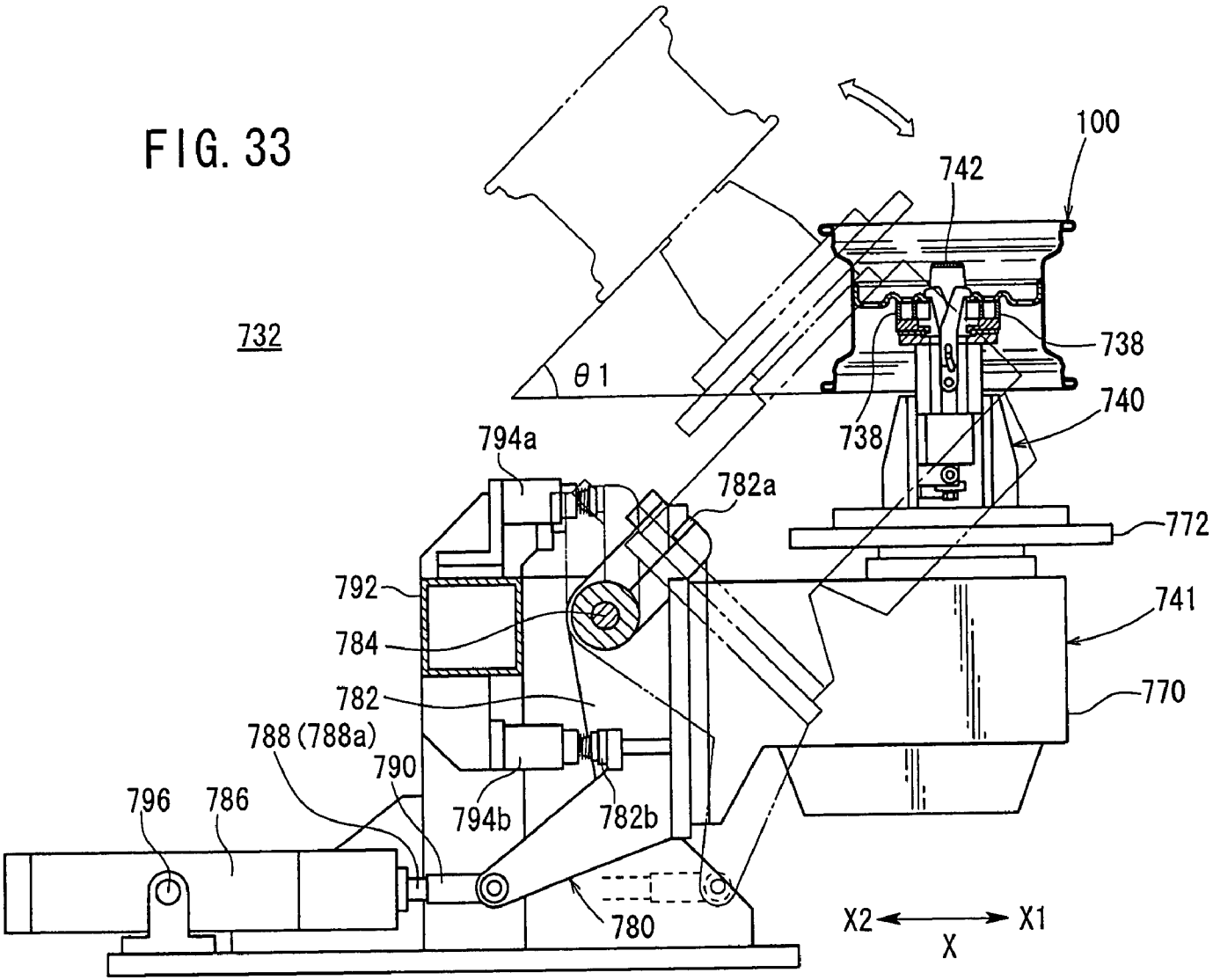
FIG. 33 is a view, partly in cross section, of the placing/tilting means shown in FIG. 32.

As shown in FIGS. 32 and 33, the placing/tilting means 732 has a placement unit 740 for supporting the pressure-fitted product 100 (wheel 122) with support blocks 738, and a base 741 on which the placement unit 740 is mounted.

Figure 34:
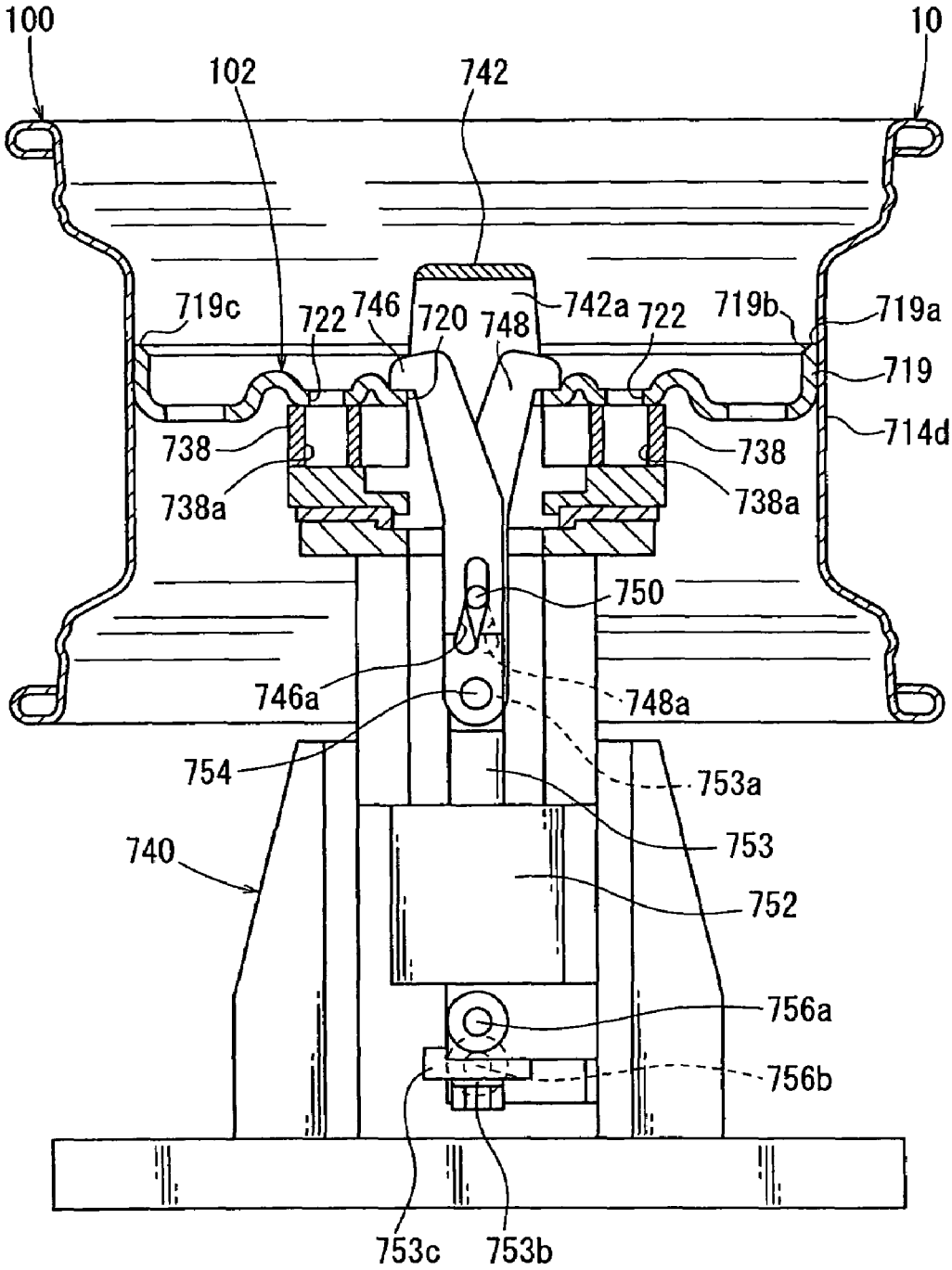
FIG. 34 is an enlarged cross-sectional view of a placing unit of the placing/tilting means shown in FIG. 33.
Figure 35:
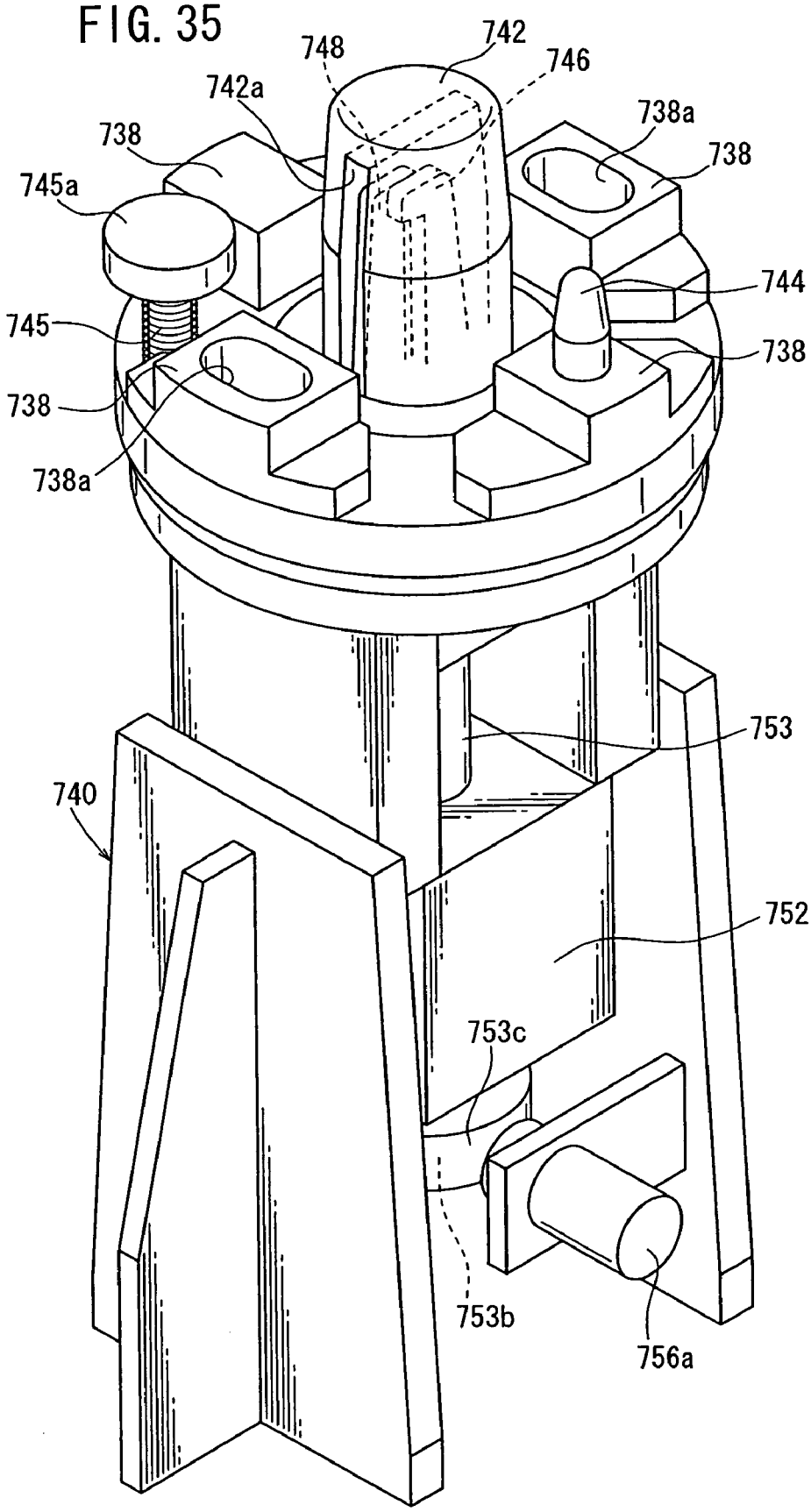
FIG. 35 is an enlarged perspective view of the placing unit shown in FIG. 34.
Figure 36:
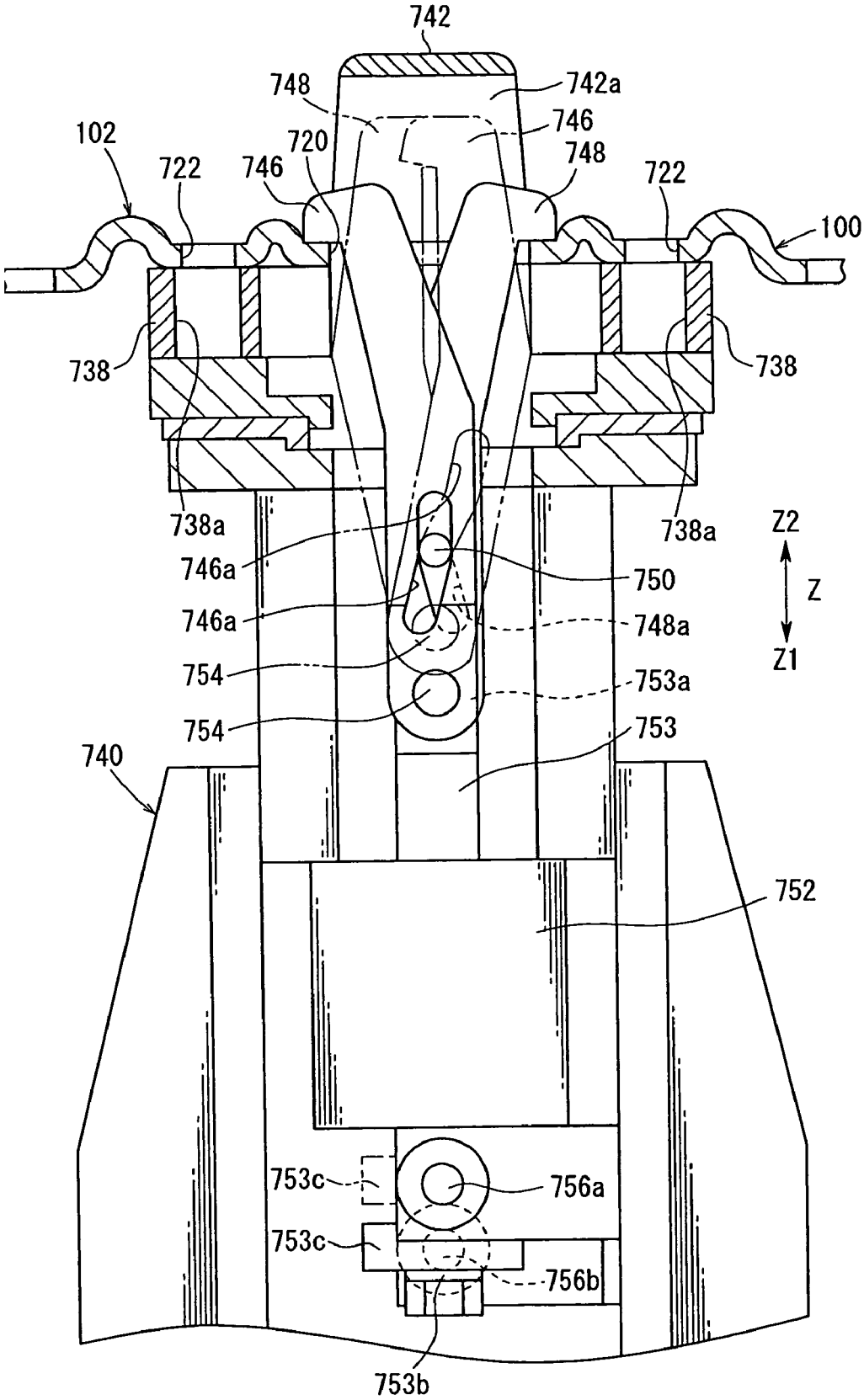
FIG. 36 is an enlarged fragmentary cross-sectional view of the placing unit shown in FIG. 34.

As shown in FIGS. 34 through 36, the placement unit 740 has an insertion block 742 for guiding the disk 102 through the hub hole 114 and radially positioning the pressure-fitted product 100 when the pressure-fitted product 100 is placed on the support blocks 738, and a positioning pin 744 for circumferentially positioning the pressure-fitted product 100 on the support block 738 through a bolt hole 116 in the disk 102.

The support blocks 738 are disposed in circumferentially spaced positions aligned respectively with the bolt holes 116. Two of the support blocks 738 which are positioned diametrically opposite to each other have clearance holes 738*a* defined therein for respective clamps 804 of a gripping means 802 to be described later. Near the support blocks 738, there are disposed a detecting shaft 745 having an abutment surface 745*a* for determining whether the pressure-fitted product 100 engages the support blocks 738 or not, and a shaft detector (not shown) for detecting a positionally adjustable detected member, the shaft detector being disposed on an opposite side of the abutment surface 745*a* of the detecting shaft 745.

The insertion block 742 is of a tapered shape that is progressively smaller in diameter upwardly. The insertion block 742 has a slit 742*a* defined diametrically therethrough and housing therein a pair of clamps 746, 748 that can be opened and closed to secure and release the pressure-fitted product 100. The clamps 746, 748 have fingers on their tip ends.

The clamps 746, 748 have bent elongate guided holes 746*a*, 748*a* defined respectively therein, and a guide shaft 750 fixed at a position below the support blocks 738 extends through the guided holes 746*a*, 748*a*. The clamps 746, 748 are angularly movably coupled by a joint pin 754 to an end 753*a* of a rod 753 of a cylinder 752 such as an air cylinder or the like, for example. The clamps 746, 748 can be moved back and forth when the cylinder 752 is actuated. When the clamps 746, 748 are moved back and forth by the cylinder 752, the clamps 746, 748 are guided by the guide shaft 750 in the guided holes 746*a*, 748*a* so as to be opened and closed.

A positionally adjustable detected member 753*c* is mounted on the other end 753*b* of the rod 753 of the cylinder 752. A pair of rod detectors 756*a*, 756*b*, which are made of proximity sensors or the like, are disposed near the other end 753*b* of the rod 753 for adjusting the stroke of back-and-forth movement of the cylinder 752 by detecting the detected member 753*c*. Stated otherwise, the positional relationship of the rod detectors 756*a*, 756*b* with respect to the rod 753 of the cylinder 752 may be adjusted to handle different wheel types depending on the wall thickness of the disk 102 of the pressure-fitted product 100. With this arrangement, different wheel types can efficiently be switched.

A workpiece detector, not shown, made of a transmissive sensor or the like is disposed near the placement unit 740 for detecting whether there is a pressure-fitted product 100 or not.

As shown in FIGS. 32 and 33, the base 741 has a housing 770 and a turntable 772 rotatably supported by the housing 770. The housing 770 houses therein a motor, not shown, such as a servomotor or the like. The turntable 772 is rotated when the motor is energized. The placement unit 740 is mounted on the turntable 772. Therefore, the pressure-fitted product 100 placed on the placement unit 740 is rotated when the motor is energized. A positioning means, not shown, having a knock pin or the like is disposed near the turntable 772 on the housing 770 for angularly positioning the turntable 772.

The placing/tilting means 732 has a tilting unit 780 which can be turned for tilting the base 741 and the placement unit 740. The tilting unit 780 has a support shaft 784 by which the base 741 is angularly movably supported through a bracket 782, and a cylinder 786 such as a hydraulic cylinder or the like for turning the base 741 together with the bracket 782 about the support shaft 784. The bracket 782 is angularly movably coupled to an end 788*a* of a rod 788 of a cylinder 786 by a joint member 790.

The support shaft 784 is fixed to a main frame 792 of the tilting unit 780. Therefore, the pressure-fitted product 100 placed on the placement unit 740 is turned upwardly, i.e., tilted upwardly, by the forward movement of the rod 788 in the direction indicated by the arrow X1 when the cylinder 786 is actuated. The pressure-fitted product 100 should preferably be tilted through an angle θ1 of about 45° (see FIG. 33) with respect to the horizontal direction of the welding system 710.

The tilting unit 780 has an upper stopper 794*a* including a spring, etc. for absorbing shocks produced when it is engaged by an abutment member 782*a* of the bracket 782 when the bracket 782 is turned and for positioning the bracket 782 in a predetermined tilted position, and a lower stopper 794*b* including a spring, etc., for absorbing shocks produced when it is engaged by an abutment member 782*b* of the bracket 782 when the tilted bracket 782 returns to a normal position (horizontal position) and for positioning the bracket 782 in a predetermined horizontal position. These stoppers 794*a*, 794*b* are fixed to the main frame 792. The cylinder 786 is angularly movably supported by a support member 796 so as to follow the arcuate path of the bracket 782 as it is turned when the rod 788 is moved back and forth.

Figure 37:
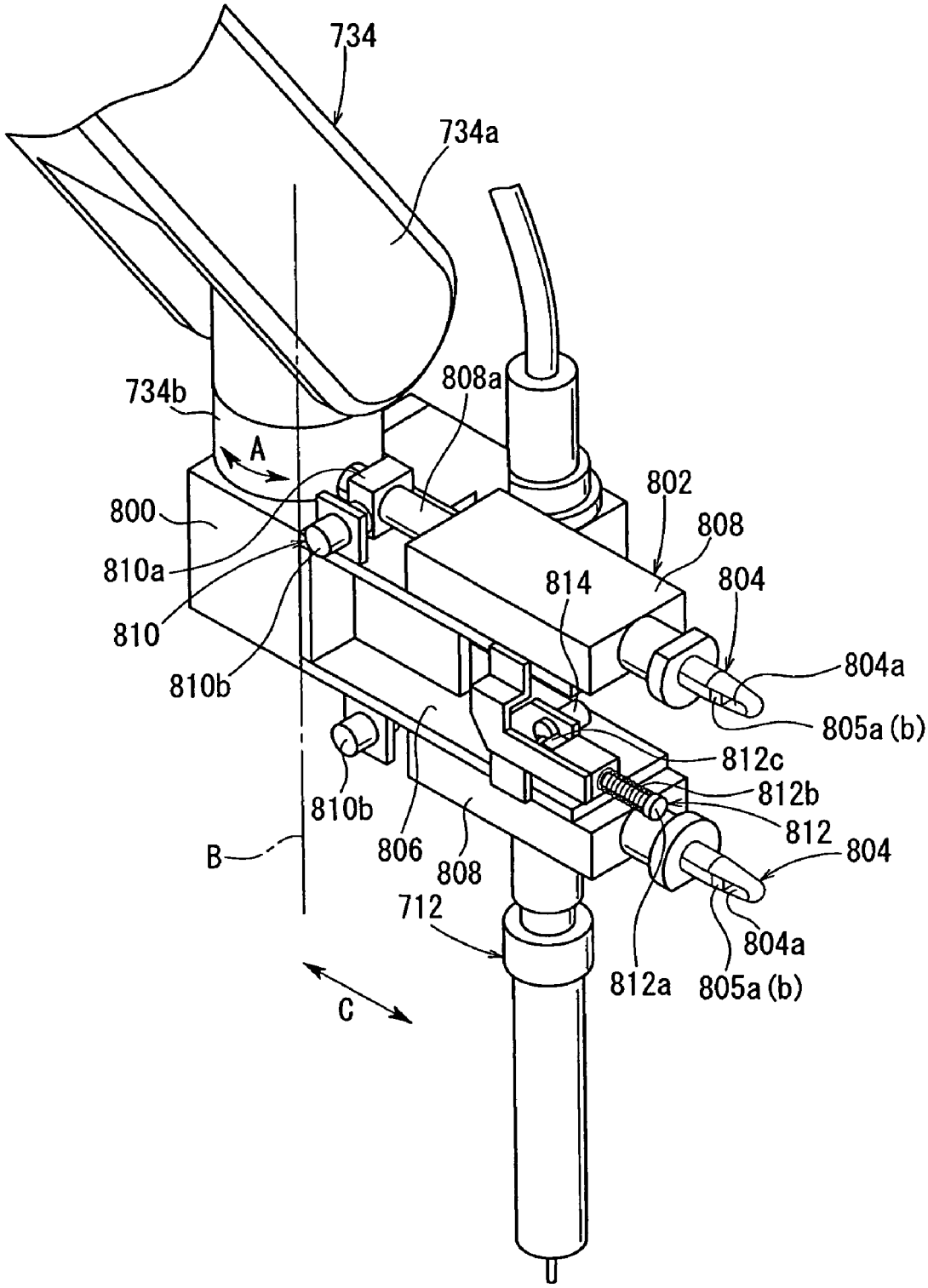
FIG. 37 is an enlarged perspective view of a welding torch and a gripping means of the welding system shown in FIG. 31.
Figure 38:
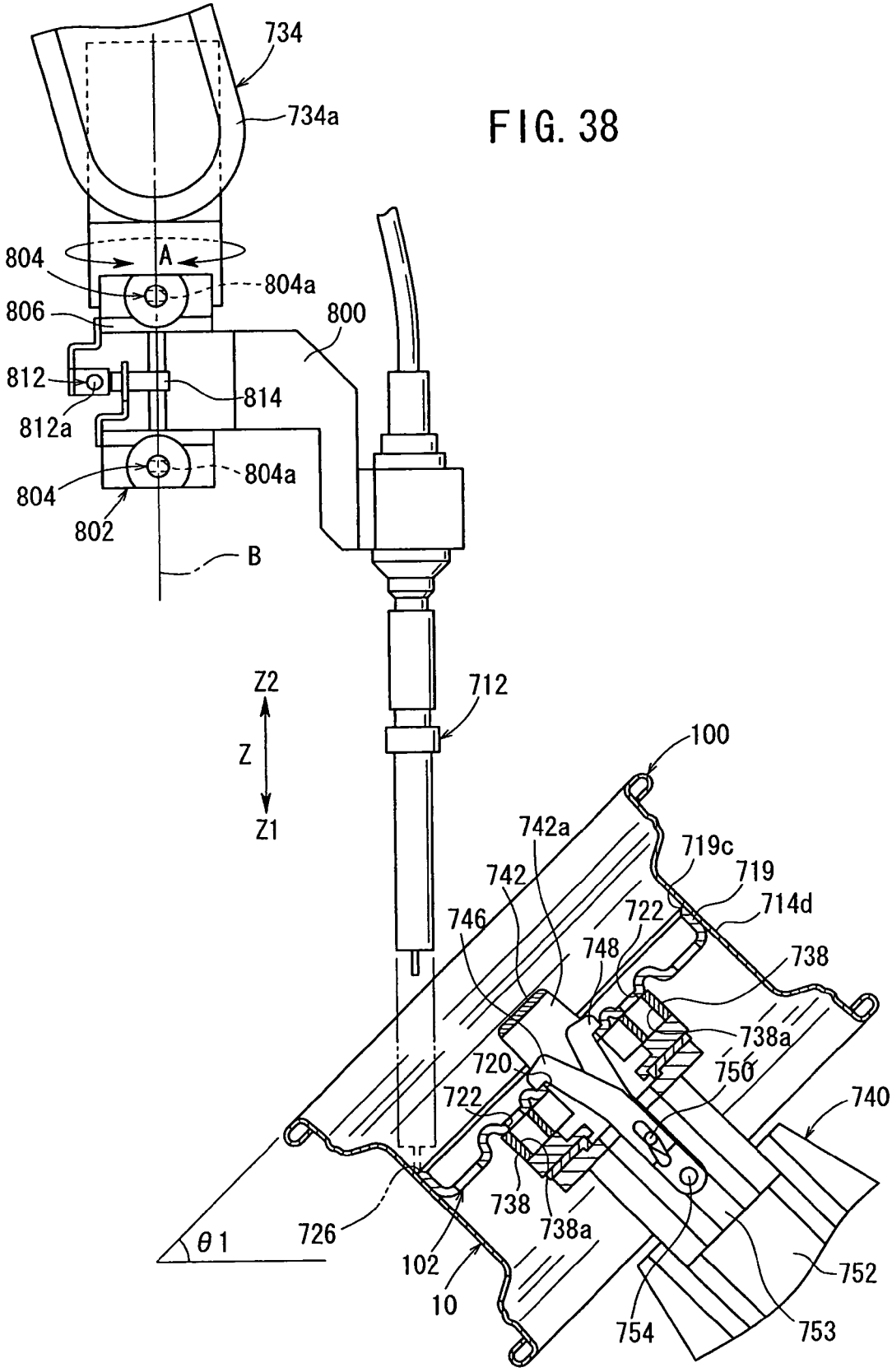
FIG. 38 is a side elevational view of the welding torch and the gripping means shown in FIG. 37.
Figure 39:
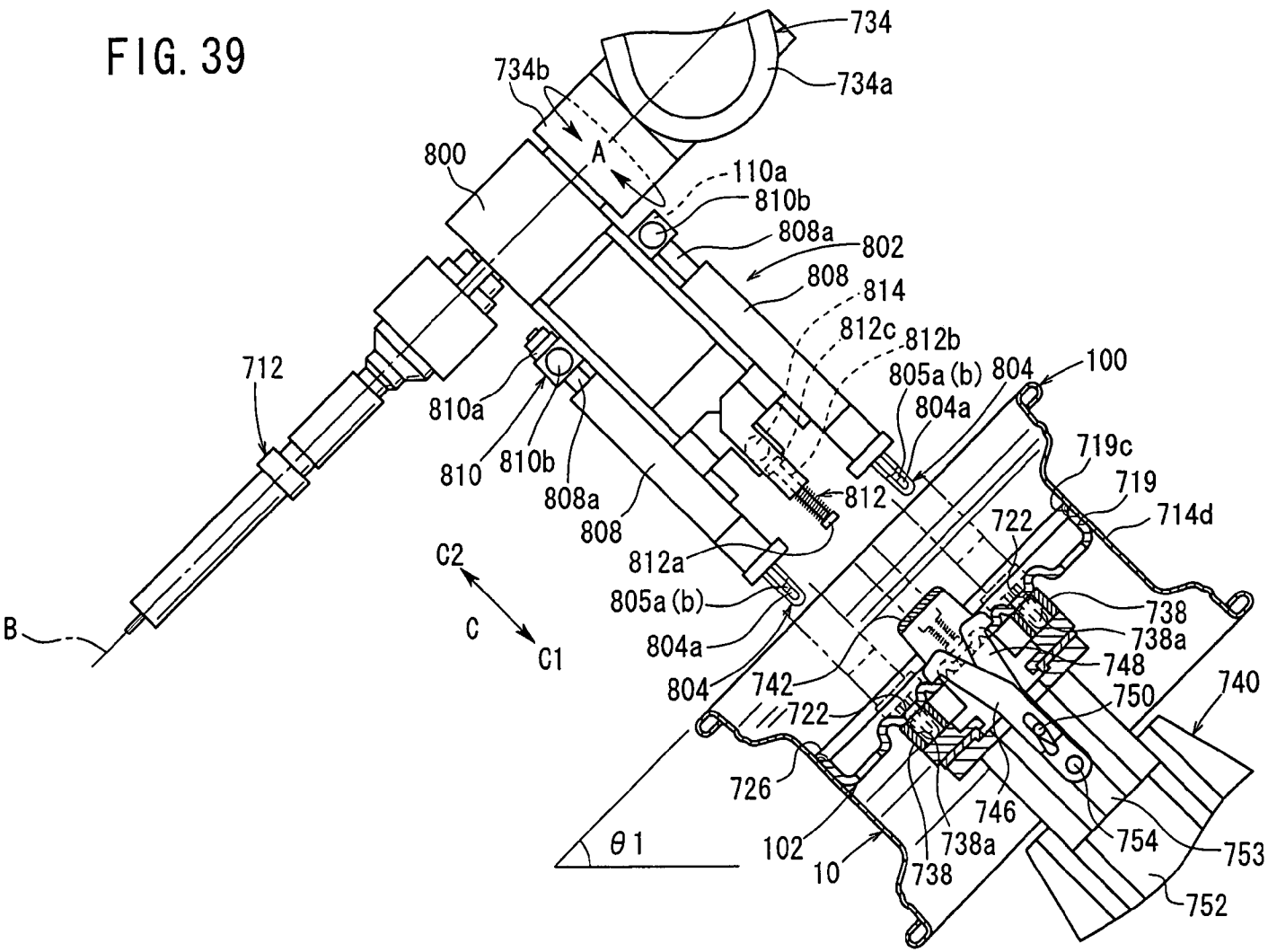
FIG. 39 is another side elevational view of the welding torch and the gripping means shown in FIG. 37.

As shown in FIGS. 37 through 39, the welding torch 712 has a bracket 800 and is mounted by the bracket 800 on a head 734*b* supported on a final arm 734*a* of the robot 734. The head 734*b* is rotatable with respect to the arm 734*a* (in the directions indicated by the arrow A in FIG. 37). Therefore, the welding torch 712 is rotatably supported by the head 734*b*. The bracket 800 has a gripping means 802 for removing the wheel 122 joined by the welding torch 712 from the placement unit 740. The gripping means 802 extends in a direction transverse to the axis B of rotation of the head 734*b* of the robot 734, e.g., a perpendicular direction (in the direction indicated by the arrow C in FIG. 37).

The gripping means 802 has a plurality of (e.g., two) clamps 804 for gripping the wheel 122 by being inserted into bolt holes 116 of the wheel 122. The clamps 804 are mounted on ends of respective cylinders 808 such as air cylinders or the like that are coupled to a seat 806. The clamps 804 have respective slits 804*a* defined therein and accommodating therein a pair of fingers 805*a*, 805*b* that are radially expanded or contracted to grip or release the bolt holes 116 from inside when the cylinders 808 are actuated.

The seat 806 has an adjuster 810 for adjusting a gripping force with which the fingers 805*a*, 805*b* of the clamps 804 grip the bolt holes 116 of the wheel 122. The adjuster 810 has a pair of positionally adjustable detected members 810*a* on rods 808*a* on the other ends of the cylinders 808 and a pair of rod detectors 810*b* such as proximity sensors or the like for detecting the detected members 810*a*.

The gripping force applied to the bolt holes 116 is adjusted depending on the stroke of back-and-forth movement of the rods 808*a* upon actuation of the cylinders 808. The clamps 804 have a mechanism, not shown, for adjusting the amount of expansion and contraction of the fingers 805*a*, 805*b* in response to the back-and-forth movement of the rods 808*a*. When the positions of the detected members 810*a* at the other ends of the rods 808*a*, particularly, the positions upon forward movement of the rods 808*a* (in the direction indicated by the arrow C1 in FIG. 39), are adjusted, the positions at which the rods 808*a* are stopped upon forward movement are determined. In this manner, the stroke of the rods 808*a* is adjusted to adjust the gripping force applied to the bolt holes 116. The adjuster 810 thus makes it possible to handle different wheel types depending on the wall thickness of the disk 102.

The seat 806 has a detector 812 for detecting when the clamps 804 abut against the wheel 122. The detector 812 has a detecting shaft 812*b* having an abutment surface 812*a* on one end thereof, a positionally adjustable detected member 812*c* on the other end of the detecting shaft 812*b*, and a detecting unit 814 such as a proximity sensor or the like for detecting the detected member 812*c*. The detector 812 is capable of reliably detecting when the clamps 804 abut against the wheel 122 and are inserted into the bolt holes 116.

The welding system 710 has a controller, not shown, for controlling the welding system 710 as a whole.

Operation of the welding system 710 will be described below.

When the pressure-fitted product 100 is placed on the support blocks 738 of the placement unit 740 by being guided by the insertion block 742 and positioned by the insertion block 742 and the positioning pin 744, the workpiece detector and the shaft detector output detected signals to the controller. In response to the detected signals, the controller outputs operation commands to the components of the welding system 710, which starts to operate.

First, the cylinder 752 is actuated to retract the rod 753 (in the direction indicated by the arrow Z1 in FIG. 36) and the guide shaft 750 guides the guided holes 746*a*, 748*a* to open the clamps 746, 748, fixing the pressure-fitted product 100 placed on the placement unit 740 to the support blocks 738.

Then, the cylinder 786 is actuated to move the rod 788 forward (in the direction indicated by the arrow X1 in FIGS. 32 and 33) to turn the bracket 782. As the bracket 782 is turned, the pressure-fitted product 100 placed on the placement unit 740 is turned upwardly until the bracket 782 abuts against the upper stopper 794*a*, whereupon the pressure-fitted product 100 is held at the tilted angle θ1. The tilted angle θ1 should preferably be set to 45°.

Then, the robot 734 operates to move the welding torch 712 toward the pressure-fitted product 100 held at the tilted angle θ1 (in the direction indicated by the arrow Z1 in FIG. 38). The tip end of the welding torch 712 is moved from a substantially vertical direction toward the slanted surface 119*b* or the edge 119*c* of the disk 102 (see FIG. 40).

After the turntable 772 is released for rotation by the positioning means, the pressure-fitted product 100 held at the tilted angle θ1 is rotated in unison with the placement unit 740 when the turntable 772 is turned by the motor in the base 741 (see FIGS. 32 and 33). At the same time, the tip end of the welding torch 712 is supplied with a welding rod or a welding wire, not shown, and the inner side surface of the well portion 10*d* of the rim 10 and the peripheral edge portion 119 of the disk 102 are welded based on operation commands under welding conditions set in the controller, e.g., commands for a welding current supplied to the welding torch 712 and a rotational speed of the motor. A welded bead 700 is now formed from the inner side surface of the rim 10 to the slanted surface 119*b* of the disk 102, thereby producing a wheel 122 (see FIGS. 38 and 40).

As the peripheral edge portion 119 of the disk 102 has the slanted surface 119*b*, it is possible to make the depth D of the groove 120 in the pressure-fitted product 100 as small as possible. Since the tip end of the welding torch 712 is oriented toward the slanted surface 119*b* or the edge 119*c* of the disk 102 during the welding process, the welded bead 700 reliably fills the groove 120 thereby preventing voids from forming in the groove 120. Therefore, the welded bead 700 is appropriately formed from the inner side surface of the rim 10 to the slanted surface 119*b* of the disk 102, increasing the bonding strength between the rim 10 and the disk 102. Particularly, when the tip end of the welding torch 712 is oriented toward the edge 119*c* during the welding process, because the welded bead 700 is suitably distributed to the end face 119*a* and the slanted surface 119*b* on both sides of the edge 119*c* as the boundary, the welded bead 700 is more appropriately formed from the inner side surface of the rim 10 to the slanted surface 119*b* of the disk 102.

With the disk 102 having the slanted surface 119*b*, it is possible to uniformize different heat masses posed on the welded bead 700 as a joined region, due to the different wall thicknesses of the rim 10 and the disk 102. As a result, the welded bead 700 is prevented from being exposed on the joined surface of the rim 10, and the welded bead 700 is more appropriately formed from the inner side surface of the rim 10 to the slanted surface 119*b* of the disk 102.

As the different heat masses posed on the welded bead 700 are uniformized as described above, the welded bead 700 is appropriately obtained even if it is formed at a high speed. Consequently, the wheel 122 can be produced with increased efficiency.

In this manner, it is possible to produce a sufficiently rigid wheel 122 (see FIGS. 18 and 19).

Figure 40:
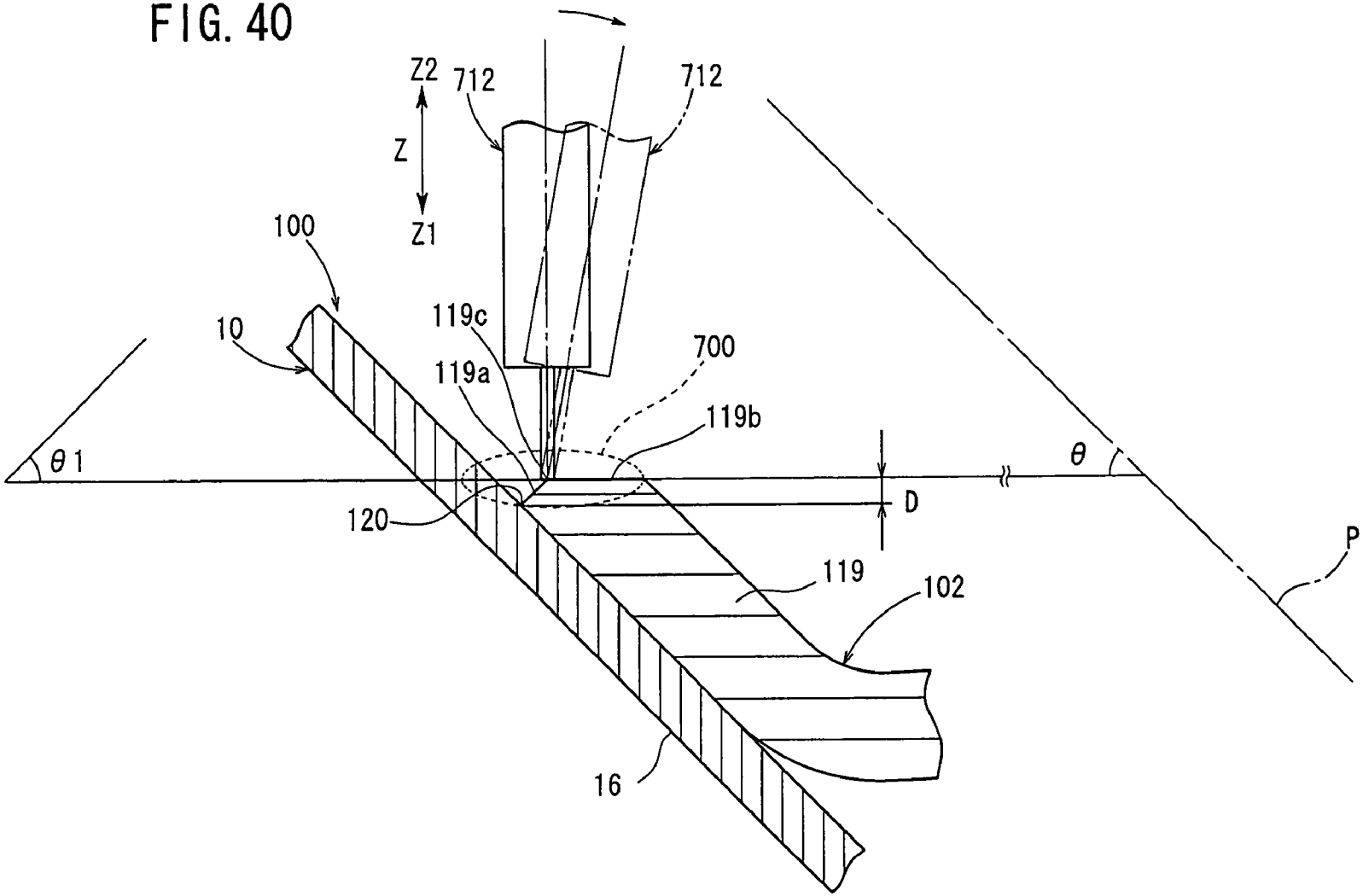
FIG. 40 is a view showing a mode of operation for forming a welded bead on the wheel shown in FIGS. 19 and 20.

The welding torch 712 may be tilted slightly from the vertical direction toward the central axis P of rotation of the wheel 122 (see the welding torch 712 represented by the two-dot-and-dash lines in FIG. 40). The welding torch 712 thus tilted allows the welded bead 700 to fill the groove 120 more easily, making it possible to form the welded bead 700 more appropriately and easily.

When the welded bead 700 is formed, the motor is de-energized to stop rotating the placement unit 740 and the wheel 122. At the same time, the positioning means is operated to position the turntable 772 in a predetermined angular position. Then, the robot 734 operates to move the welding torch 712 in a direction opposite to the direction described above, away from the welded bead 700 (in the direction indicated by the arrow Z2 in FIG. 38). Thereafter, the gripping means 802 is moved toward the disk 102 of the wheel 122, and the clamps 804 of the gripping means 802 are inserted into the bolt holes 116 in the disk 102 (in the direction indicated by the arrow C1 in FIG. 39).

The detector 812 detects whether the clamps 804 abut against the wheel 122 and are inserted in the bolt holes 116 or not. Specifically, when the abutment surface 812*a* of the detecting shaft 812*b* of the detector 812 abuts against the disk 102 and the detecting unit 814 detects the detected member 812*c*, the gripping means 802 stops moving toward the disk 102. The cylinders 808 are actuated to move the rods 808*a* forward (in the direction indicated by the arrow C1 in FIG. 39), spreading the fingers 805*a*, 805*b* of the clamps 804 to grip the wheel 122 through the bolt holes 116.

Then, the cylinder 752 is actuated in a direction opposite to the direction referred to above (in the direction indicated by the arrow Z2 in FIG. 36), closing the clamps 746, 748 to release the wheel 122 placed on the placement unit 740. The robot 734 operates to move the gripping means 802 in a direction opposite to the direction referred to above (in the direction indicated by the arrow C2 in FIG. 39). The wheel 122 is removed from the placement unit 740 and transferred toward the feed conveyor 736. At the same time, the cylinders 808 are actuated in a direction opposite to the direction referred to above, retracting the rods 808*a* (in the direction indicated by the arrow C2 in FIG. 39). The fingers 805*a*, 805*b* of the clamps 804 are contracted, releasing the wheel 122. The wheel 122 transferred onto the feed conveyor 736 is fed to a subsequent process such as an inspection process or the like, for example.

Then, the cylinder 786 is actuated in a direction opposite to the direction referred to above (in the direction indicated by the arrow X2 in FIGS. 32 and 33), and the bracket 782 abuts against the lower stopper 794*b*. The placement unit 740 is returned together with the bracket 782 to the normal position. The welding system 710 waits until it is supplied with a next pressure-fitted product 100. One cycle of the process performed by the welding system 710 for welding the pressure-fitted product 100 is now completed.

Figure 41:
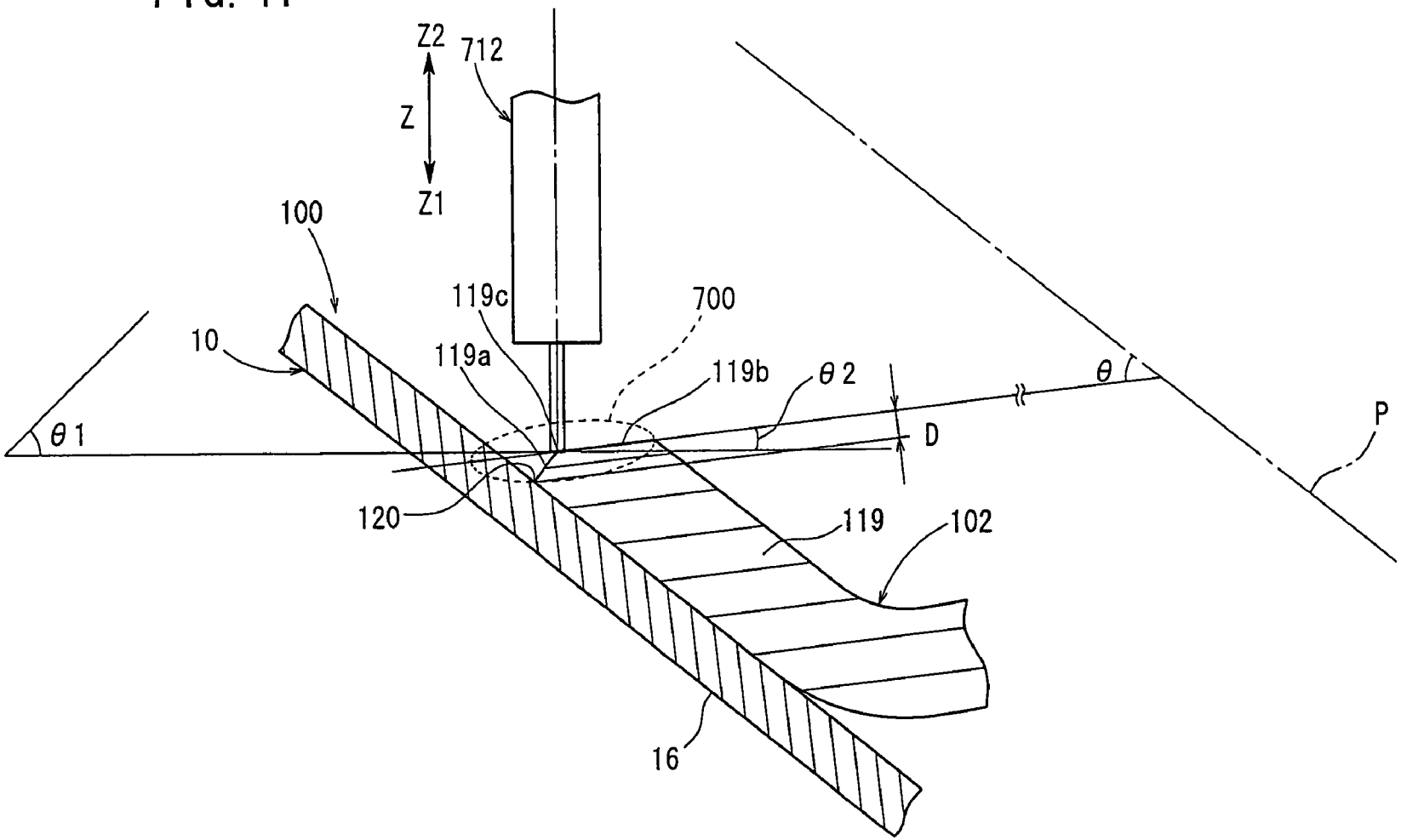
FIG. 41 is a view showing another mode of operation for forming a welded bead on the wheel shown in FIGS. 19 and 20.
Figure 42:
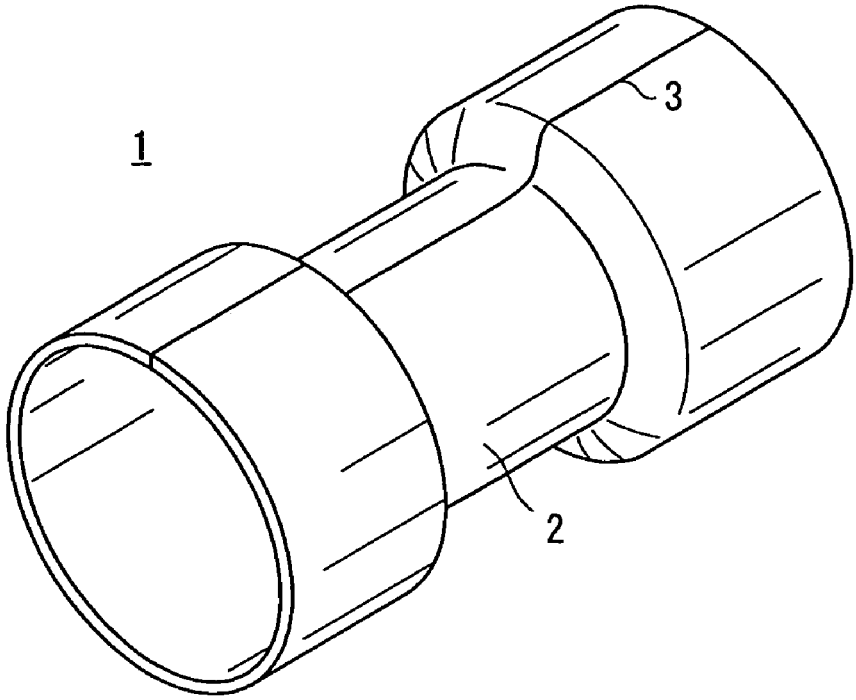
FIG. 42 is a schematic perspective view of a hollow cylindrical body with a drop portion.
Figure 43:
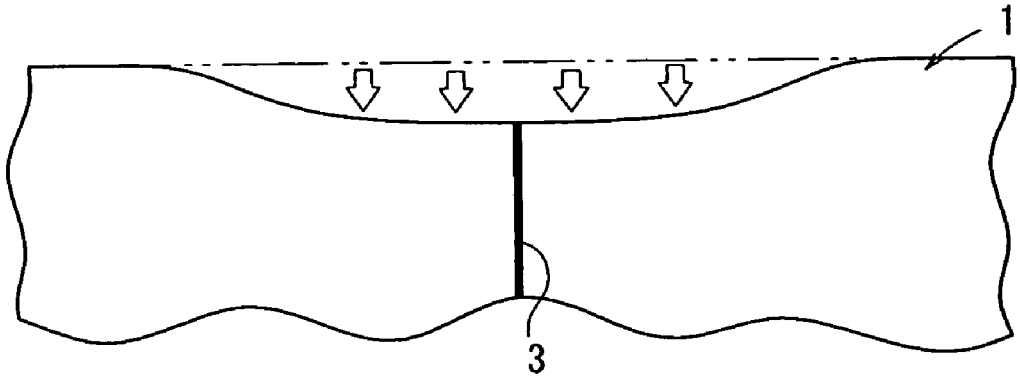
FIG. 43 is an enlarged fragmentary view showing an end of the hollow cylindrical body which is pulled to form a depressed region when the drop portion is formed.

As shown in FIG. 41, if the pressure-fitted product 100 placed on the placement unit 740 is further tilted toward the rim 10 and the tilted angle θ1 of the pressure-fitted product 100 with respect to the horizontal direction is kept as an acute angle in excess of 45°, then the slanted surface 119*b* of the disk 102 has a tilted angle θ2 with respect to the horizontal direction.

Alternatively, if the tilted angle θ of the slanted surface 119*b* of the disk 102 of the pressure-fitted product 100 is set to an acute angle in excess of 45° with respect to the central axis P of rotation of the wheel 122, then even if the tilted angle θ1 of the pressure-fitted product 100 placed on the placement unit 740 with respect to the horizontal direction is kept as 45°, the slanted surface 119*b* of the disk 102 has the tilted angle θ2 with respect to the horizontal direction as described above.

By keeping the tilted angle θ1 of the pressure-fitted product 100 as described above or setting the tilted angle θ of the slanted surface 119*b* of the disk 102 as described above, the slanted surface 119*b* of the disk 102 is more tilted toward the groove 120 of the pressure-fitted product 100. Therefore, the welded bead 700 fills the groove 120 more easily, so that the welded bead 700 can be formed more appropriately and easily.

The invention claimed is:

1. A method of manufacturing a wheel rim by bringing end faces of a workpiece into abutment against each other to form a hollow cylindrical body and forming a circumferential recess which is depressed from an outer circumferential wall of said hollow cylindrical body toward an inner circumferential wall thereof, said method comprising the steps of providing protrusions disposed near ends of a joined area of said hollow cylindrical body and extending in a joining direction, and then pressing said outer circumferential wall of said hollow cylindrical body having the protrusions to form said recess, such that the pressed hollow cylinder has substantially flush circumferential edges.

2. A method according to claim 1, wherein fingers are formed on respective corners of said workpiece and joined to form said protrusions.

3. A method according to claim 1, wherein said hollow cylindrical body is cut circumferentially to form said protrusions.

4. A method according to claim 1, wherein abutting edges of said hollow cylindrical body are joined to each other by friction stir welding.

5. A method according to claim 1, wherein said recess is formed by a spinning process or a roll forming process.

* * * * *